US008735037B2

(12) United States Patent
Yamashita et al.

(10) Patent No.: US 8,735,037 B2
(45) Date of Patent: May 27, 2014

(54) TONER, DEVELOPER, PROCESS CARTRIDGE, IMAGE FORMING METHOD, AND IMAGE FORMING APPARATUS

(75) Inventors: Hiroshi Yamashita, Shizuoka (JP); Masaki Watanabe, Shizuoka (JP); Tomoki Murayama, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 65 days.

(21) Appl. No.: 13/635,453

(22) PCT Filed: Mar. 16, 2011

(86) PCT No.: PCT/JP2011/057262
§ 371 (c)(1),
(2), (4) Date: Sep. 17, 2012

(87) PCT Pub. No.: WO2011/115304
PCT Pub. Date: Sep. 22, 2011

(65) Prior Publication Data

US 2013/0011779 A1 Jan. 10, 2013

(30) Foreign Application Priority Data

Mar. 18, 2010 (JP) ..... 2010-062761

(51) Int. Cl.
*G03G 9/087* (2006.01)

(52) U.S. Cl.
USPC ..... 430/109.4; 430/137.14

(58) Field of Classification Search
CPC ..... G03G 9/08755; G03G 9/08797; G03G 9/08795; G03G 9/0804; G03G 9/0806
USPC ..... 430/109.4, 137.14
See application file for complete search history.

(56) References Cited

U.S. PATENT DOCUMENTS

| | | | |
|---|---|---|---|
| 6,787,280 | B2 | 9/2004 | Yamashita et al. |
| 6,824,945 | B2 | 11/2004 | Emoto et al. |
| 7,005,223 | B2 | 2/2006 | Yamashita et al. |
| 7,074,541 | B2 | 7/2006 | Yamashita et al. |
| 7,110,710 | B2 | 9/2006 | Yamashita et al. |
| 7,214,461 | B2 | 5/2007 | Yamashita et al. |

(Continued)

FOREIGN PATENT DOCUMENTS

| | | |
|---|---|---|
| JP | 04-070765 | 3/1992 |
| JP | 2004-245854 | 9/2004 |

(Continued)

OTHER PUBLICATIONS

International Search Report Issued Jul. 26, 2011 in International Patent Application No. PCT/JP2011/057262 filed Mar. 16, 2011.

*Primary Examiner* — Hoa V Le
(74) *Attorney, Agent, or Firm* — Oblon, Spivak, McClelland, Maier & Neustadt, L.L.P.

(57) ABSTRACT

A toner obtained by a method for producing a toner, which includes dissolving or dispersing in an organic solvent a toner material containing at least a binder resin, and a dispersion liquid of a crystalline polyester resin, so as to prepare a solution or dispersion liquid of the toner material, emulsifying or dispersing the solution or dispersion liquid of the toner material in an aqueous medium, so as to prepare an emulsion or dispersion liquid, and removing the organic solvent from the emulsion or dispersion liquid, wherein the crystalline polyester resin is localized near a surface of the toner.

20 Claims, 7 Drawing Sheets

1 μm

(56) References Cited

U.S. PATENT DOCUMENTS

| | | | |
|---|---|---|---|
| 7,294,443 | B2 | 11/2007 | Yamashita et al. |
| 7,364,828 | B2 | 4/2008 | Yamashita et al. |
| 7,419,756 | B2 | 9/2008 | Yamashita et al. |
| 7,435,521 | B2 | 10/2008 | Yagi et al. |
| 7,455,942 | B2 | 11/2008 | Nagatomo et al. |
| 7,629,099 | B2 | 12/2009 | Yamashita et al. |
| 7,879,523 | B2 | 2/2011 | Yamashita et al. |
| 7,932,007 | B2 | 4/2011 | Yamashita et al. |
| 7,939,238 | B2 | 5/2011 | Yamashita et al. |
| 8,012,660 | B2 | 9/2011 | Yamashita et al. |
| 2002/0081510 | A1 | 6/2002 | Sugiyama et al. |
| 2003/0022084 | A1 | 1/2003 | Sugiyama et al. |
| 2003/0027066 | A1 | 2/2003 | Yamashita et al. |
| 2003/0027074 | A1 | 2/2003 | Emoto et al. |
| 2003/0055159 | A1 | 3/2003 | Yamashita et al. |
| 2003/0096185 | A1 | 5/2003 | Yamashita et al. |
| 2003/0113648 | A1 | 6/2003 | Tomita et al. |
| 2003/0134220 | A1 | 7/2003 | Emoto et al. |
| 2003/0138717 | A1 | 7/2003 | Yagi et al. |
| 2003/0152859 | A1 | 8/2003 | Emoto et al. |
| 2003/0219669 | A1 | 11/2003 | Yamashita et al. |
| 2004/0076899 | A1 | 4/2004 | Sugiyama et al. |
| 2004/0076900 | A1 | 4/2004 | Sugiyama et al. |
| 2004/0115551 | A1 | 6/2004 | Sugiyama et al. |
| 2004/0121256 | A1 | 6/2004 | Suzuki et al. |
| 2004/0131961 | A1 | 7/2004 | Watanabe et al. |
| 2004/0185365 | A1 | 9/2004 | Saito et al. |
| 2004/0259013 | A1 | 12/2004 | Ohtani et al. |
| 2005/0003288 | A1 | 1/2005 | Sugiyama et al. |
| 2005/0079433 | A1 | 4/2005 | Watanabe et al. |
| 2005/0196691 | A1 | 9/2005 | Ohtani et al. |
| 2006/0056888 | A1 | 3/2006 | Sugiyama et al. |
| 2006/0172214 | A1 | 8/2006 | Saito et al. |
| 2006/0177756 | A1 | 8/2006 | Sugimoto et al. |
| 2006/0240349 | A1 | 10/2006 | Watanabe et al. |
| 2007/0031752 | A1 | 2/2007 | Watanabe et al. |
| 2007/0141500 | A1 | 6/2007 | Sugimoto et al. |
| 2007/0275315 | A1 | 11/2007 | Nagatomo et al. |
| 2008/0032226 | A1 | 2/2008 | Sugiyama et al. |
| 2008/0070151 | A1 | 3/2008 | Sugimoto et al. |
| 2008/0131802 | A1* | 6/2008 | Mizutani et al. ..... 430/109.4 |
| 2008/0193869 | A1* | 8/2008 | Vanbesien et al. ..... 430/108.4 |
| 2008/0227002 | A1 | 9/2008 | Moriya et al. |
| 2008/0233496 | A1 | 9/2008 | Kotsugai et al. |
| 2008/0280218 | A1 | 11/2008 | Sabu et al. |
| 2008/0280219 | A1 | 11/2008 | Nakayama et al. |
| 2008/0318144 | A1 | 12/2008 | Watanabe et al. |
| 2008/0318148 | A1 | 12/2008 | Sugimoto et al. |
| 2009/0003885 | A1 | 1/2009 | Sabu et al. |
| 2009/0074467 | A1 | 3/2009 | Seshita et al. |
| 2009/0092917 | A1 | 4/2009 | Sugimoto et al. |
| 2009/0104555 | A1 | 4/2009 | Wakamatsu et al. |
| 2009/0214973 | A1 | 8/2009 | Sugimoto et al. |
| 2009/0233204 | A1 | 9/2009 | Watanabe et al. |
| 2009/0325099 | A1 | 12/2009 | Watanabe et al. |
| 2010/0035170 | A1 | 2/2010 | Sugimoto et al. |
| 2010/0075243 | A1 | 3/2010 | Shimota et al. |
| 2010/0075245 | A1 | 3/2010 | Watanabe et al. |
| 2010/0081075 | A1 | 4/2010 | Watanabe et al. |
| 2010/0310980 | A1 | 12/2010 | Sugimoto et al. |
| 2010/0316944 | A1 | 12/2010 | Nakajima et al. |
| 2011/0033794 | A1 | 2/2011 | Watanabe et al. |
| 2011/0223532 | A1 | 9/2011 | Sugimoto et al. |

FOREIGN PATENT DOCUMENTS

| | | |
|---|---|---|
| JP | 2005-024784 | 1/2005 |
| JP | 2006-208609 | 8/2006 |
| JP | 2006-337872 | 12/2006 |
| JP | 2008-015232 | 1/2008 |
| JP | 2008-268353 | 11/2008 |
| JP | 2009-109971 | 5/2009 |
| JP | 2011-186295 | 9/2011 |

* cited by examiner

TONER, DEVELOPER, PROCESS CARTRIDGE, IMAGE FORMING METHOD, AND IMAGE FORMING APPARATUS

FIELD OF THE INVENTION

The present invention relates to a toner for developing an electrostatic image by electrophotography, electrostatic recording and electrostatic printing, etc.; a developer containing the toner; a process cartridge employing the toner; an image forming method employing the toner; and an image forming apparatus employing the toner.

DESCRIPTION OF THE RELATED ART

Background Art

Image formation by electrophotography, electrostatic recording and electrostatic printing, etc. is performed in accordance with a series of steps: forming a latent electrostatic image on an electrophotographic photoconductor (hereinafter may be referred to as a "photoconductor" or a "latent electrostatic image bearing member"); developing the latent electrostatic image with a developer to form a visible image (toner image); transferring the visible image onto a recording medium such as paper; and fixing the transferred image onto the recording medium to form a fixed image. The developer is mainly classified into one-component developers containing only a magnetic or non-magnetic toner and two-component developers containing a toner and a carrier.

In general, from the viewpoint of achieving desired energy efficiency, image fixation in electrophotography is widely performed with a heating roller method in which a toner image on a recording medium is fixed by directly pressing a heating roller thereagainst. The heating roller method requires a large amount of electric power for performing image fixation. In view of this, various attempts have been made to reduce electric power consumed for a heating roller from the viewpoint of energy saving. For example, there is often employed a method in which when no image is output, the power of a heater for a heating roller is set to a low level; and when an image is output, the power is increased to raise the temperature of the heating roller.

However, in this method, it takes about several tens of seconds (waiting time) to raise the temperature of a heating roller at a sleep mode to a temperature required for image fixing, which is inconvenient for users. Also, in another desired method for reduction of electric power consumption, a heater is completely off when no image is output. In order to attain energy saving based on these method, it is required that the fixing temperature of a toner itself be lowered to decrease the toner fixing temperature in use.

In accordance with development in electrophotographic technology, toners used in developers have been required to be excellent in low-temperature fixing ability and storage stability (blocking resistance). As a result, attempts have been made to use polyester resins instead of styrene-based resins conventionally used for binder resins of toners, since polyester resins have a higher affinity to recording media, and have a better low-temperature fixing ability than styrene-based resins. For example, there have been proposed a toner containing a linear polyester resin whose physical properties (e.g., molecular weight) have been defined at predetermined values (see PTL 1), and a toner containing a non-linear, cross-linked polyester resin formed by using rosin as an acid component (see PTL 2).

In an attempt to further improve image forming apparatuses in processing speed and energy saving, conventionally used binder resins for toners are not still sufficient to meet the recent market requirements, making it very difficult to shorten the required fixing time in a fixing step and to maintain a sufficient fixation strength when using a fixing unit whose temperature has been lowered.

As disclosed in PTL 2, the toner containing a polyester resin formed by using rosin is advantageously excellent in low-temperature fixing ability, and pulverization properties, thus, it is readily pulverized to enhance toner productivity in the pulverization method. Meanwhile, when 1,2-propanediol (a branched alcohol having 3 carbon atoms) is used as an alcohol component, the formed toner has a better low-temperature fixing ability, while maintaining offset resistance, than that formed by using an alcohol having 2 or less carbon atoms. In addition, such an alcohol is effectively used for preventing degradation of storage stability of the toner caused by decrease in glass transition temperature thereof, as compared with the case where a branched alcohol having 4 or more carbon atoms is used. When the polyester resins formed from rosin and/or the above alcohols are used for a binder resin of toner, the formed toner is advantageous in that it is fixed at low temperature and improved in storage stability.

Meanwhile, demand for energy saving is expected to be more and more strict in future. At present, use of polyester resin excellent in low-temperature fixing ability is gradually improving toners in low-temperature fixing ability, compared to those before. But, when such a polyester resin is only used; i.e., unless some additional measures are taken, it is difficult to sufficiently meet requirements for energy saving in near future.

In recent years, toners have been improved in low-temperature fixing ability by adding a fixing aid thereto (see PTL 3). PTL 3 proposed that the fixing aid is made to exist in the toners as crystal domains to improve it in both heat resistant storage stability and low-temperature fixing ability.

There is a proposal of toners satisfying both heat resistant storage stability and low-temperature fixing ability by introducing a crystalline polyester resin in the toners (see PTLs 4 and 5).

There is a proposal of capsule toners, each of which is obtained by incorporating a crystalline polyester resin in toner base particles which are produced by a dissolution suspension method, and then coating the toner base particles with fine resin particles (see PTL 6). In the proposed capsule toners, the crystalline polyester resin does not have a needle shape, but a substantially spherical shape, because the crystalline polyester resin is dissolved in an organic solvent, and emulsified, and then dried. Since the crystalline polyester resin is dried without removing a surfactant used for emulsification, the crystalline polyester resin is in a form of being coated with an impurity of the surfactant. Moreover, the crystalline polyester resin is finely dispersed in each of the toner base particles, and is not localized near a toner surface. Thus, the effect of softening a resin by adding the crystalline polyester resin cannot be exhibited, and consequently, low temperature fixing effect may not be sufficiently exhibited.

However, in accordance with the recent development in high-speed image forming apparatuses, toners have been required to have low-temperature fixing ability, high durability, and excellent cleaning ability, and meet requirements for further energy saving. At present, difficultly is encountered in sufficiently meeting the aforementioned requirements and thus, demand has arisen for further improvement and development.

CITATION LIST

Patent Literature

PTL Japanese Patent Application Laid-Open (JP-A) No. 2004-245854
PTL 2: JP-A No. 04-70765
PTL 3: JP-A No. 2006-208609
PTL 4: JP-A No. 2009-109971
PTL 5: JP-A No. 2006-337872
PTL 6: JP-A No. 2008-268353

SUMMARY OF INVENTION

Technical Problem

An object of the present invention is to provide a toner having excellent low-temperature fixing ability, having excellent offset resistance, not smearing a fixing device and images, having excellent cleaning ability, and being capable of forming high quality image having excellent sharpness for a long period of time, and to provide a developer, a process cartridge, an image forming method, and an image forming apparatus that use the toner.

Solution to Problem

Means for solving the problems are as follows.

<1> A toner obtained by a method for producing a toner, which includes: dissolving or dispersing in an organic solvent a toner material containing at least a binder resin, and a dispersion liquid of a crystalline polyester resin, so as to prepare a solution or dispersion liquid of the toner material; emulsifying or dispersing the solution or dispersion liquid of the toner material in an aqueous medium, so as to prepare an emulsion or dispersion liquid; and removing the organic solvent from the emulsion or dispersion liquid, wherein the crystalline polyester resin is localized near a surface of the toner.

<2> The toner according to <1>, wherein the crystalline polyester resin is localized within 1 μm-depth from an outermost surface of the toner.

<3> The toner according to any of <1> and <2>, wherein the crystalline polyester resin has a needle shape.

<4> The toner according to any of <1> to <3>, wherein the crystalline polyester resin in the dispersion liquid of the crystalline polyester resin has an average particle diameter of 10 nm to 500 nm.

<5> The toner according to any of <1> to <4>, wherein an amount of the crystalline polyester resin is 1 part by mass to 30 parts by mass relative to 100 parts by mass of the toner.

<6> The toner according to any of <1> to <5>, wherein the solution or dispersion liquid of the toner material contains a cationic compound, and the aqueous medium contains fine anionic resin particles having an average particle diameter of 5 μm to 50 μm and an anionic surfactant.

<7> The toner according to any of <1> to <6>, wherein the toner material further contains an active hydrogen group-containing compound, and a modified polyester resin reactive with the active hydrogen group-containing compound.

<8> The toner according to any of <1> to <7>, wherein the toner has an average circularity of 0.95 to 0.99.

<9> A method for producing a toner, including: dissolving or dispersing in an organic solvent a toner material containing at least a binder resin, and a dispersion liquid of a crystalline polyester resin, so as to prepare a solution or dispersion liquid of the toner material, emulsifying or dispersing the solution or dispersion liquid of the toner material in an aqueous medium, so as to prepare an emulsion or dispersion liquid, and removing the organic solvent from the emulsion or dispersion liquid, wherein a value calculated by subtracting Dw1 from Dw2 is 1 μm or less, and wherein Dw1 denotes a weight average particle diameter of a toner just before completion of emulsification in the emulsifying or dispersing and Dw2 denotes a weight average particle diameter of the toner obtained in the removing the organic solvent.

<10> The method for producing a toner according to <9>, wherein the crystalline polyester resin in the dispersion liquid of the crystalline polyester resin has an average particle diameter of 10 nm to 500 nm.

<11> The method for producing a toner according to any of <9> and <10>, wherein the solution or dispersion liquid of the toner material contains a cationic compound, and the aqueous medium contains fine anionic resin particles having an average particle diameter of 5 μm to 50 μm and an anionic surfactant.

<12> A developer containing the toner according to any of <1> to <8>.

<13> An image forming method including: charging a surface of an electrophotographic photoconductor; exposing the charged surface of the electrophotographic photoconductor with light so as to form a latent electrostatic image; developing the latent electrostatic image using the toner according to any of <1> to <8> so as to form a visible image; primarily transferring the visible image onto an intermediate transfer medium; secondarily transferring the primarily transferred visible image from the intermediate transfer medium to a recording medium; fixing the secondarily transferred visible image onto the recording medium; and cleaning the toner remaining on the electrophotographic photoconductor.

<14> An image forming apparatus including: an electrophotographic photoconductor; a charging unit configured to charge a surface of the electrophotographic photoconductor; an exposing unit configured to expose the charged surface of the electrophotographic photoconductor with light so as to form a latent electrostatic image; a developing unit configured to develop the latent electrostatic image using the toner according to any of <1> to <8> so as to form a visible image; a primary transfer unit configured to primarily transfer the visible image onto an intermediate transfer medium; a secondary transfer unit configured to secondarily transfer the primarily transferred visible image from the intermediate transfer medium to a recording medium; a fixing unit configured to fix the secondarily transferred visible image onto the recording medium; and a cleaning unit configured to clean the toner remaining on the electrophotographic photoconductor.

<15> The image forming apparatus according to <14>, wherein the image forming apparatus includes tandemly-arranged plurality of image forming elements, each of which includes at least the electrophotographic photoconductor, the charging unit, the exposing unit, and the developing unit.

<16> A process cartridge including: an electrophotographic photoconductor, and a developing unit configured to develop a latent electrostatic image formed on the electrophotographic photoconductor using the toner according to any of <1> to <8>, so as to form a visible image, wherein the process cartridge is detachably attached to an image forming apparatus.

The toner of the present invention includes a crystalline polyester resin localized near the surface thereof, the crystalline polyester resin having functions of assisting fixation and rapidly melting. By localizing the crystalline polyester resin near the toner surface, the crystalline polyester resin rapidly spreads near the toner surface upon heating. By uniformly localizing particles of the crystalline polyester resin each having a small particle size near the toner surface, the particles of the crystalline polyester resin are not separated from the toner, unlike the case of the aggregated particles of the crystalline polyester resin adhering onto the surface of the toner. Thus, a toner having excellent durability can be obtained.

In order to localize the crystalline polyester resin near the toner surface, as described above, it is necessary to disperse the crystalline polyester resin so that the dispersed crystalline polyester resin has a sufficiently smaller particle size than that of the toner. The crystalline polyester resin is likely to approach relatively to an oil droplet surface when a toner component is emulsified. However, in order to uniformly localize the crystalline polyester resin near the toner surface, the size of the oil droplet of the toner component upon emulsification is important.

An oil droplet having a certain size is formed depending on the amount of a surfactant added to an aqueous phase and shearing force upon emulsification. Thereafter, by eliminating the shearing force, followed by removing the organic solvent, oil droplets aggregate, and a weight average particle diameter of a resultant toner is larger than that of the oil droplet upon emulsification (shearing).

The inventors of the present invention found that the degree of increase of the particle diameter of the toner deeply relates to the position of the crystalline polyester resin near the toner surface. That is, the inventors of the present invention infer as follows. As shown in FIG. 1, when oil droplets are excessively finely formed upon emulsification, fine particles of the crystalline polyester resin are present on the surface of the toner particle upon formation of the oil droplets. Thereafter, in the case where aggregations of the fine particles of the crystalline polyester resin are formed in a high proportion, the fine particles of the crystalline polyester resin present on the surface of the toner particle are finally located inside the toner particle.

Therefore, when a difference (Dw2−Dw1) between a weight average particle diameter of a toner just before completion of emulsification in the emulsification or dispersion step Dw1 and a weight average particle diameter of the toner obtained in the organic solvent removing step Dw2 is 1 μm or less, the crystalline polyester resin is localized near the toner surface. The difference (Dw2−Dw1) is preferably 0.5 μm or less, and in such a case, the crystalline polyester resin is uniformly localized near the toner surface.

Advantageous Effects of Invention

According to the present invention, conventional problems can be solved, and the object of the present invention can be achieved, and thus, the present invention can provide a toner having excellent low-temperature fixing ability, having excellent offset resistance, not smearing a fixing device and images, having excellent cleaning ability, and being capable of forming high quality image having excellent sharpness for a long period of time, and provide a developer, a process cartridge, an image forming method, and an image forming apparatus that use the toner.

DESCRIPTION OF EMBODIMENTS (Toner)

Figure 1:
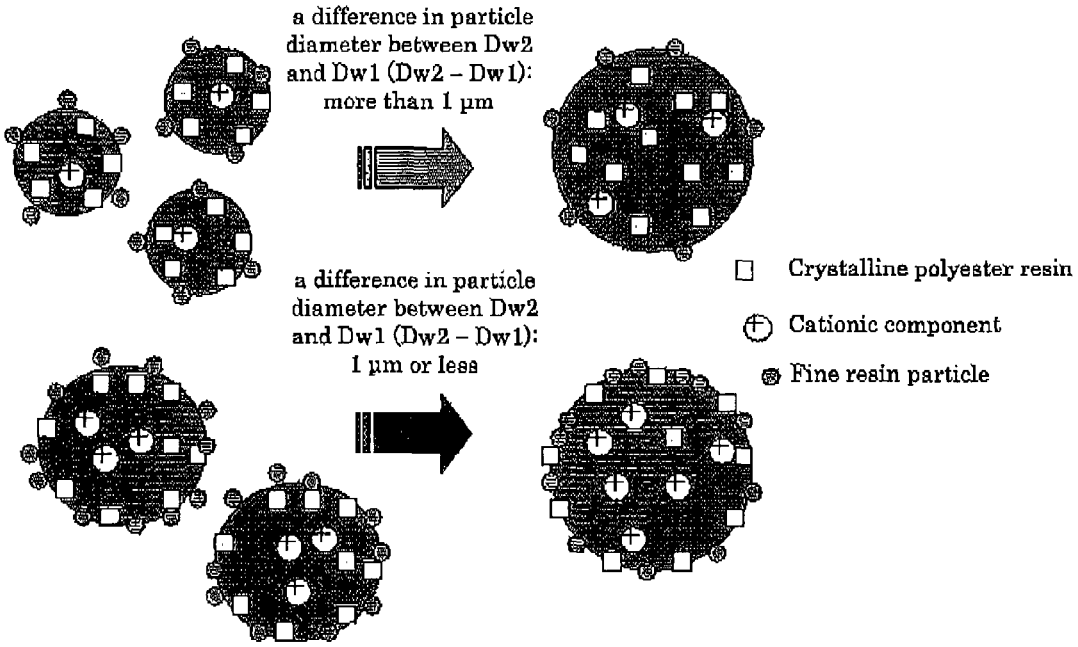
FIG. 1 is an explanatory view of an effect, on a dispersion state of a crystalline polyester resin, caused by a difference between a weight average particle diameter of a toner just before completion of emulsification and a weight average particle diameter of the toner after removal of an organic solvent.

A toner of the present invention is obtained by a method for producing a toner, which includes a toner material solution or dispersion liquid preparing step, an emulsification or dispersion step, and an organic solvent removing step, wherein the crystalline polyester resin is localized near a surface of the toner.

The crystalline polyester resin is preferably localized within 1 μm-depth from the outermost surface of the toner.

By localizing the crystalline polyester resin near the toner surface, the crystalline polyester resin having functions of assisting fixation and rapidly melting, the crystalline polyester resin rapidly spreads near the toner surface upon heating. By uniformly localizing particles of the crystalline polyester resin each having small particle size near the toner surface, the particles of the crystalline polyester resin are not separated from the toner, unlike the case of the aggregated particles of the crystalline polyester resin adhering onto the surface of the toner. Thus, a toner having excellent durability can be obtained.

The observation and evaluation of a cross section of the toner surface with a transmission electron microscope (TEM) is performed as follows.

A produced toner is stained by being exposed to vapor of 5% by mass aqueous solution of commercially available ruthenium tetroxide. Subsequently, the toner is wrapped with an epoxy resin, and then cut with a microtome (Ultracut-E) using a diamond knife. The thus-cut section is adjusted to a thickness of about 100 nm using an interference color of the epoxy resin. The section is placed on a copper grid mesh, and exposed to vapor of 5% by mass aqueous solution of commercially available ruthenium tetroxide, and then observed under a transmission electron microscope, JEM-2100F (manufactured by JEOL Ltd.), followed by photographing a cross section of the toner in the section. Cross sections of 20 toner particles are observed. Specifically, a surface part of the toner particle formed of the fine resin particles and the crystalline polyester resin (outline of a cross section of a toner particle) is observed, and a state where the fine resin particles and crystalline polyester resin are present is evaluated.

First, the toner is stained, and then cut into a section, thus, a staining material penetrates from the surface to the inside of the toner, and the state of a coating composed of resin fine particles on the outermost surface of the toner particle is observed with clear contrast. For example, in the case where the fine resin particles forming the coating and the resin component inside the coating are different, the coating part can be distinguished from the resin inside the toner.

Next, by staining the cut section after cutting, the crystalline polyester resin with clear contrast is observed. The crystalline polyester resin is stained lighter than the organic component constituting the inside the toner. It is considered that this occurs because the staining material less penetrates into the crystalline polyester resin, compared to the organic component inside the toner, because of difference in density therebetween.

The density of staining differs depending on the number of ruthenium atoms. There are many ruthenium atoms in a portion stained densely, and electron beam does not penetrate through the portion, and the portion appears black in an observation image. On the other hand, a portion stained lightly, through which electron beam easily penetrates, appears white in an observation image.

Figure 2A:
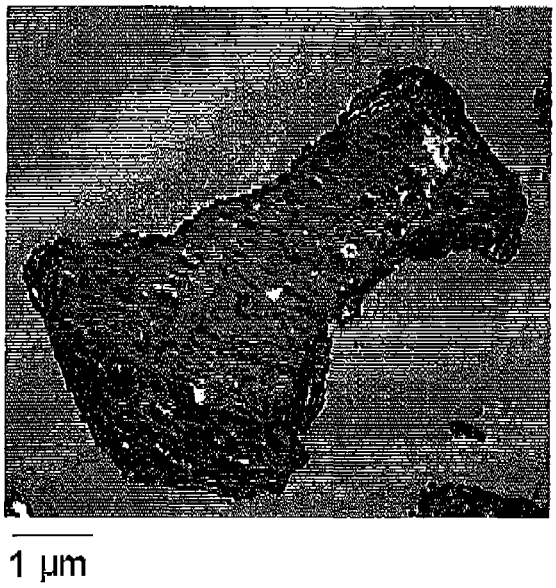
FIG. 2A is a TEM image showing one exemplary structure of a cross section of a toner of the present invention.
Figure 2B:
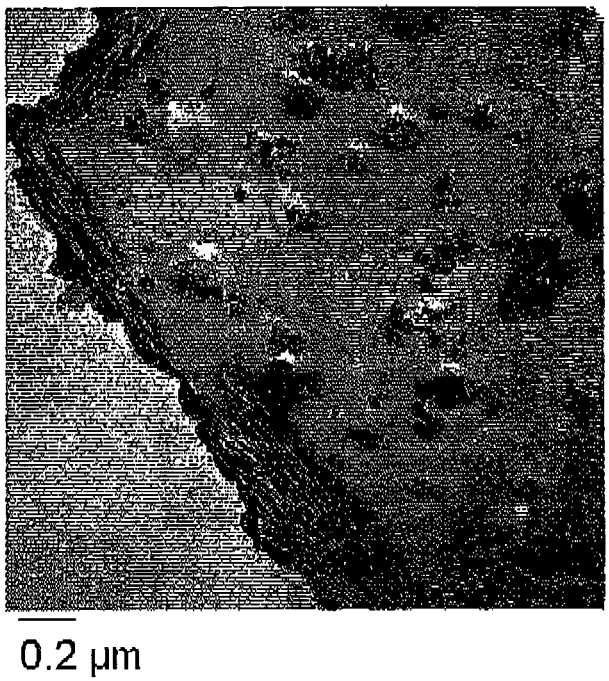
FIG. 2B is an enlarged view of FIG. 2A.

The observation images of the toner are shown in FIGS. 2A and 2B. FIG. 2A shows an entire toner image, and FIG. 2B shows an enlarged image of a part near the toner surface. From FIG. 2B, it is observed that the outermost surface of a toner particle is coated with fine resin particles in a thickness of approximately 20 nm to approximately 30 nm, which are uniformly stained. Moreover, it is observed that inside the coating of the fine resin particles, needle shapes each having a long axis of approximately 200 nm to approximately 500 nm with white contrast form a layer structure, i.e. a lamellar structure. The lamellar structure corresponds to the crystalline polyester resin. In FIG. 2A, it is confirmed that the crystalline polyester resin is not present through the outline of the toner particle, but is partly localized near the surface of the toner particle. In FIG. 2B, it is confirmed that a coating of the fine resin particles is present on the surface of the toner particle, and the crystalline polyester resin is present just inside the coating. Therefore, this cross section of the toner particle satisfies the requirements of the present invention.

The proportion of the crystalline polyester resin present within 1 μm depth from the outermost surface of the toner is obtained in such a manner that an area of the crystalline polyester resin in the image of the cross section of the toner particle (FIG. 2B) is assigned, and then subjected to image processing. Namely, the proportion of the crystalline polyester resin present within 1 μm depth from the outermost surface of the toner is obtained from a ratio of an area of the crystalline polyester resin present within 1 μm depth from the outermost surface of the toner to the entire area of the detected crystalline polyester resin.

<Crystalline Polyester Resin>

The crystalline polyester resin is preferably obtained by synthesizing an alcohol component, such as saturated aliphatic diol compounds having 2 to 12 carbon atoms, particularly 1,4-butanediol, 1,6-hexanediol, 1,8-octanediol, 1,10-decanediol, 1,12-dodecanediol and derivatives thereof; and an acid component, such as a dicarboxylic acid having 2 to 12 carbon atoms and a double bond (C=C double bond), or saturated dicarboxylic acids having 2 to 12 carbon atoms, particularly, fumaric acid, 1,4-butanediacid, 1,6-hexanediacid, 1,8-octanediacid, 1,10-decanediacid, 1,12-dodecane diacid and derivatives thereof.

Among these, alcohol components and acid components, in terms of reducing a difference between an endothermic peak temperature and an endothermic shoulder temperature, the crystalline polyester resin is particularly preferably synthesized with at least one alcohol component selected from 1,4-butanediol, 1,6-hexanediol, 1,8-octanediol, 1,10-decanediol, 1,12-dodecanediol; and at least one dicarboxylic acid selected from fumaric acid, 1,4-butanediacid, 1,6-hexanediacid, 1,8-octanediacid, 1,10-decanediacid, 1,12-dodecanediacid.

The crystallinity and the softening point of the crystalline polyester resin may be controlled, for example, by designing and employing a nonlinear polyester produced by condensation polymerization using an alcohol component to which, further, a trihydric or higher polyhydric alcohol such as glycerin is added and an acid component to which, further, a trivalent or higher polycarboxylic acid such as trimellitic anhydride is added during the synthesis of the polyester.

The molecular structure of a crystalline polyester resin of the present invention may be confirmed, for example, by NMR measurement of the crystalline, polyester resin in a solution or as a solid, as well as by measurement of the crystalline polyester resin using X-ray diffraction, GC/MS, LC/MS, and IR. For example, simply in the infrared absorption spectrum, the crystalline polyester resin having an absorption at wavelengths of 965 $cm^{-1}$±10 $cm^{-1}$ and 990 $cm^{-1}$±10 $cm^{-1}$, which is based on an out-of-plane bending vibration (δCH) of an olefin, is exemplified.

In view of the fact that a crystalline polyester resin having a sharp molecular weight distribution and having a low molecular weight is excellent in achieving low-temperature fixing ability, and that the crystalline polyester resin containing excess amount of the component having low molecular weight is poor in heat resistant storage stability, the following crystalline polyester resin is preferable: in terms of molecular weight distribution by gel permeation chromatography (GPC) using orthodichlorobenzene soluble content, it is preferred that a peak be located in a range of 3.5 to 4.0, and that the half width of the peak be 1.5 or less in a molecular weight distribution plot with a horizontal axis representing log (M) and a vertical axis representing % by mass; and the crystalline polyester resin preferably has a weight average molecular weight (Mw) of 3,000 to 30,000, a number average molecular weight (Mn) of 1,000 to 10,000, and a ratio Mw/Mn of 1 to 10, more preferably a weight average molecular weight (Mw) of 5,000 to 15,000, a number average molecular weight (Mn) of 2,000 to 10,000, and a ratio Mw/Mn of 1 to 5.

An acid value of the crystalline polyester resin is not particularly limited, may be appropriately selected depending on the intended purpose, and is preferably 5 mgKOH/g or higher, and more preferably 10 mgKOH/g or higher from the view point of increasing the affinity of the resin with paper and of achieving the intended low-temperature fixing ability. On the other hand, it is preferably 45 mgKOH/g or lower from the view point of improving offset resistance.

Furthermore, the hydroxyl value of the crystalline polymer is preferably 50 mgKOH/g or lower, and more preferably 5 mgKOH/g to 50 mgKOH/g for achieving both the predetermined degree of low-temperature fixing ability and favorable charging property.

The crystalline polyester resin is used in a form of an organic solvent dispersion liquid containing 5 parts by mass to 25 parts by mass of the crystalline polyester resin in 100 parts by mass of a dispersion liquid of the crystalline polyester resin, and preferably has an average particle diameter (dispersion diameter) of 10 nm to 500 nm.

When the dispersion diameter of the crystalline polyester resin is less than 10 nm, particles, of the crystalline polyester resin aggregate inside toner particles, and charge-imparting effect may not be sufficiently obtained. On the other hand, the dispersion diameter of the crystalline polyester resin is more than 500 nm, the surface properties of the toner particle degrades, causing contamination of a carrier, and chargeability cannot be sufficiently maintained for a long period of time. Moreover, environmental stability may be inhibited.

The organic solvent dispersion liquid of the crystalline polyester resin preferably contains 5 parts by mass of the crystalline polyester resin and 5 parts by mass to 25 parts by mass of the binder resin, more preferably 5 parts by mass of the crystalline polyester resin and 15 parts by mass of the binder resin, relative to 100 parts by mass of the organic solvent dispersion liquid. When the binder resin is less than 5 parts by mass, the dispersion diameter of the crystalline polyester resin may not decrease. When the amount of the binder resin is more than 25 parts by mass, the binder resins aggregate when added to the solution or dispersion liquid of the toner material, and low temperature fixing effect may not be sufficiently obtained.

In the present invention, the dispersion liquid of the crystalline polyester resin means a polyester resin which is preferably finely dispersed in an organic solvent for toner production, and the polyester resin is used for the toner production in a form of a dispersion in the organic solvent. By using the dispersion liquid of the crystalline polyester resin, when the toner composition is emulsified in the aqueous solvent, the crystalline polyester resin is present in oil droplets of the toner in a finely dispersed state. In the droplets, as shown in FIG. 1, the crystalline polyester resin is movable to an oil-water interface, and the effect of the toner of the present invention can be exhibited. In the present invention, the crystalline polyester resin is dissolved in the organic solvent by heating, and recrystallized and deposited by cooling. Most of the deposited products each have a particle size larger than a desired particle size, and preferably further dispersed and pulverized in a liquid. It is important that the crystalline polyester resin, which needs to be subjected to the deposition and dispersion steps, locates on a surface of a toner particle in a form of needle-shaped crystal to thereby secure low-temperature fixing ability, durability, and cleaning ability.

The amount of the crystalline polyester resin is not particularly limited and may be appropriately selected depending on the intended purpose. The amount of the crystalline polyester resin is preferably 1 part by mass to 30 parts by mass relative to 100 parts by mass of the toner. When the amount of the crystalline polyester resin is less than 1 part by mass, the low-temperature fixing ability may not be sufficiently obtained. When the amount of the crystalline polyester resin is more than 30 parts by mass, the excessive amount of the crystalline polyester resin is present on the outermost surface of the toner. As a result, a photoconductor and other members are smeared, causing a degradation in image quality, and causing a degradation in flowability of a developer and a degradation in image density. In addition, the surface properties of the toner are degraded and contaminate carriers, and can not maintain sufficient chargeability for a long period of time. Furthermore, the environmental stability may be inhibited.

It is preferred that the solution or dispersion liquid of the toner material contain a cationic compound, and that the aqueous medium contain fine anionic resin particles having an average particle diameter of 5 μm to 50 μm and an anionic surfactant, because particle size does not become too small and particle size distribution becomes sharp under high shear force.

It is estimated that the cationic compound has a function of preventing the stability of oil droplets of submicron particles, and automatically adjusting the oil droplets to an appropriate size. Moreover, according to increase of the amount of the cationic compound, the adsorption amount of the fine resin particles to the toner increases, thereby protecting the oil droplets, and hardly causing aggregation of the oil droplets.

Hereinafter, a description will be made for the embodiment in which an aqueous medium containing fine anionic resin particles having an average particle diameter of 5 nm to 50 nm and an anionic surfactant is used.

The obtained toner contains fine resin particles adhere to a surface of the toner particle that is a core formed of a toner material mainly containing a colorant and a binder resin. The average particle diameter of the toner is adjusted under the emulsification or dispersion conditions of stirring the aqueous medium in an emulsification step.

The fine anionic resin particles are attached onto the surface of the toner, and fused to and integrated with the surface of the toner particle to form a relatively hard surface. Therefore, it is preferred that the crystalline polyester resin be present in a layer of the fine anionic resin particles in the surface of the toner, for exhibiting further excellent durability. Since the fine anionic resin particles have anionic properties, the fine anionic resin particles can adsorb, on the oil droplet containing the toner material to suppress coalescence between the oil droplets. This is important for regulating the particle size distribution of the toner. Further, the fine anionic resin particles can impart negative charging ability to the toner. In order to attain these effects, the fine anionic resin particles preferably have an average particle diameter of 5 nm to 50 nm.

—Fine Resin Particles—

A resin used as the fine resin particles is not particularly limited as long as the resin can form an aqueous dispersion liquid in an aqueous medium, and may be appropriately selected from known resins depending on the intended purpose. The resin used as the fine resin particles may be a thermoplastic or thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. These may be used alone or in combination. Among these, at least one selected from vinyl resins, polyurethane resins, epoxy resins and polyester resins is preferable, from the viewpoint of easily preparing an aqueous dispersion liquid containing spherical fine resin particles.

The vinyl resin is a homopolymer or copolymer of a vinyl monomer. Examples thereof include styrene-(meth)acrylate ester resins, styrene-butadiene copolymers, (meth)acrylic acid-acrylic acid ester polymers, styrene-acrylonitrile copolymers, styrene-maleic anhydride copolymers and styrene-(meth)acrylic acid copolymers.

The fine resin particles are preferably anionic to avoid aggregation when used in combination with the above-described anionic surfactant. The fine resin particles can be prepared by using an anionic active agent in the below-described methods or by introducing into a resin an anionic group such as a carboxylic acid group and/or a sulfonic acid group.

As the particle diameter of each fine resin particle, the average particle diameter of the primary particles are preferably 5 nm to 50 nm, in terms of regulating the particle diameter and the particle size distribution of the emulsified particles. It is more preferably 10 nm to 25 nm.

The average particle diameter of the primary particles of the fine resin particles can be measured by, for example, SEM, TEM or a light scattering method. Specifically, LA-920 (manufactured by HORIBA, Ltd.) based on a laser scattering method can be used for measurement so that the primary particles are diluted to a proper concentration at which the measured value falls within the measurement range. The particle diameter is determined as a volume average diameter.

The fine resin particles are not particularly limited and can be obtained by polymerization according to a method which is appropriately selected from known methods depending on the intended purpose. The fine resin particles are preferably obtained in a form of an aqueous dispersion liquid of the fine resin particles. The method of preparing the aqueous dispersion liquid of fine resin particles is preferably as follows, for example:

(1) in the case of vinyl resins, a method in which an aqueous dispersion liquid of fine resin particles is directly produced by subjecting a vinyl monomer serving as a starting material to polymerization reaction by any one of a suspension polymerization method, an emulsification polymerization method, a seed polymerization method and a dispersion polymerization method;

(2) in the case of polyadded or condensed resins such as polyester resins, polyurethane resins and epoxy resins, a method in which an aqueous dispersion liquid of fine particles of the polyadded or condensed resins is produced by dispersing their, precursor (e.g., monomer or oligomer) or a solution thereof in an aqueous medium in the presence of an appropriate dispersant and then curing the resultant dispersion with heating or through addition of a curing agent;

(3) in the case of polyadded or condensed resins such as polyester resins, polyurethane resins and epoxy resins, a method in which an aqueous dispersion of fine particles of the polyadded or condensed resins is produced by dissolving an appropriate emulsifier in their precursor (e.g., monomer or oligomer) or a solution thereof (which is preferably a liquid or may be liquefied with heating) and then adding water to the resultant mixture for phase inversion emulsification;

(4) a method in which a resin is prepared through polymerization reaction (e.g., addition polymerization, ring-opening polymerization, polyaddition, addition condensation or condensation polymerization); the thus-prepared resin is pulverized using a mechanically rotary pulverizer, a jet pulverizer, etc., and then classified; and the thus-formed fine resin particles are dispersed in water in the presence of an appropriate dispersant;

(5) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution; the thus-prepared resin solution is sprayed to produce fine resin particles; and the thus-produced fine resin particles are dispersed in water in the presence of an appropriate dispersant;

(6) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution, followed by addition of a poor solvent for precipitation, or the thus-prepared resin is dissolved with heating in a solvent to prepare a resin solution, followed by cooling for precipitation; the solvent is removed to produce fine resin particles; and the thus-produced fine resin particles are dispersed in water, in the presence of an appropriate dispersant;

(7) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution; the thus-prepared resin solution is dispersed in an aqueous medium in the presence of an appropriate dispersant; and the solvent is removed with heating or under reduced pressure; and (8) a method in which a resin is prepared through polymerization reaction (e.g., addition polymerization, ring-opening polymerization, polyaddition, addition condensation or condensation polymerization); the thus-prepared resin is dissolved in a solvent to prepare a resin solution; an appropriate emulsifier is dissolved in the thus-prepared resin solution; and water is added to the resultant solution for phase inversion emulsification.

—Anionic Surfactant—

Examples of anionic surfactants used in the method for producing a toner of the present invention include alkylbenzene sulfonic acid salts, α-olefin sulfonic acid salts, phosphates, and anionic surfactants having a fluoroalkyl group. Among these, the anionic surfactants having a fluoroalkyl group are preferable. Examples of the anionic surfactants having a fluoroalkyl group include fluoroalkyl carboxylic acids having 2 to 10 carbon atoms or metal salts thereof, disodium perfluorooctanesulfonylglutamate, sodium-3-[ω-fluoroalkyl (C6 to C11)oxy]-1-alkyl (C3 to C4) sulfonate, sodium-3-[ω-fluoroalkanoyl (C6 to C8)-N-ethylamino]-1-propanesulfonate, fluoroalkyl (C11 to C20) carboxylic acids or metal salts thereof, perfluoroalkyl (C7 to C13) carboxylic acids or metal salts thereof, perfluoroalkyl (C4 to C12) sulfonic acid or metal salts thereof, perfluorooctanesulfonic acid diethanol amide, N-propyl-N-(2-hydroxyethyl)perfluorooctanesulfone amide, perfluoroalkyl (C6 to C10) sulfoneamidepropyltrimethylammonium salts, perfluoroalkyl (C6 to C10)-N-ethylsulfonyl glycin salts, and monoperfluoroalkyl (C6 to C16)ethylphosphate ester.

Examples of commercially available products of the fluoroalkyl group-containing anionic surfactants include, but not limited to, SURFLON S-111, S-112 and S-113 (manufactured by Asahi Glass Co., Ltd.); FLUORAD FC-93, FC-95, FC-98 and FC-129 (manufactured by Sumitomo 3M Limited); UNIDYNE DS-101 and DS-102 (manufactured by Daikin Industries, Ltd.); MEGAFACE F-110, F-120, F-118, F-191, F-812 and F-833 (manufactured by Dainippon Ink and Chemicals, Incorporated); EETOP EF-102, 103, 104, 105, 112, 123A, 123B, 306A, 501, 201 and 204 (manufactured by Tohchem Products Co., Ltd.); FTERGENT F-100 and F-150 (manufactured by NEOS COMPANY LIMITED).

Sodium dodecyldiphenyl ether sulfonate is preferable, because it is inexpensive and easily-obtainable, and no problem in safety.

—Cationic Compound—

In the present invention, a cationic compound is used in combination with the fine resin particles and the anionic surfactant during emulsification, so as to prevent formation of microscopic emulsion droplets, and to intensively localize the crystalline polyester resin near a surface of a toner particle. Examples of the cationic compound include basic compounds, such as amines, and ammonium salts. Moreover, diamines, and triamine compounds are also preferable.

Specific examples of the cationic compound include aliphatic primary amines, aliphatic secondary amines, aliphatic tertiary amines, aromatic primary amines, aromatic secondary amines, aromatic tertiary amines. Particularly, the aliphatic or aromatic primary amines, secondary amines are preferable. Specific examples thereof include butylamines, propylamines, ethylenediamines, hexamethylene diamines, isophoronediamines, anilines, o-toluidines, p-phenylenediamines, and α-naphthylamines. Additionally, examples thereof include amines exemplified in the section of an active hydrogen group-containing compound reactive with a modified polyester resin described below.

<Toner Material>

The toner material contains at least an active hydrogen group-containing compound, and a modified polyester resin, which is a polymer reactive with the active hydrogen group-containing compound, and further contains a binder resin, and a colorant, and if necessary, other components such as a releasing agent, fine resin particles, and a charge controlling agent, and the like.

—Binder Resin—

The binder resin contained in the toner material is not particularly limited and may be appropriately selected from known binder resins depending on the intended purpose. Examples thereof include polyester resins, silicone resins, styrene-acrylic resins, styrene resins, acrylic resins, epoxy resins, diene resins, phenol resins, terpene resins, coumarin resins, amide imide resins, butyral resins, urethane resins, and ethylene vinyl acetate resins. Among these, polyester resins are preferable because of being sharply melted upon fixing, being capable of smoothing the image surface, having sufficient flexibility even if the molecular weight thereof is lowered. The polyester resins may be used in combination with another resin.

The polyester resins are preferably produced through reaction between one or more polyols represented by the following General Formula (1) and one or more polycarboxylic acids represented by the following General Formula (2):

A-(OH)*m* General Formula (1)

in General Formula (1), A represents an alkyl group having 1 to 20 carbon atoms, an alkylene group having 1 to 20 carbon atoms, an aromatic group which may have a substituent, or a heterocyclic aromatic group which may have a substituent; and m is an integer of 2 to 4, B—(COOH)*n* General Formula (2)

in General Formula (2), B represents an alkyl group having 1 to 20 carbon atoms, an alkylene group having 1 to 20 carbon atoms, an aromatic group which may have a substituent, or a heterocyclic aromatic group which may, have a substituent; and n is an integer of 2 to 4.

The polyols represented by General Formula (1) are not particularly limited as long as it contains an active hydrogen atom, and may be appropriately selected depending on the intended purpose. Examples of the polyols represented by General Formula (1) include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,8,6-hexanetetrol, 1,4-sorbitan, pentaerythritol, dipentaerythritol, trip entaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adducts of bisphenol A, propylene oxide adducts of bisphenol A, hydrogenated bisphenol A, ethylene oxide adducts of hydrogenated bisphenol A, and propylene oxide adducts of hydrogenated bisphenol A.

The polycarboxylic acids represented by General Formula (2) are not particularly limited as long as it contains an active hydrogen atom, and may be appropriately selected depending on the intended purpose. Examples of the polycarboxylic acids represented by General Formula (2) include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isooctylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, 1,2,4-benzenetricarboxylic acid, 2,6,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Enpol trimer acid, cyclohexanedicarboxylic acid, cyclohexenedicarboxylic acid, butanetetracarboxylic acid, diphenylsulfonetetracarboxylic acid, and ethylene glycolbis(trimellitic acid).

—Active Hydrogen Group-Containing Compound—

When the toner material contains the active hydrogen group-containing compound and a modified polyester resin reactive with the active hydrogen group-containing compound, the mechanical strength of the resultant toner is increased and embedding of fine resin particles and external additives can be suppressed. When the active hydrogen group-containing compound has a cationic polarity, it can electrostatically pull the fine resin particles. Further, the fluidity of the toner during the heat fixation can be regulated, and, consequently, the fixing temperature range can be broadened. The active hydrogen group-containing compound and the modified polyester resin reactive with the active hydrogen group-containing compound can be said to be a binder resin precursor.

The active hydrogen group-containing compound serves, in the aqueous medium, as an elongating agent, a crosslinking agent, etc. for reactions of elongation, crosslinking, etc. of a polymer reactive with the active hydrogen group-containing compound. The active hydrogen group-containing compound is not particularly limited as long as it contains an active hydrogen group, and may be appropriately selected depending on the intended purpose. For example, when the polymer reactive with the active hydrogen group-containing compound is an isocyanate group-containing polyester prepolymer (A), an amine (B) is preferably used as the active hydrogen group-containing compound, since it can provide a high-molecular-weight product through reactions of elongation, crosslinking, etc. with the isocyanate group-containing polyester prepolymer (A).

The active hydrogen group is not particularly limited as long as it contains an active hydrogen group, and may be appropriately selected depending on the intended purpose. Examples thereof include a hydroxyl group (alcoholic or phenolic hydroxyl group), an amino group, a carboxylic group and a mercapto group. These may be used alone or in combination.

The amine (B) is not particularly limited and may be appropriately selected depending on the intended purpose. Examples thereof include diamines (B1), trivalent or higher polyamines (B2), amino alcohols (B3), aminomercaptans (B4), amino acids (B5), and amino-blocked products (B6) of the amines (B1) to (B5). These may be used alone or in combination. Among these, preferred are diamines (B1) and a mixture of the diamines (B1) and a small amount of the trivalent or higher polyamines (B2).

Examples of the diamines (B1) include aromatic diamines, alicyclic diamines and aliphatic diamines. Examples of the aromatic diamines include phenylenediamine, diethyltoluenediamine and 4,4'-diaminodiphenylmethane. Examples of the alicyclic diamines include 4,4'-diamino-3,3'-dimethyldicyclohexylmethane, diaminecyclohexane and isophoronediamine. Examples of the aliphatic diamines include ethylenediamine, tetramethylenediamine and hexamethylenediamine.

Examples of the trivalent or higher polyamines (B2) include diethylenetriamine and triethylenetetramine. Examples of the amino alcohols (B3) include ethanolamine and hydroxyethylaniline. Examples of the aminomercaptans (B4) include aminoethyl mercaptan and aminopropyl mercaptan. Examples of the amino acids (B5) include aminopropionic acid and aminocaproic acid.

Examples of the amino-blocked products (B6) include ketimine compounds and oxazolidine compounds derived from the amines (B1) to (B5) and ketones (e.g., acetone, methyl ethyl ketone and methyl isobutyl ketone).

Also, a reaction terminator is used for terminating elongation/crosslinking reaction between the active hydrogen group-containing compound and the polymer reactive therewith. Use of the reaction terminator can control the adhesive base material in its molecular weight, etc. to a desired range. The reaction terminator is not particularly limited, and examples thereof include monoamines (e.g., diethyl amine, dibutyl amine, butyl amine and lauryl amine) and blocked products thereof (e.g., ketimine compounds).

The mixing ratio of the isocyanate group-containing polyester prepolymer (A) to the amine (B) is not particularly limited but preferably 1/3 to 3/1, more preferably 1/2 to 2/1, particularly preferably 1/1.5 to 1.5/1, in terms of the equivalent ratio ([NCO]/[NHx]) of isocyanate group [NCO] in the isocyanate group-containing prepolymer (A) to amino group [NHx] in the amine (B). When the equivalent ratio ([NCO]/[NHx]) is less than 1/3, the formed toner may have degraded low-temperature fixing ability. When the equivalent ratio ([NCO]/[NHx]) is more than 3/1, the molecular weight of the urea-modified polyester resin decreases, possibly causing degradation in hot offset resistance of the formed toner.

<Polymer Reactive with Active Hydrogen Group-Containing Compound>

The polymer reactive with the active hydrogen group-containing compound (hereinafter also referred to as a "prepolymer") is not particularly limited as long as it has at least a site reactive with the active hydrogen group-containing compound, and may be appropriately selected from known resins. Examples thereof include polyol resins, polyacrylic resins, polyester resins, epoxy resins, and derivative resins thereof. These may be used alone or in combination. Among these, polyester resins are preferred since they have high fluidity upon melting and high transparency.

In the prepolymer, the reaction site reactive with the active hydrogen group-containing group is not particularly limited. Appropriately selected known substituents (moieties) may be used as the reaction site. Examples thereof include an isocyanate group, an epoxy group, a carboxyl group and an acid chloride group. These may be used alone or in combination as the reaction site. Among these, an isocyanate group is particularly preferred. As the prepolymer, a urea bond-forming group-containing polyester resin (RMPE) containing a urea bond-forming group is preferred, since it is easily adjusted for the molecular weight of the polymeric component thereof and thus is preferably used for forming dry toner, in particular for assuring oil-less low-temperature fixing ability (e.g., releasing and fixing abilities requiring no releasing oil-application mechanism for a heat-fixing medium).

Examples of the urea bond-forming group include an isocyanate group. Preferred examples of the RMPE having an isocyanate group as the urea bond-forming group include the isocyanate group-containing polyester prepolymer (A). The isocyanate group-containing polyester prepolymer (A) is not particularly limited and may be appropriately selected depending on the intended purpose. Examples thereof include those produced as follows: a polyol (PO) is polycondensed with a polycarboxylic acid (PC) to form a polyester resin having an active hydrogen-containing group; and the thus-formed polyester resin is reacted with a polyisocyanate (PIC). The polyol (PO) is not particularly limited and may be appropriately selected depending on the intended purpose. Examples thereof include diols (DIOs), trihydric or higher polyols (TOs), and mixtures of diols (DIOs) and trihydric or higher polyols (TOs). These may be used alone or in combination. Among these, preferred are diols (DIOs) and mixtures of diols (DIOs) and a small amount of trihydric or higher polyols (TOs).

Examples of the dial (DIO) include alkylene glycols, alkylene ether glycols, alicyclic diols, alkylene oxide adducts of alicyclic diols, bisphenols, and alkylene oxide adducts of bisphenols.

The alkylene glycol is preferably those having 2 to 12 carbon atoms, and examples thereof include ethylene glycol, 1,2-propylene glycol, 1,3-propylene glycol, 1,4-butanediol and 1,6-hexanediol. Examples of the alkylene ether glycol include diethylene glycol, triethylene glycol, dipropylene glycol, polyethylene glycol, polypropylene glycol and polytetramethylene ether glycol. Examples of the alicyclic diol include 1,4-cyclohexane dimethanol and hydrogenated bisphenol A.

Examples of the alkylene oxide adducts of alicyclic diols include adducts of the alicyclic diols with alkylene oxides (e.g., ethylene oxide, propylene oxide and butylene oxide). Examples of the bisphenol include bisphenol A, bisphenol F and bisphenol S. Examples of the alkylene oxide adducts of bisphenols include adducts of the bisphenols with alkylene oxides (e.g., ethylene oxide, propylene oxide and butylene oxide). Among these, preferred are alkylene glycols having 2 to 12 carbon atoms and alkylene oxide adducts of bisphenols, particularly preferred are alkylene oxide adducts of bisphenols, and mixtures of alkylene glycols having 2 to 12 carbon atoms and alkylene oxide adducts of bisphenols.

As the trihydric or higher polyol (TO) trihydric to octahydric polyols are preferably used. Examples thereof include trihydric or higher aliphatic alcohols, and trihydric or higher polyphenols, and alkylene oxide adducts of the trihydric or higher polyphenols. Examples of the trihydric or higher aliphatic alcohols include glycerin, trimethylolethane, trimethylolpropane, pentaerythritol and sorbitol. Examples of the trihydric or higher polyphenols include trisphenol compounds (e.g., trisphenol PA, manufactured by HONSHU CHEMICAL INDUSTRY CO., LTD.), phenol novolak and cresol novolak. Examples of the alkylene oxide adducts of the trihydric or higher polyphenols include adducts of the trihydric or higher polyphenols with alkylene oxides (e.g., ethylene oxide, propylene oxide and butylene oxide).

In the mixture of the diol (DIO) and the trihydric or higher polyol (TO), the mixing ratio by mass (DIO:TO) is preferably 100:0.01 to 100:10, more preferably 100:0.01 to 100:1.

The polycarboxylic acid (PC) is not particularly limited and may be appropriately selected depending on the intended purpose. Examples thereof include dicarboxylic acids (DICs), tri- or higher polycarboxylic acids (PCs), and mixtures of dicarboxylic acids (DICs) and the tri- or higher polycarboxylic acids (TCs). These may be used alone or in combination. Among these, preferred are dicarboxylic acids (DICs) and mixtures of DICs and a small amount of tri- or higher polycarboxylic acids (TCs).

Examples of the dicarboxylic acid (DIC) include alkylene dicarboxylic acids, alkenylene dicarboxylic acids, and aromatic dicarboxylic acids. Examples of the alkylene dicarboxylic acid include succinic acid, adipic acid and sebacic acid. The alkenylene dicarboxylic acid is preferably those having 4 to 20 carbon atoms, and examples thereof include maleic acid and fumaric acid. The aromatic dicarboxylic acid is preferably those having 8 to 20 carbon atoms, and examples thereof include phthalic acid, isophthalic acid, terephthalic acid, and naphthalenedicarboxylic acid. Among these, preferred are alkenylene dicarboxylic acids having 4 to 20 carbon atoms and aromatic dicarboxylic acids having 8 to 20 carbon atoms.

Examples of the tri- or higher polycarboxylic acid (TC) include aromatic polycarboxylic acids. The aromatic polycarboxylic acid is preferably those having 9 to 20 carbon atoms, and examples thereof include trimellitic acid and pyromellitic acid.

Alternatively, as the polycarboxylic acid (PC), there may be used acid anhydrides or lower alkyl esters of the dicarboxylic acids (DICs), the tri- or higher polycarboxylic acid (TCs), or mixtures of the dicarboxylic acid (DICs) and the tri- or higher polycarboxylic acid (TCs). Examples of the lower alkyl ester thereof include methyl esters thereof, ethyl esters thereof and isopropyl esters thereof.

In the mixture of the dicarboxylic acid (DIC) and the tri- or higher polycarboxylic acid (TC), the mixing ratio by mass (DIC:TC) is not particularly limited and may be appropriately selected depending on the intended purpose. Preferably, the mixing ratio (DIC:TC) is 100:0.01 to 100:10, more preferably 100:0.01 to 100:1.

In polycondensation reaction between the polyol (PO) and the polycarboxylic acid (PC), the mixing ratio of PO to PC is not particularly limited and may be appropriately selected depending on the intended purpose. The mixing ratio PO/PC is preferably 2/1 to 1/1, more preferably 1.5/1 to 1/1, particularly preferably 1.3/1 to 1.02/1, in terms of the equivalent ratio ([OH]/[COOH]) of hydroxyl group [OH] in the polyol (PO) to carboxyl group [COOH] in the polycarboxylic acid (PC).

The content of the polyol (PO) in the isocyanate group-containing polyester prepolymer (A) is not particularly limited and may be appropriately selected depending on the intended purpose. For example, it is preferably 0.5% by mass to 40% by mass, more preferably 1% by mass to 30% by mass, particularly preferably 2% by mass to 20% by mass. When the content of the polyol (PO) is less than 0.6% by mass, the formed toner has degraded hot offset resistance, making it difficult for the toner to attain both desired heat-resistant storage stability and desired low-temperature fixing ability. When the content of the polyol (PO) is more than 40% by mass, the formed toner may have degraded low-temperature fixing ability.

The polyisocyanate (PIC) is not particularly limited and may be appropriately selected depending on the intended purpose. Examples thereof include aliphatic polyisocyanates, alicyclic polyisocyanates, aromatic diisocyanates, aromatic/aliphatic diisocyanates, isocyanurates, phenol derivatives thereof, and blocked products thereof with oxime, caprolactam, etc.

Examples of the aliphatic polyisocyanate include tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate, and tetramethylhexane diisocyanate. Examples of the alicyclic polyisocyanate include isophorone diisocyanate and cyclohexylmethane diisocyanate. Examples of the aromatic diisocyanate include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate and diphenylether-4,4'-diisocyanate. Examples of the aromatic/aliphatic diisocyanate include $\alpha,\alpha,\alpha',\alpha'$-tetramethylxylylene diisocyanate. Examples of the isocyanurate include tris-isocyanatoalkyl-isocyanurate and triisocyanatocycloalkyl-isocyanurate. These may be used alone or in combination.

In reaction between the polyisocyanate (PIC) and the polyester resin having an active hydrogen group (e.g., hydroxyl group-containing polyester resin), the ratio of the PIC to the hydroxyl group-containing polyester resin is preferably 5/1 to 1/1, more preferably 4/1 to 1.2/1, particularly preferably 3/1 to 1.5/1, in terms of the mixing equivalent ratio ([NCO]/[OH]) of an isocyanate group [NCO] in the polyisocyanate (PIC) to a hydroxyl group [OH] in the hydroxyl group-containing polyester resin. When the mixing equivalent ratio [NCO]/[OH] is more than 5/1, the formed toner may have degraded low-temperature fixing ability; whereas when the mixing equivalent ratio [NCO]/[OH] is less than 1/1, the formed toner may have degraded offset resistance.

The content of the polyisocyanate (PIC) in the isocyanate group-containing polyester prepolymer (A) is not particularly limited and can be appropriately selected depending on the intended purpose. For example, it is preferably 0.5% by mass to 40% by mass, more preferably 1% by mass to 30% by mass, still more preferably 2% by mass to 20% by mass. When the content of the polyisocyanate (PIC) is less than 0.5% by mass, the formed toner may have degraded hot offset resistance, making it difficult for the toner to attain both desired heat-resistant storage stability and desired low-temperature fixing ability. When the content of the polyisocyanate (PIC) is more than 40% by mass, the formed toner may have degraded low-temperature fixing ability.

The average number of isocyanate groups per molecule of the isocyanate group-containing polyester prepolymer (A) is not particularly limited but is preferably one or more, more preferably 1.2 to 5, still more preferably 1.5 to 4. When the average number of the isocyanate groups is less than one per one molecule, the molecular weight of the polyester resin modified with a urea bond-forming group (EMPE) decreases, causing degradation in hot offset resistance.

The weight average molecular weight (Mw) of the polymer reactive with the active hydrogen group-containing compound is not particularly limited but is preferably 3,000 to 40,000, more preferably 4,000 to 30,000 based on the molecular weight distribution obtained by analyzing tetrahydrofuran (THF) soluble matter of the polymer through gel permeation chromatography (GPC). When the weight average molecular weight (Mw) is lower than 3,000, the formed toner may have degraded heat-resistant storage stability; whereas when the Mw is higher than 40,000, the formed toner may have degraded low-temperature fixing ability.

The gel permeation chromatography (GPC) for measuring the molecular weight distribution can be performed, for example, as follows. Specifically, a column is conditioned in a heat chamber at 40° C., and then tetrahydrofuran (THF) (solvent) is caused to pass through the column at a flow rate of 1 mL/min while the temperature is maintained. Subsequently, a separately prepared tetrahydrofuran solution of a resin sample (concentration: 0.05% by mass to 0.6% by mass) is supplied to the column in an amount of 50 μL to 200 μL. In the measurement of the molecular weight of the sample, the molecular weight distribution is determined based on the relationship between the logarithmic value and the count number of a calibration curve given by using several monodisperse polystyrene-standard samples. The standard polystyrenes used for giving the calibration curve may be, for example, those available from Pressure Chemical Co. or Tosoh Corporation; i.e., those each having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$. Preferably, at least about 10 standard polystyrenes are used for giving the calibration curve. The detector which can be used is a refractive index (RI) detector.

—Colorant—

The colorant is not particularly limited and may be appropriately selected depending on the intended purpose from known dyes and pigments. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone. These colorants may be used alone or in combination.

The amount of the colorant contained in the toner is not particularly limited and may be appropriately determined depending on the intended purpose. It is preferably 1% by mass to 15% by mass, more preferably 3% by mass to 10% by mass. When the amount of the colorant is less than 1% by mass, the formed toner may degrade in coloring performance. Whereas when the amount is more than 15% by mass, the pigment is not sufficiently dispersed in the toner, possibly causing decrease in coloring performance and in electrical properties of the formed toner.

The colorant may be mixed with a resin to form a masterbatch. The resin is not particularly limited and may be appropriately selected from those known in the art. Examples thereof include polyesters, polymers of a substituted or unsubstituted styrene, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyrals, polyacrylic acid resins, rosin, modified rosins, terpene resins, aliphatic or alicyclic hydrocarbon resins, aromatic petroleum resins, chlorinated paraffins and paraffin waxes. These resins may be used alone or in combination.

Examples of the polymers of a substituted or unsubstituted styrene include polyesters, polystyrenes, poly(p-chlorostyrenes) and polyvinyltoluenes. Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene ethylacrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile indene copolymers, styrene maleicacid copolymers and styrene maleicacid ester copolymers.

The masterbatch can be prepared by mixing or kneading a colorant with the resin for use in the masterbatch through application of high shearing force. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, for example, a high-shearing disperser (e.g., a three-roll mill) is preferably used. As has been known well, when exists in the surface of the toner, the colorant degrades charging performance of the toner. Thus, as the masterbatch by blending the colorant well in the resin, the formed toner can be improved in charging performances (e.g., environmental stability, charge retainability and charging amount).

—Releasing Agent—

The releasing agent is not particularly limited and may be appropriately selected depending on the intended purpose. The melting point thereof is preferably low; i.e., 50° C. to 120° C. When dispersed together with a resin, such a low-melting-point releasing agent effectively exhibits its releasing effects on the interface between a fixing roller and each toner particle. Thus, even when an oil-less mechanism is employed (in which a releasing agent such as oil is not applied onto a fixing roller), excellent hot offset resistance is attained.

Preferred examples of the releasing agent include waxes.

Examples of the waxes include natural waxes such as vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum); synthetic hydrocarbon waxes (e.g., Fischer-Tropsch waxes and polyethylene waxes); and synthetic waxes (e.g., ester waxes, ketone waxes and ether waxes). Further examples include fatty acid amides such as 12-hydroxystearic acid amide, stearic amide, phthalic anhydride imide and chlorinated hydrocarbons; low-molecular-weight crystalline polymer resins such as acrylic homopolymers (e.g., poly-n-stearyl methacrylate and poly-n-lauryl methacrylate) and acrylic copolymers (e.g., n-stearyl acrylate-ethyl methacrylate copolymers) and crystalline polymers having a long alkyl group as a side chain. These releasing agents may be used alone or in combination.

The melting point of the releasing agent is not particularly limited and may be appropriately selected depending on the intended purpose. The melting point is preferably 50° C. to 120° C., more preferably 60° C. to 90° C. When the melting point is lower than 50° C., the wax may adversely affect the heat-resistant storage stability of the toner. When the melting point is higher than 120° C., cold offset is easily caused upon fixing at lower temperatures.

The melt viscosity of the releasing agent is not particularly limited and may be appropriately selected depending on the intended purpose. In the case where the melt viscosity of the releasing agent is measured at the temperature 20° C. higher than the melting point of the wax, it is preferably 5 cps to 1,000 cps, more preferably 10 cps to 100 cps. When the melt viscosity is lower than 5 cps, the formed toner may degrade in releasing ability. When the melt viscosity is higher than 1,000 cps, the hot offset resistance and the low-temperature fixing ability may not be improved.

The amount of the releasing agent contained in the toner is not particularly limited and may be appropriately selected depending on the intended purpose. The amount of the releasing agent is preferably 40% by mass or less, more preferably 3% by mass to 30% by mass. When the amount is higher than 40% by mass, the formed toner may be degraded in flowability.

—Charge Controlling Agent—

The charge controlling agent is not particularly limited and may be appropriately selected from those known in the art. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. These may be used alone or in combination.

Also, the charge controlling agent may be a commercially available product. Examples thereof include a resin or a compound having an electron-donating functional group, azo dyes, metal complexes of organic acids may be used. Specific examples thereof include nigrosine dye BONTRON 03, quaternary ammonium salt BONTRON P-51, metal azo-containing dye BONTRON S-34, oxynaphthoic acid-based metal complex E-82, salicylic acid-based metal complex E-84 and phenol condensate E-89 (manufactured by ORIENT CHEMICAL INDUSTRIES CO., LTD); metal complex of salicylic acid TN-105, quaternary ammonium salt molybdenum complex TP-302 and TP-415 (manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (manufactured by Hoechst AG); boron complex LRA-901 and LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

The charge controlling agent may be incorporated into any of a resin phase inside the toner by utilizing the difference in affinity to the resin in the toner. By selectively incorporating the charge controlling agent into the resin phase inside the toner present in the inner layer, the spent of the charge controlling agent to other members such as the photoconductors and carriers can be suppressed. In the method for producing a toner of the present invention, the arrangement of the charge controlling agent is sometimes freely designed and the charge controlling agent may be arbitrarily arranged according to various image forming processes.

—Fine Inorganic Particles—

The fine inorganic particles are used as an external additive for imparting, for example, fluidity, develop ability and charging ability to the toner. The fine inorganic particles are not particularly limited and may be appropriately selected depending on the intended purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. These fine inorganic particles may be used alone or in combination.

In addition to fine inorganic particles each having a large particle diameter of 80 nm to 600 nm in terms of primary average particle diameter, fine inorganic particles each having a small particle diameter can be preferably used as fine inorganic particles for assisting the fluidity, develop ability, and charging ability of the toner. In particular, hydrophobic silica and hydrophobic titanium oxide are preferably used as the fine inorganic particles each having a small particle diameter. The primary average particle diameter of the fine inorganic particles is preferably 5 nm to 50 nm, more preferably 10 nm to 30 nm. The BET specific surface area of the fine inorganic particles is preferably 20 $m^2/g$ to 500 $m^2/g$. The amount of the fine inorganic particles contained in the toner is preferably 0.01% by mass to 5% by mass, more preferably 0.01% by mass to 2.0% by mass.

Other components are not particularly limited and may be appropriately selected depending on the intended purpose. Examples thereof include flowability improvers, cleaning improvers, magnetic materials and metal soaps.

The flowability improver is an agent applying surface treatment to improve hydrophobic properties, and is capable of inhibiting the degradation of flowability or charging ability under high humidity environment. Specific examples of the flowability improver include silane coupling agents, silylation agents, silane coupling agents having a fluorinated alkyl group, organotitanate coupling agents, aluminum coupling agents, silicone oils, and modified silicone oils. It is preferable that the silica and titanium oxide (fine inorganic particles) be subjected to surface treatment with such a flowability improver and used as hydrophobic silica and hydrophobic titanium oxide.

The cleanability improver is an agent added to the toner to remove the developer remaining on a photoconductor or a primary transfer member after transfer. Specific examples of the cleanability improver include metal salts of fatty acids such as stearic acid (e.g., zinc stearate and calcium stearate), fine polymer particles formed by soap-free emulsion polymerization, such as fine polymethylmethacrylate particles and fine polyethylene particles. The fine polymer particles preferably have a relatively narrow particle size distribution. It is preferable that the volume average particle diameter thereof be 0.01 μm to 1 μm.

The magnetic material is not particularly limited and may be appropriately selected from those known in the art depending on the intended purpose. Examples thereof include iron powder, magnetite and ferrite. Among these, one having a white color is preferable in terms of color tone.

(Method for Producing Toner)

A method for producing a toner of the present invention includes a toner material solution or dispersion liquid preparing step, an emulsification or dispersion step and an organic solvent removing step, and if necessary further includes other steps.

In the present invention, a value calculated by subtracting Dw1 from Dw2, i.e., a difference between Dw2 and Dw1 (Dw2−Dw1), is 1 μm or less, preferably 0.5 μm or less, wherein Dw1 denotes a weight average particle diameter of a toner just before completion of emulsification in the emulsification or dispersion step, and Dw2 denotes a weight average particle diameter of the toner obtained in the organic solvent removing step.

The weight average particle diameter of the toner obtained in the organic solvent removing step Dw2 (Dw after toner formation) is measured by sampling a small amount of the toner after the organic solvent removing step, and diluting it with an excessive amount of ion-exchanged water.

The weight average particle diameter just before completion of emulsification in the emulsification or dispersion step, Dw1 (Dw just before, completion of the emulsification) is measured by sampling a small amount of the toner while applying shear force, and immediately diluting it with an excessive amount of ion-exchanged water. Thus, the weight average particle diameter in the emulsified state free from influence of aggregation occurring later can be measured.

The difference (Dw2−Dw1) represents a degree of increase in the weight average particle diameter. When the difference (Dw2−Dw1) is more than 1 μm, the crystalline polyester resin may not be localized near the toner surface.

<Toner Material Solution or Dispersion Liquid Preparing Step>

The toner material solution or dispersion liquid preparing step is a step of dissolving or dispersing in an organic solvent a toner material containing at least a binder resin, and a dispersion liquid of a crystalline polyester resin, so as to prepare a solution or dispersion liquid of the toner material.

The toner material is not particularly limited as long as it can form a toner, and may be appropriately selected depending on the intended purpose. For example, the toner material contains a binder resin, or an active hydrogen group-containing compound, a polymer (prepolymer) reactive with the active hydrogen group-containing compound, and a colorant, and if necessary, further contains a releasing agent, a charge controlling agent, and other components. The solution or dispersion liquid of the toner material is preferably prepared by dissolving or dispersing the toner material and the dispersion liquid of the crystalline polyester resin in an organic solvent. The organic solvent is preferably removed during or after formation of a toner.

—Organic Solvent—

The organic solvent is not particularly limited as long as it allows the toner material to be dissolved or dispersed therein, and may be appropriately selected depending on the intended purpose. It is preferable that the organic solvent be a solvent having a boiling point of lower than 150° C. in terms of easy removal during or after formation of a toner. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Among these solvents, ester solvents are preferable, with more preference given to ethyl acetate. These solvents may be used alone or in combination.

The amount of the organic solvent is not particularly limited and may be appropriately selected depending on the intended purpose. Preferably, the amount of the organic solvent is 40 parts by mass to 300 parts by mass, more preferably 60 parts by mass to 140 parts by mass, still more preferably 80 parts by mass to 120 parts by mass, relative to 100 parts by mass of the toner material. The solution or dispersion liquid of the toner material can be prepared by dissolving or dispersing in the organic solvent the toner material such as the dispersion liquid of the crystalline polyester resin, the active hydrogen group-containing compound, the polymer reactive with the active hydrogen group-containing compound, the unmodified polyester resin, the releasing agent, the colorant and the charge controlling agent. Of the toner material; components other than the polymer (prepolymer) reactive with the active hydrogen group containing compound may be added and mixed in the aqueous medium in the preparation of the aqueous medium described below, or may be added together with the solution or dispersion liquid of the toner material to the aqueous medium when the solution or dispersion liquid of the toner material is added to the aqueous medium.

<Emulsification or Dispersion Step>

The emulsification or dispersion step is a step of emulsifying or dispersing the solution or dispersion liquid of the toner material in an aqueous medium, so as to prepare an emulsion or dispersion liquid.

—Aqueous Medium—

The aqueous medium is not particularly limited and may be appropriately selected from those known in the art. Examples thereof include water, water-miscible solvents and mixtures thereof. Among these, water is preferred. The water-miscible solvent is not particularly limited, as long as it is miscible with water. Examples thereof include alcohols, dimethylformamide, tetrahydrofuran, cellsolves and lower ketones. Examples of the alcohols include methanol, isopropanol and ethylene glycol. Examples of the lower ketones include acetone and methyl ethyl ketone. These may be used alone or in combination.

The aqueous medium is prepared by, for example, dispersing fine resin particles in an aqueous medium in the presence of an anionic surfactant. The amounts of the anionic surfactant and the fine resin particles in the aqueous medium are not particularly limited and may be appropriately selected depending on the intended purpose. The amount of each of the anionic surfactant and the fine resin particles is preferably 0.5% by mass to 10% by mass.

—Emulsification or Dispersion—

The emulsification or dispersion of the solution or dispersion liquid of the toner material in the aqueous medium is preferably performed by dispersing the solution or dispersion liquid of the toner material in the aqueous medium with stirring. The method for dispersing the solution or dispersion liquid of the toner material is not particularly limited and may be appropriately selected depending on the intended purpose. For example, known dispersers may be used for dispersion. The dispersers are not particularly limited, and examples thereof include low-speed shear dispersers and high-speed shear dispersers. In the method for producing a toner, during the emulsification or dispersion, the active hydrogen group-containing compound and the polymer reactive with the active hydrogen group-containing compound are subjected to elongation reaction or crosslinking reaction, to thereby form an adhesive base material.

By monitoring the particle size of a toner during emulsification, a shearing condition, the amounts of the anionic surfactant and fine resin particles, the amount of the cationic component to be added are adjusted, so as to obtain a desired emulsified particle size. Then, by observing a difference between a particle diameter of a toner just before completion of emulsification and a particle diameter of the toner obtained in the organic solvent removing step, the shearing condition, the amounts of the anionic surfactant and fine resin particles, the amount of the cationic component to be added are adjusted again, so as to reduce the difference therebetween.

Thus, the crystalline polyester resin can be uniformly localized near the toner surface.

The urea-modified polyester resin is formed by, for example, the following methods.

(1) The solution or dispersion liquid of the toner material containing the polymer reactive with the active hydrogen group-containing compound (e.g., the isocyanate group-containing polyester prepolymer (A)) is emulsified or dispersed in the aqueous medium together with the active hydrogen group-containing compound (e.g., the amine (B)) so as to form oil droplets, and these are allowed to proceed the elongation reaction and/or crosslinking reaction in the aqueous medium.

(2) The solution or dispersion liquid of the toner material is emulsified or dispersed in the aqueous medium, to which the active hydrogen group-containing compound has previously been added, so as to form oil droplets, and these are allowed to proceed the elongation reaction and/or crosslinking reaction in the aqueous medium.

(3) The solution or dispersion liquid of the toner material is added and mixed in the aqueous medium, the active hydrogen group-containing compound is added thereto so as to form oil droplets, and these are allowed to proceed the elongation reaction and/or crosslinking reaction from the surfaces of the particles in the aqueous medium. In the case of (3), the modified polyester resin is preferentially formed at the surface of the toner to be formed, and thus the concentration gradation of the modified polyester resin can be provided within the toner particles.

The reaction conditions for forming the binder resin through emulsification or dispersion are not particularly limited and may be appropriately selected depending on the combination of the active hydrogen group-containing compound and the polymer reactive with the active hydrogen group-containing compound. The reaction time is preferably 10 minutes to 40 hours, more preferably 2 hours to 24 hours.

The method for stably forming the dispersion containing the polymer reactive with the active hydrogen group-containing compound (e.g., the isocyanate group-containing polyester prepolymer (A)) in the aqueous medium is such that the solution or dispersion liquid of the toner material, which is prepared by dissolving or dispersing the toner material containing the polymer reactive with the active hydrogen group-containing compound (e.g. the isocyanate group-containing polyester prepolymer (A)), the colorant, the releasing agent, the charge controlling agent, the unmodified polyester resin, and the like, is added to the aqueous medium, and then dispersed by shearing force.

In emulsification or dispersion, the amount of the aqueous medium used is preferably 50 parts by mass to 2,000 parts by mass, more preferably 100 parts by mass to 1,000 parts by mass, relative to 100 parts by mass of the toner material. When the amount of the aqueous medium used is less than 50 parts by mass, the toner material is poorly dispersed, possibly failing to obtain toner particles each having a predetermined particle diameter. When the amount of the aqueous medium used is more than 2,000 parts by mass, the production cost increases.

For the aqueous medium, the following inorganic dispersants and polymer protective colloid may be used in combination with the anionic surfactant and the fine resin particles. Examples of the inorganic dispersants having poor water solubility include tricalcium phosphate, calcium carbonate, titanium oxide, colloidal silica, and hydroxyapatite.

The polymer protective colloid is not particularly limited and may be appropriately selected depending on the intended purpose. Examples thereof include acids, (meth)acrylic monomers having a hydroxyl group, vinyl alcohols or ethers of vinyl alcohols, esters of vinyl alcohol and compounds having a carboxyl group, amide compounds or methylol compounds thereof, chlorides, homopolymers or copolymers of a compound containing a nitrogen atom or a nitrogen-containing heterocyclic ring, polyoxyethylenes, and celluloses.

Examples of the acids include acrylic acid, methacrylic acid, α-cyanoacrylic acid, α-cyanomethacrylic acid, itaconic acid, crotonic acid, fumaric acid, maleic acid, and maleic anhydride.

Examples of the (meth)acrylic monomers having a hydroxyl group include β-hydroxyethyl acrylate, β-hydroxylethyl methacrylate, β-hydroxylpropyl acrylate, β-hydroxylpropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide; and N-methylolmethacrylamide.

Examples of the vinyl alcohols or ethers of vinyl alcohols include vinyl methyl ether, vinyl ethyl ether, and vinyl propyl ether. Examples of the esters of vinyl alcohols and compounds having a carboxyl group include vinyl acetate, vinyl propionate, and vinyl butyrate. Examples of the amide compounds or methylol compounds thereof include acryl amide, methacryl amide, diacetone acryl amide acid, and methylol compounds thereof.

Examples of the chlorides include acrylic acid chloride, and methacrylic acid chloride. Examples of the homopolymers or copolymers of a compound containing a nitrogen atom or a nitrogen-containing heterocyclic ring include vinyl pyridine, vinyl pyrrolidone, vinyl imidazole, and ethylene imine.

Examples of the polyoxyethylenes include polyoxyethylene, polyoxypropylene, polyoxyethylene alkylamine, polyoxypropylene alkylamine, polyoxyethylene alkylamide, polyoxypropylene polyoxyethylene nonylphenylether, polyoxyethylene laurylphenylether, polyoxyethylene stearylphenylester, and polyoxyethylene nonylphenylester.

Examples of the celluloses include methyl cellulose, hydroxyethyl cellulose, and hydroxypropyl cellulose.

When a dispersion stabilizer (e.g., calcium phosphate) soluble in an acid or alkali is used, the calcium phosphate can be removed from the particles by dissolving it with an acid such as hydrochloric acid, followed by washing with water; or by enzymatically decomposing it.

—Organic Solvent Removing Step—

The organic solvent removing step is a step of removing the organic solvent from the emulsion or dispersion liquid.

—Removal of Organic Solvent—

The organic solvent is removed from the emulsion or dispersion liquid (emulsified slurry). The method for removing the organic solvent is performed as follows: (1) the entire reaction system is gradually increased in temperature to completely evaporate the organic solvent contained in oil droplets; (2) the emulsified dispersion is sprayed in a dry atmosphere to completely remove and evaporate the water insoluble organic solvent contained in oil droplets together with the aqueous dispersant, whereby fine toner particles are formed. By removing the organic solvent, toner particles are formed, or the like. The thus-formed toner particles are subjected to washing drying, etc., and then, if necessary, to classification, etc. Classification is performed by removing very fine particles using a cyclone, a decanter, a centrifugal separator, etc. in the liquid. Alternatively, after drying, the formed powdery toner particles may be classified.

The toner particles produced through the above-described steps may be mixed with particles of a colorant, a releasing agent and a charge controlling agent, or a mechanical impact may be applied to the resultant mixture (toner particles) for preventing particles of the releasing agent, etc. from dropping off from the surfaces of the toner particles. Examples of the method for applying a mechanical impact include a method in which an impact is applied to a mixture using a high-speed rotating blade, and a method in which impact is applied by putting mixed particles into a high-speed air flow and accelerating the air speed such that the particles collide with one another or that the particles are crashed into a proper collision plate. Examples of apparatuses used in these methods include ANGMILL (manufactured by Hosokawa Micron Corporation), an apparatus produced by modifying I-type mill (manufactured by Nippon Pneumatic Mfg. Co., Ltd.) so that the pulverizing air pressure thereof is decreased, hybridization system (manufactured by Nara Machinery Co., Ltd.), kryptron system (manufactured by Kawasaki Heavy Industries, Ltd.), and automatic mortar.

The toner preferably has the following weight average particle diameter (Dw), weight average particle diameter (Dw)/number average particle diameter (Dn), average circularity, volume specific resistance, and BET specific surface area.

The toner preferably has a volume average particle diameter of 1 μm to 6 μm, more, preferably 2 μm to 5 μm. When the volume average particle diameter of the toner is less than 1 μm, toner dust is likely to be generated in the primary transfer and the secondary transfer. On the other hand, when the volume average particle diameter of the toner is more than 6 μm, the dot reproducibility is unsatisfactory and the granularity of a halftone part is also deteriorated, possibly failing to obtain a high-definition image.

The ratio of the weight average particle diameter (Dw) to the number average particle diameter (Dn), i.e., Dw/Dn, of the toner is not particularly limited and may be appropriately selected depending on the intended purpose. The ratio Dw/Dn is preferably 1.25 or less, more preferably 1.05 to 1.25.

When the ratio Dw/Dn is less than 1.05, the following problems occur. Specifically, in the case of a two-component developer, toner fusion to a carrier surface occurs during long term stirring in a developing device, which may cause decrease in the charging ability of the carrier, and poor cleanability. In the case of a one-component developer, toner filming to a developing roller or toner fusing to members, such as a blade to form a thin toner film, may easily occurs. On the other hand, when the ratio Dw/Dn exceeds 1.25, it becomes difficult to provide a high-resolution, high-quality image, and variations in toner particle diameter may increase after toner consumption or toner supply in the developer. Also, the distribution of the charge amount of the toner is broadened, making it difficult to obtain a high-quality image. When the ratio Dw/Dn is 1.05 to 1.25, the distribution of the charge amount becomes uniform, which reduces fogging on the background.

When the ratio Dw/Dn is 1.05 to 1.25, the resultant toner is excellent in all of storage stability, low-temperature fixing ability, and hot offset resistance. In particular, when the toner is used in a full color copier, images have excellent gloss. When the ratio falls within this range in the case of the two-component developer, variations in toner particle diameter are small in the developer even after toner consumption and toner supply have been repeated for a long time, and in addition, even after a long time stirring in the developing device, excellent developing ability can be ensured. Moreover, when the ratio falls within this range in the case of the one-component developer, variations in toner particle diameter decrease even after toner consumption or toner supply, and toner filming to a developing roller and toner fusing to members, such as a blade to form a thin toner film, are prevented, and in addition, even after long-time use of the developing device, i.e. long-time stirring of developer, excellent developing ability can be ensured. Thus, a high-quality image can be obtained.

The weight average particle diameter (Dw), and the number average particle diameter (Dn) of the toner can be measured as follows. Specifically, using a particle size analyzer ("MULTISIZER III," manufactured by Beckman Coulter Inc.) with the aperture diameter being set to 100 μm, and the obtained measurements are analyzed with an analysis software (Beckman Coulter MULTISIZER 3 Version 3.51). More specifically, 0.5 mL of a 10% by mass surfactant (alkylbenzene sulfonate, Neogen SC-A, manufactured by Daiichi Kogyo Seiyaku Co., Ltd.) is charged to a 100 mL-glass beaker, and 0.5 g of a toner sample is added thereto, followed by stirring with a microspatula. Subsequently, 80 mL of ion-exchanged water is added to the beaker. The obtained dispersion liquid is subjected to dispersion treatment for 10 min using an ultrasonic wave dispersing device (W-113MK-II, manufactured by Honda Electronics Co., Ltd.). The resultant dispersion liquid is measured using MULTISIZER III and ISOTON III (manufactured by Beckman Coulter Inc.) serving as a solution for measurement. The dispersion liquid containing the toner sample is dropped so that the concentration indicated by the meter falls within a range of 8%±2%. In this measuring method, it is important in terms of reproducibility of measuring the particle size that the concentration is adjusted to the range of 8%±2%. When the concentration indicated by the meter falls within the range of 8% 2%, no error is occurred in the measurement of the particle size.

—Average Circularity—

The average circularity of the toner is preferably 0.95 to 0.99. When the average circularity of the toner is less than 0.95, evenness of an image in the development is deteriorated, or the efficiency of transfer of the toner from an electrophotographic photoconductor to an intermediate transfer medium or from the intermediate transfer medium to a recording medium may be lowered. The toner of the present invention is produced by performing emulsification treatment in an aqueous medium, and particularly, it is effective to achieve a small particle diameter of a color toner, and to be formed into a shape having an average circularity in the above-described range.

The average circularity of the toner is defined by the following equation.

Average circularity $SR$=(Circumferential length of a circle having the same area as projected particle area/Circumferential length of projected particle image)×100(%)

The average circularity of the toner is measured using a flow-type particle image analyzer ("FPIA-2100," manufactured by SYSMEX CORPORATION), and analyzed using an analysis software (FPIA-2100 Data Processing Program for FPIA Version00-10). Specifically, into a 100 mL glass beaker, 0.1 mL to 0.5 mL of a 10% by mass surfactant (NEOGEN SC-A, an alkylbenzene sulfonate, manufactured by Dai-ichi Kogyo Seiyaku Co., Ltd.) is charged, and 0.1 g to 0.5 g of a toner is added, followed by stirring with a microspatula. Subsequent, 80 mL of ion-exchanged water is added to the beaker. The obtained dispersion liquid is subjected to dispersion treatment for 3 min using an ultrasonic wave dispersing device (manufactured by Honda Electronics Co., Ltd.). Using FPIA-2100, the shape and distribution of toner particles are measured until the dispersion liquid has a concentration of 5,000 number per μL to 15,000 number per μL. In this measuring method, it is important in terms of reproducibility in measuring the average circularity that the concentration of the dispersion liquid is adjusted to the range of 5,000 number per μL to 15,000 number per μL. To obtain the above-mentioned concentration of the dispersion liquid, it is necessary to change the conditions of the dispersion liquid, namely the amounts added of the surfactant and of the toner. The required amount of the surfactant varies depending on the hydrophobicity of the toner, similar to the measurement of the toner particle diameter. When the surfactant is added in large amounts, noise is caused by foaming. When the surfactant is added in small amounts, the toner cannot be sufficiently wetted, causing insufficient dispersion. Also, the amount of the toner added varies depending on its particle diameter. When the toner has a small particle diameter, it needs to be added in small amounts. When the toner has a large particle diameter, it needs to be added in large amounts. In the case where the toner particle diameter is 3 μm to 7 μm, the dispersion liquid concentration can be adjusted to the range of 5,000 number per μL to 15,000 number per μL by adding 0.1 g to 0.5 g of the toner.

—Volume Specific Resistance of Toner—

The common logarithmic value Log ρ of the volume specific resistance ρ (Ωcm) of the toner is preferably 10.9 Log Ωcm to 11.4 Log Ωcm. As a result, dispersion state of a colorant and the like in the toner is excellent, thereby obtaining excellent toner charge stability, and causing less toner scattering and fogging. When the common logarithmic value Log ρ of the volume specific resistance ρ (Ωcm) of the toner is smaller than 10.9 Log Ωcm, the conductivity becomes high, causing charging failures. As a result, background smear, toner scattering, etc. tend to increasingly occur. Moreover, an abnormal image may be formed due to electrostatic offset, and a high quality image may not be stably formed. When it is greater than 11.4 Log Ωcm, the resistance becomes high, possibly causing increase in the charge amount, and decrease in the image density.

—BET Specific Surface Area of Toner—

The BET specific surface area is preferably 0.5 $m^2/g$ to 4.0 $m^2/g$, more preferably 0.5 $m^2/g$ to 2.0 $m^2/g$. When the BET specific surface area is smaller than 0.5 $m^2/g$, the toner particles are covered densely with the fine resin particles, which impair the adhesion between a recording paper and the binder resin inside the toner particles. As a result, the lower limit temperature for fixing may be elevated. In addition, the fine resin particles prevent wax from oozing out, failing to obtaining the releasing effect of the wax and causing occurrence of offset. When the BET specific surface area of the toner exceeds 4.0 $m^2/g$, fine organic particles remaining on the toner particle surface considerably project as protrusions. The fine resin particles remain as coarse multilayers and impair the adhesion between a recording paper and the binder resin inside the toner particles. As a result, the lower limit temperature for fixing may be elevated. In addition, the fine resin particles prevent wax from oozing out, failing to obtain the releasing effect of the wax, and causing occurrence of offset. Furthermore, the additives protrude to form irregularities in the toner surface, which easily affects the image quality.

Color of the toner is not particularly limited and may be appropriately selected depending on the intended purpose, and is at least one selected from a black toner, a cyan toner, a magenta toner and a yellow toner. The toner of each color can be obtained by appropriately selecting types of the colorants. A full-color toner is preferable.

(Developer)

The developer of the present invention at least contains the toner of the present invention. The developer may further contain other components such as a carrier. Examples of the developer include a one-component developer and a two-component developer. For high-speed printers responding to the recent increase in information processing speed, the two component developer is preferably used from the viewpoint of elongating the service life.

In the case of the one-component developer using the toner, variations in toner particle diameter decrease even after toner consumption or toner supply, and toner filming to a developing roller and toner fusing to a layer regulating member, such as a blade to form a thin toner film, are prevented, and in addition, even after long-time use of the developing device, i.e. long-time stirring of developer, excellent developing ability can be ensured. Thus, a high-quality image can be obtained. In the case of the two-component developer, variations in toner particle diameter are small in the developer even after toner consumption and toner supply have been repeated for a long time, and in addition, even after a long time stirring in the developing device, excellent developing ability can be ensured.

—Carrier—

The carrier is not particularly limited and may be appropriately selected depending on the intended purpose. The carrier preferably has a core material and a resin layer coating the core material.

The material of the core material is not particularly limited and may be appropriately selected depending on the intended purpose. For example, it is preferable to employ manganese-strontium (Mn—Sr) materials or manganese-magnesium (Mn—Mg) materials (50 emu/g to 90 emu/g). Further, it is preferably to employ high magnetization materials such as iron powder (100 emu/g or more) or magnetite (75 emu/g to 120 emu/g) for the purpose of securing image density. Moreover, it is preferably to employ low magnetization materials such as copper zinc (Cu—Zn) with 30 emu/g to 80 emu/g because the impact toward a latent electrostatic image bearing member on which the toner held in an upright position can be relieved and because it is advantageous for improving image quality. These may be used alone or in combination.

The material of the resin layer is not particularly limited and may be appropriately selected from known resins depending on the intended purpose. Examples thereof include amino resins, polyvinyl resins, polystyrene resins, halogenated polyolefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoroterpolymers such as terpolymers of tetrafluoroethylene, vinylidene fluoride and monomer having no fluorine-containing group, and silicone resins. These may be used alone or in combination. Among these, silicone resins are particularly preferable.

The silicone resins are not particularly limited and may be appropriately selected from known silicone resins depending on the intended purpose. Examples thereof include straight silicone resins composed only of organosiloxane bond; and silicone resins that have been modified with alkyd resin, polyester resin, epoxy resin, acrylic resin, or urethane resin.

As the silicone resins, commercially available products may be used. Examples of the straight silicone resins include KR271, KR255 and KR152 manufactured by Shin-Etsu Chemical Co., Ltd.; and SR2400, SR2406, and SR2410 manufactured by DOW CORNING TORAY SILICONE CO., LTD.

As the modified silicone resins, commercially available products may be used. Examples of the modified silicone resin include KR206 (alkyd-modified), KR5208 (acryl-modified), ES1001N (epoxy-modified), and KR305 (urethane modified) manufactured by Shin-Etsu Chemical Co., Ltd.; and SR2115 (epoxy-modified) and SR2110 (alkyd-modified) manufactured by DOW CORNING TORAY SILICONE CO., LTD.

Each of these silicone resins may be used alone, and components capable of crosslinking reaction, charge amount controlling components and the like may be used in combination therewith.

In the resin layer conductive powder may be contained, if necessary. The conductive powder is not particularly limited and may be appropriately selected depending on the intended purpose. Examples thereof include metal powder, carbon black, titanium oxide, tin oxide, and zinc oxide. The average particle diameter of the conductive powder is not particularly limited and may be appropriately selected depending on the intended purpose. It is preferably 1 μm or less. When the average particle diameter is greater than 1 μm, it may be difficult to control the electrical resistance.

The resin layer may be formed by uniformly coating a surface of the core material with a coating solution obtained by dissolving the silicone resin or the like in a solvent, by a known coating method, followed by drying and baking. The coating method is not particularly limited and may be appropriately selected depending on the intended purpose. Examples thereof include clipping, spraying, and brushing.

The solvent is not particularly limited and may be appropriately selected depending on the intended purpose. Examples thereof include toluene, xylene, methyl ethyl ketone, methyl isobutyl ketone, cellosolve, and butyl acetate.

The baking method is not particularly limited and may be appropriately selected depending on the intended purpose. It may be external heating or internal heating. Examples of the baking method include methods using fixed electric furnace, fluid electric furnace, rotary electric furnace, or burner furnace, and methods using microwaves.

The amount of the resin layer in the carrier is not particularly limited and may be appropriately selected depending on the intended purpose. It is preferably 0.01% by mass to 6.0% by mass. When the amount is less than 0.01% by mass, the resin layer may not be uniformly formed over the surface of the core material. When the amount is more than 5.0% by mass, the resin layer becomes so thick that fusing of carrier particles occurs and thus equally-sized carrier particles may not be obtained.

The amount of the carrier contained in the two-component developer is not particularly limited and may be appropriately selected depending on the intended purpose. The amount of the carrier is preferably 90% by mass to 98% by mass, more preferably 92% by mass to 97% by mass.

In the case of two-component developer, the mixing ratio of the toner to the carrier is preferably 1 part by mass to 10.0 parts by mass of the toner relative to 100 parts by mass of the carrier.

The weight average particle diameter of the carrier Dw is not particularly limited but is preferably 15 μm to 40 μm. When the weight average particle diameter is smaller than 16 μm, carrier adhesion, which is a phenomenon that the carrier is also disadvantageously transferred in the transfer step, is likely to occur. When the weight average particle diameter is larger than 40 μm, the carrier adhesion is less likely to occur. In this case, however, when the toner density is increased to provide a high image density, there is a possibility that background smear is likely to occur. Further, when the dot diameter of a latent image is small, variation in dot reproducibility is so large that the granularity in highlight parts may be degraded.

The weight average particle diameter (Dw) of the carrier is calculated on the basis of the particle size distribution of the particles measured on a number basis; i.e., the relation between the number based frequency and the particle diameter. In this case, the weight average particle diameter (Dw) is expressed by Equation (1):

$$Dw=\{1/\Sigma(nD^3)\}\times\{\Sigma(nD^4)\} \quad \text{Equation (1)}$$

in Equation (1) D represents a typical particle diameter (μm) of particles present in each channel, and "n" represents the total number of particles present in each channel. It should be noted that each channel is a length for equally dividing the range of particle diameters in the particle size distribution chart, and 2 μm is employed for each channel in the present invention. For the typical particle diameter of particles present in each channel, the minimum particle diameter of the particles present in each channel is employed.

In addition, the number average particle diameter (Dp) of the carrier or the core material particles are calculated on the basis of the particle diameter distribution measured on a number basis. The number average particle diameter (Dp) is expressed by Equation (2):

$$Dp=(1/\Sigma N)\times(\Sigma nD) \quad \text{Equation (2)}$$

in Equation (2) N represents the total number of particles measured, "n" represents the total number of particles present in each channel and D represents the minimum particle diameter of the particles present in each channel (2 μm).

For a particle size analyzer used for measuring the particle size distribution, a micro track particle size analyzer (Model HRA9320-X100, manufactured by Honewell Co.) may be used. The evaluation conditions are as follows.

(1) Range of particle diameters: 8 μm to 100 μm
(2) Channel length (width): 2 μm
(3) Number of channels: 46
(4) Refraction index: 2.42

(Image Forming Method and Image Forming Apparatus)

An image forming method of the present invention includes a charging step, an exposing step, a developing step, a primary transfer step, a secondary transfer step, a fixing step, and a cleaning step, and if necessary further includes other steps.

An image forming apparatus of the present invention includes an electrophotographic photoconductor (also, referred to as photoconductor, or latent electrostatic image bearing member), a charging unit, an exposing unit, a developing unit, a primary transfer unit, a secondary transfer unit, a fixing unit, and a cleaning unit, and if necessary further includes other units.

In the image forming method, in the secondary transfer step, the linear velocity of transferring a toner image onto a recording medium is not particularly limited and may be appropriately selected depending on the intended purpose. It is preferably 300 mm/sec to 1,000 mm/sec, the secondary transfer step the transfer time at a nip portion in the secondary transfer unit is preferably 0.5 msec to 20 msec.

Further, the image forming apparatus of the present invention is preferably of a tandem type including a plurality of sets of an electrophotographic photoconductor, a charging unit, an exposing unit, a developing unit, a primary transfer unit, and a cleaning unit. In the so-called tandem type in which a plurality of electrophotographic photoconductors are provided, and development is carried out one color by one color upon each rotation, a latent electrostatic image formation step and a development and transfer step are carried out for each color to form each color toner image. Accordingly, the difference in speed between single color image formation and full color image formation is so small that the tandem type can advantageously apply to high-speed printing. In this case, the color toner images are formed on respective separate electrophotographic photoconductors, and the color toner layers are stacked (color superimposition) to form a full color image. Accordingly, when a variation in properties, for example, a difference in charging ability between color toner particles exists, a difference in amount of the developing toner occurs between the individual color toner particles. As a result, a change in hue of secondary color by color superimposition is increased, and the color reproducibility is lowered.

It is necessary for the toner used in the tandem image forming method to satisfy the requirements that the amount of the developing toner for regulating the balance of the colors is stabilized (no variation in developing toner amount between respective color toner particles), and the adherence to an electrophotographic photoconductor and to a recording medium is uniform between the respective color toner particles. With respect to these points, the toner of the present invention is preferable.

<Electrophotographic Photoconductor>

The electrophotographic photoconductor is not particularly limited as to the material, shape, structure, size and the like, and may be appropriately selected depending on the intended purpose. For the shape, drum-shape, sheet-shape, and endless belt-shape are exemplified. The structure of the electrophotographic photoconductor may be a single-layer structure or a laminate structure. The size of the electrophotographic photoconductor may be appropriately selected in accordance with the size and specification of the image forming apparatus employed. Examples of the material of the electrophotographic, photoconductor include inorganic photoconductors such as amorphous silicon, selenium, CdS, and ZnO; and organic photoconductors (OPC) such as polysilane, and phthalopolymethine.

The amorphous silicon photoconductor is provided with a photosensitive layer composed of a-Si, on a substrate which is heated at 50° C. to 400° C., by a layer forming method such as vacuum evaporation method, sputtering method, ion-plating method, heat CVD method, optical CVD method, and plasma CVD method. Among these layer forming methods, plasma CVD method is particularly preferable. Specifically, a method is preferable in which a raw material gas is decomposed by means of a high frequency wave or microwave glow discharge, and a photosensitive layer composed of a-Si is formed on a substrate with the use of the decomposed gas.

The organic photoconductors (OPC) are widely used for the following reasons: (1) optical properties such as its width of optical absorption wavelength range, and its largeness of optical absorption amount; (2) electric properties such as high-sensitivity, and stable charge property; (3) wide selection of materials; (4) ease of production; (5) low-cost; and (6) non-toxicity. Layer structures of such organic photoconductors are broadly classified into single-structure and laminate structure.

A single-layer photoconductor is provided with a substrate, and a single-layer photosensitive layer on the substrate, and if necessary, further provided with a protective layer, an intermediate layer and other layers.

The photoconductor of the laminate structure is provided with a substrate and a laminated photosensitive layer, which has at least a charge generating layer, and a charge transporting layer in this order, on the substrate, and if necessary, further provided with a protective layer, an intermediate layer, and other layers.

<Charging Step and Charging Unit>

The charging step is a step of charging a surface of a latent electrostatic image bearing member, and is carried out by means of the charging unit.

The charging unit is not particularly limited as long as being capable of applying a voltage to the surface of the latent electrostatic image bearing member to uniformly charge the surface, and it may be appropriately selected depending on the intended purpose. Charging units are broadly-classified into the following two types: (1) contact charging units each configured to charge a surface of a latent electrostatic image bearing member in a contact manner; and (2) non-contact charging units each configured to charge a surface of a latent electrostatic image bearing member in a non-contact manner.

The charging unit is not particularly limited and may be appropriately selected depending on the intended purpose, but the charging unit preferably applies at least an alternating voltage superimposed on direct voltage. The application of the alternating voltage superimposed on direct voltage can stabilize the surface voltage of the electrophotographic photoconductor to a desired value as compared with the application of only a direct current voltage. Accordingly, further uniform charging can be realized. The charging unit preferably performs charging by bringing a charging member into contact with the electrophotographic photoconductor and applying the voltage to the charging member. When charging is carried out by bringing the charging member into contact with the electrophotographic photoconductor and applying the voltage to the charging member, the effect of uniform charging ability attained by applying the alternating voltage superimposed on direct voltage can be further improved.

Figure 3:
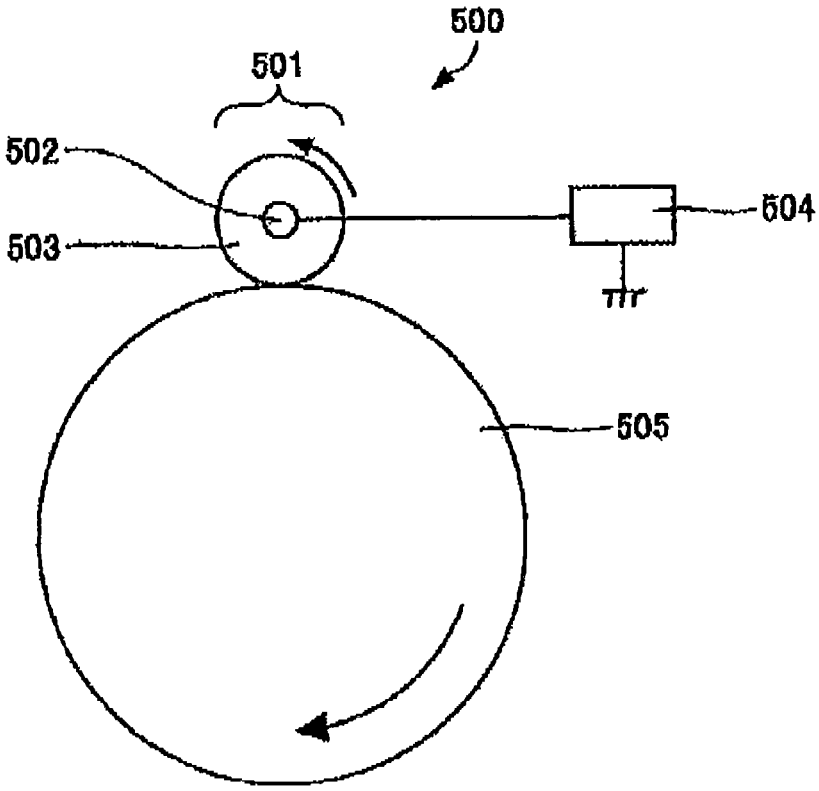
FIG. 3 is a schematic view of one exemplary contact roller charging device.
Figure 4:
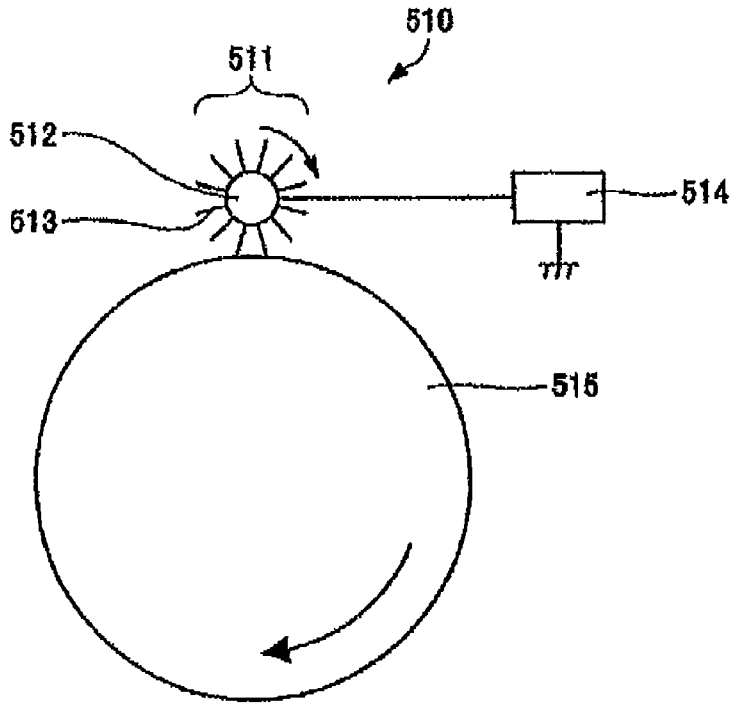
FIG. 4 is a schematic view of one exemplary contact brush charging device.

The charging unit used in the image forming method of the present invention may be a contact charging device shown in FIGS. 3 and 4.

—Roller Charging Device—

FIG. 3 is a schematic configuration of an example of a roller charging device 500 which is one type of the contact charging devices. A photoconductor (electrophotographic photoconductor) 605 to be charged as an image bearing member is rotated at a predetermined speed (process speed), in the direction indicated by the arrow. A charging roller 501 serving as a charging member, which is brought into contact with the photoconductor 505, contains a metal core 502 and a conductive rubber layer 503 formed on the outer surface of the metal core 502 in a shape of a concentric circle, as a basic structure. The both terminals of the metal core 502 are supported with bearings (not shown) so that the charging roller enables to rotate, and the charging roller is pressed against the photoconductor drum at a predetermined pressure by a pressurizing unit (not shown). The charging roller 501 in FIG. 3 therefore rotates along with the rotation of the photoconductor 505. The charging roller 501 is generally formed with a diameter of 16 mm in which a metal core 502 having a diameter of 9 mm is coated with a conductive rubber layer 503 having a moderate resistance of approximately 100,000 Ω·cm. The power supply 504 shown in the figure is electrically connected to the metal core 502 of the charging roller 601, and a predetermined bias is applied to the charging roller 501 by the power supply 504. Thus, the surface of the photoconductor 505 is uniformly charged at a predetermined polarity and potential.

In addition to the roller charging device, the charging device used in the present invention may be any form, such as a magnetic brush charging device, a fur brush charging device, or the like. It may be appropriately selected according to a specification or configuration of an electrophotographic image forming apparatus. When the magnetic brush charging device is used as the charging device, the magnetic brush includes a charging member formed of various ferrite particles such as Zn—Cu ferrite, etc., a non-magnetic conductive sleeve to support the ferrite particles, and a magnetic roller included in the non-magnetic conductive sleeve. Moreover, in the case of using the fur brush charging device, a material of the fur brush is, for example, a fur treated to be conductive with, for example, carbon, copper sulfide, a metal or a metal oxide, and the fur is coiled or mounted to a metal or another metal core which is treated to be conductive, thereby obtaining the charging device, —Fur Brush Charging Device—

FIG. 4 is a schematic configuration of one example of a contact fur brush charging device 510. A photoconductor (electrophotographic photoconductor) 515 to be charged as an image bearing member is rotatably driven at a predetermined speed (process speed) in the direction indicated by the arrow. The fur brush roller 511 having a fur brush is brought into contact with the photoconductor 515, with a predetermined nip width and a predetermined pressure with respect to elasticity of a brush part 513.

The fur brush roller 511 as the contact charging device has an outer diameter of 14 mm and a longitudinal length of 250 mm. In this fur brush, a tape formed of a pile of conductive rayon fiber REC-B (manufactured by Unitika Ltd.), as a brush part 513, is spirally coiled around a metal core 512 having a diameter of 6 mm, which serves also as an electrode. A brush of the brush part 513 is of 300 denier/50 filament, and a density of 155 fibers per 1 square millimeter. This role brush is once inserted into a pipe having an internal diameter of 12 mm with rotating in a certain direction, and is set so as to be a concentric circle relative to the pipe. Thereafter, the role brush in the pipe is, left in an atmosphere of high humidity and high temperature so as to twist the fibers of the fur.

The resistance of the fur brush roller 511 is $1\times10^5\Omega$ at an applied voltage of 100 V. This resistance is calculated from the current obtained when the fur brush roller is contacted with a metal drum having a diameter of 30 mm with a nip width of 3 mm, and a voltage of 100 V is applied thereon. The resistance of the brush charging device 510 should be $10^4\Omega$ or more in order to prevent image defect caused by an insufficient charge at the charging nip part when the photoconductor 515 to be charged happens to have defects caused by low pressure resistance, such as pin holes thereon and an excessive leak current therefore runs into the defects. Moreover, the resistance needs to be $10^7\Omega$ or less in order to sufficiently charge the surface of the photoconductor 515.

The material of the fur brush is not particularly limited, and may be appropriately selected depending on the intended purpose. Examples of the material of the fur brush include, in addition to REC-B, REC-C, REC-M1, REC-M10 (manufactured by Unitika Ltd.), SA-7 (manufactured by Toray Industries, Inc.), THUNDERON (manufactured by Nihon Sanmo Dyeing Co., Ltd.), BELTRON (manufactured by Kanebo Gohsen, Ltd.), KURACARBO in which carbon is dispersed in rayon (manufactured by Kuraray Co., Ltd.), and ROVAL (manufactured by Mitsubishi Rayon Co., Ltd.). The brush is of preferably 3 denier to 10 denier per fiber, 10 filaments per bundle to 100 filaments per bundle, and 80 fibers/mm$^2$ to 600 fibers/mm$^2$. The length of the fur is preferably 1 mm to 10 mm.

The fur brush roller 511 is rotatably driven in the opposite (counter) direction to the rotation direction of the photoconductor 515 at a predetermined peripheral velocity (surface velocity), and comes into contact with a surface of the photoconductor with a velocity difference. The power supply 514 applies a predetermined charging voltage to the fur brush roller 511 so that the surface of the photoconductor is uniformly charged at a predetermined polarity and potential.

The contact charge of the photoconductor 515 with the fur brush roller 511 is performed in the following manner: charges are mainly directly injected and the surface of the photoconductor is charged at the substantially equal voltage to the applying charging voltage to the fur brush roller 511.

The charging member is not limited in its shape and may be in any shape such as a charging roller or a fur blush, as well as the fur blush roller 511. The shape can be selected according to the specification and configuration of the image forming apparatus. When a charging roller is used, it generally includes a metal core and a rubber layer having a moderate resistance of about 100,000 Ω·cm coated on the metal core. When a magnetic fur blush is used, it generally includes a charging member formed of various ferrite particles such as Zn—Cu ferrite, a non-magnetic conductive sleeve to support the ferrite particles, and a magnet roll included in the non-magnetic conductive sleeve.

—Magnetic Brush Charging Device—

Figure 5:
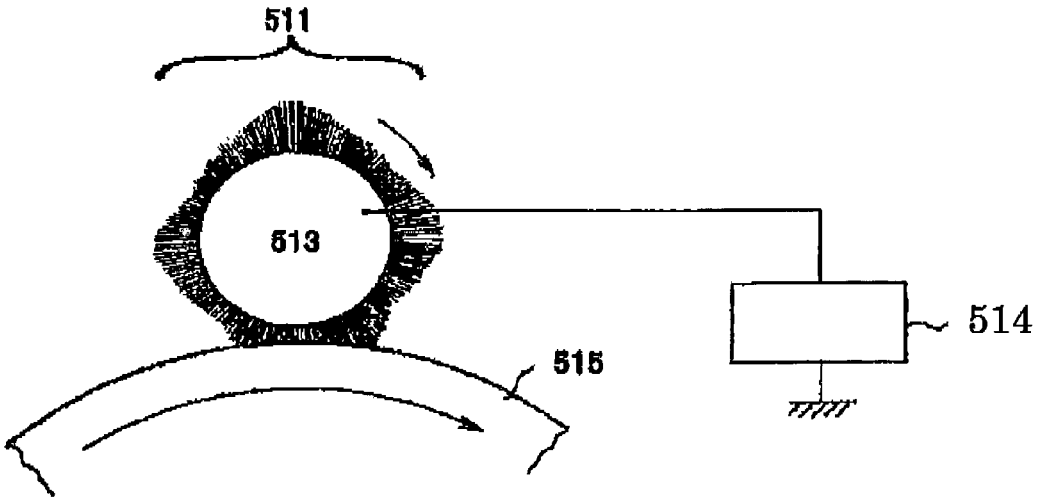
FIG. 5 is a schematic view of due exemplary magnetic brush charging device.

FIG. 5 is a schematic configuration of one example of a magnetic brush charging device. A photoconductor (electrophotographic photoconductor) 515 to be charged as an image bearing member is rotatably driven at a predetermined speed (process speed) in the direction indicated by the arrow. The fur brush roller 511 having a magnetic brush is brought into contact with the photoconductor 515, with a predetermined nip width and a predetermined pressure with respect to elasticity of a brush part 613.

The magnetic brush as the contact charging member is formed of magnetic particles. For the magnetic particles, Zn—Cu ferrite particles having an average particle diameter of 25 μm and Zn—Cu ferrite particles having an average particle diameter of 10 μm are mixed together in a ratio by mass of 1:0.05, so as to obtain ferrite particles having an average particle diameter of 25 μm, which have peaks at each average particle diameter, and then the ferrite particles are coated with a resin layer having a moderate resistance, to thereby form magnetic particles. The contact charging member is formed of the aforementioned coated magnetic particles, a non-magnetic conductive sleeve which supports the coated magnetic particles, and a magnet roller which is, included in the non-magnetic conductive sleeve. The coated magnetic particles are disposed on the sleeve with a thickness of 1 mm so as to form a charging nip of about 5 mm-wide with the photoconductor. The width between the magnetic particle-bearing sleeve and the photoconductor is adjusted to approximately 500 μm. The magnetic roller is rotated so that the sleeve is rotated at twice in speed relative to the peripheral speed of the surface of the photoconductor in the opposite direction of the rotation of the photoconductor, to thereby slidingly rub the photoconductor. Therefore, the magnetic brush is uniformly brought into contact with the photoconductor.

<Exposing Step and Exposing Unit>

The exposing step is a step of exposing the charged surface of the electrophotographic photoconductor imagewise using the exposing unit.

The exposure may be carried out by exposing the surface of the electrophotographic photoconductor imagewise using of the exposing unit.

The optical systems used for the exposure may be broadly classified into analogue optical systems and digital optical systems. The analogue optical systems are those projecting directly an original image onto the surface of a photoconductor, and the digital optical systems are those where image information is input as electric signals, the electric signals are then converted into optical signals and the photoconductor is exposed to form an image.

The exposing unit is not particularly limited as long as it is capable of exposing imagewise on the surface of the electrophotographic photoconductor which has been charged by the charging unit and may be appropriately selected depending on the intended purpose. Examples thereof include various exposing devices such as a copying optical system, a rod lens array system, a laser optical system, and a liquid crystal shutter optical system, and a LED optical system.

Here, in the present invention, a backlight system for exposing the electrophotographic photoconductor imagewise from the rear surface side may be employed.

<Developing Step and Developing Unit>

The developing step is a step of developing the latent electrostatic image using the toner and/or developer of the present invention so as to form a visible image.

The visible image may be formed by developing the latent electrostatic image using the toner and/or developer by the developing unit.

The developing unit is not particularly limited as long as it is capable of developing using the toner and/or developer, and may be appropriately selected from known ones. For example, one that includes at least a developing unit that contains the toner and/or developer and is capable of supplying the toner and/or developer to the latent electrostatic image in a contact or noncontact manner is preferable.

The developing unit may employ either a dry developing system or a wet developing system, and may be either a single-color developing unit or a multi-color developing unit. Examples thereof include one including a stirrer that frictionally stirs the toner and/or developer so as to be charged and a rotatable magnet roller.

In the developing device, for example, the toner and the carrier are mixed and stirred, the toner is charged by friction upon stirring and is held in an upright position on the surface of the rotating magnet roller to form a magnetic brush. Since the magnet roller is arranged in the vicinity of the electrophotographic photoconductor, a part of the toner constituting the magnetic brush formed on the surface of the magnet roller is moved to the surface of the electrophotographic photoconductor by an electrical suction force. As a result, the latent electrostatic image is developed with the toner to form a visible image on the surface of the electrophotographic photoconductor.

Figure 6:
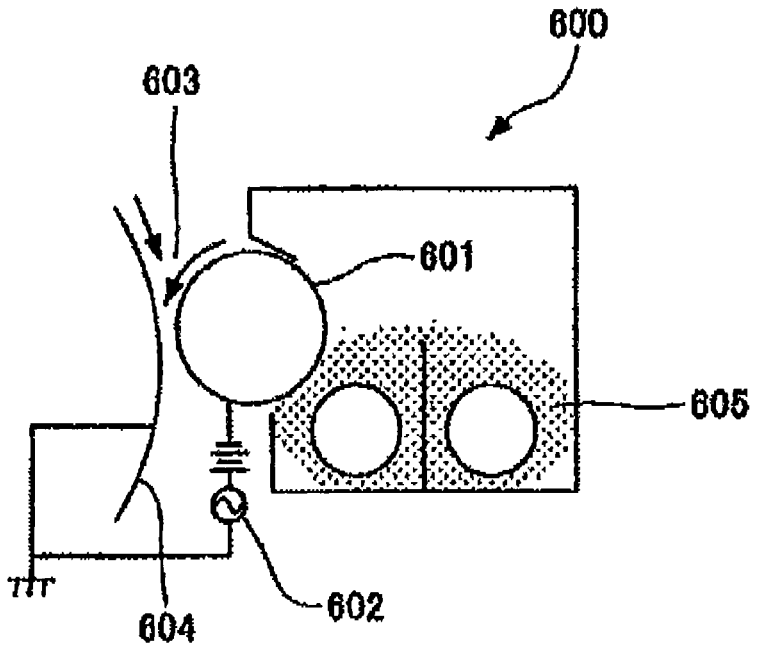
FIG. 6 is a schematic view of one exemplary developing device.

In the present invention, when a latent electrostatic image on the photoconductor is developed, an alternating electrical field is preferably applied. In a developing device 600 shown in FIG. 6, a power supply 602 applies a vibration bias voltage as developing bias, in which a direct-current voltage and an alternating voltage are superimposed, to a developing sleeve 601 during development. The potential of background part and the potential of image part are positioned between the maximum and the minimum of the vibration bias potential. This forms an alternating electrical field, whose direction alternately changes, at a developing section 603. A toner and a carrier in the developer are intensively vibrated in this alternating electrical field, so that the toner 605 overshoots the electrostatic force of constraint from the developing sleeve 601 and the carrier, and is attached to a latent image on the photoconductor 604. The toner 695 is a toner produced by the above-described method for producing a toner of the present invention.

The difference between the maximum and the minimum of the vibration bias voltage (peak-to-peak voltage) is preferably from 0.5 kV to 5 kV, and the frequency is preferably from 1 kHz to 10 kHz. The waveform of the vibration bias voltage may be a rectangular wave, a sine wave or a triangular wave. The direct-current voltage of the vibration bias voltage is in a range between the potential at the background and the potential at the image as mentioned above, and is preferably set closer to the potential at the background from the viewpoint of inhibiting a toner deposition (fogging) on the background.

When the vibration bias voltage is a rectangular wave, it is preferred that a duty ratio be 50% or less. The duty ratio is a ratio of time when the toner leaps to the photoconductor during a cycle of the vibration bias. In this way, the difference between the peak time value when the toner leaps to the photoconductor and the time average value of bias can become very large. Consequently, the movement of the toner becomes further activated hence the toner is accurately attached to the potential distribution of the latent electrostatic image and rough deposits and an image resolution can be improved. Moreover, the difference between the time peak value when the carrier having an opposite polarity of current to the toner leaps to the photoconductor and the time average value of bias can be decreased. Consequently the movement of the carrier can be restrained and the possibility of the carrier deposition on the background is largely reduced.

<Transfer Step and Transfer Unit>

The transfer step is a step of transferring the visible image to a recording medium using the transfer unit. The transfer units are broadly classified into transfer units where a visible image on a latent electrostatic image bearing member is directly transferred onto a recording medium, and secondary transfer units where a visible image is primarily transferred onto an intermediate transfer medium and then the visible image is secondarily transferred onto the recording medium. The visible-image transfer may be carried out, for example, by charging the latent electrostatic image bearing member using a transfer charging device, which may be performed by the transfer unit.

In a preferable embodiment, the transfer unit has a primary transfer unit that transfers the visible image to the intermediate transfer medium to form a composite transfer image, and a secondary transfer unit that transfers the composite transfer image to the recording medium.

—Intermediate Transfer Medium—

The intermediate transfer medium is not particularly limited and may be appropriately selected from known ones depending on the intended purpose, and examples thereof include a transfer belt, and a transfer roller.

The stationary friction coefficient of the intermediate transfer medium is preferably 0.1 to 0.6, and more preferably 0.3 to 0.5. The volume resistance of intermediate transfer medium is preferably several Ω·cm to $10^3$ Ω·cm. The volume resistance within the range of several Ω·m to $10^3$ Ω·cm may prevent charging of the intermediate transfer medium itself, and the charge applied by a charge application unit is unlikely to remain on the intermediate transfer medium, therefore, transfer nonuniformity at the secondary transferring may be prevented and the application of transfer bias at the secondary transferring is easily performed.

Material used for the intermediate transfer medium are not particularly limited and may be appropriately selected from known ones depending on the intended purpose. Examples of the material include the followings: (1) materials with high Young's modulus (tension elasticity) used as a single layer belt such as polycarbonates (PC), polyvinylidene fluoride (PVDF), polyalkylene terephthalate (PAT), blend materials of PC/PAT, blend materials of ethylene tetrafluoroethylene copolymer (ETFE) and PC, blend materials of ETFE and PAT, blend materials of PC and PAT, and thermosetting polyimides of carbon black dispersion. These single layer belts having high Young's modulus are small in their deformation against stress during image formation and are particularly advantageous in that registration error is less likely to occur during color image formation; (2) a double or triple layer belt using the belt having high Young's modulus as described in (1) as a base layer, on which outer periphery a surface layer and an optional intermediate layer are formed. The double or triple layer belt has a capability of preventing print defect of unclear center portion in a line image that is caused by hardness of the single layer belt; and (3) an elastic belt incorporating a resin, a rubber or an elastomer with relatively low Young's modulus. This belt is advantageous in that there is almost no print defect of unclear center portion in a line image owing to its softness. Additionally, by making width of the belt wider than drive roller or tension roller and thereby using the elasticity of edge portions that extend over the rollers, it can prevent meandering of the belt. It is also cost effective for requiring neither ribs nor units for prevention of meandering.

Of these, the elastic belt (3) is preferable in particular.

The elastic belt deforms corresponding to the surface roughness of a toner layer and the recording medium having poor smoothness in the transfer section. In other words, since elastic belts deform complying with local roughness and an appropriate adhesiveness can be obtained without excessively increasing the transfer pressure against the toner layer, it is possible, to obtain transfer images having excellent uniformity with no void in characters even on a recording medium having poor smoothness.

The resin materials used for the elastic belt are not particularly limited and may be appropriately selected depending on the intended purpose. Examples thereof include polycarbonate resins, fluorine resins (such as ETFE and PVDF); polystyrenes, chloropolystyrenes, poly-α-methylstyrenes; styrene resins (homopolymers or copolymers containing styrene or styrene substituents) such as styrene-butadiene copolymers, styrene-vinyl chloride copolymers, styrene-vinyl acetate copolymers, styrene-maleic acid copolymers, styrene-acrylate copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (such as styrene-methyl methacrylate copolymers, styrene-ethyl methacrylate copolymers and styrene-phenyl methacrylate copolymers); styrene-α-chloromethyl acrylate copolymers, styrene acrylonitrile acrylate copolymers, methyl methacrylate resins, and butyl methacrylate resins; ethyl acrylate resins, butyl acrylate resins, modified acrylic resins (such as silicone-modified acrylic resins, vinyl chloride resin-modified acrylic resins and acrylic urethane resins); vinyl chloride resins, styrene-vinyl acetate copolymers, vinyl, chloride-vinyl acetate copolymers, resin-modified maleic acid resins, phenol resins, epoxy resins, polyester resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinylbutylal resins, polyamide resins and modified polyphenylene oxide resins. These resins may be used alone or in combination.

The rubbers used for the elastic belt are not particularly limited and may be appropriately selected depending on the intended purpose. Examples thereof include natural rubber, butyl rubber, fluorine-based rubber, acryl rubber, EPOM rubber, NBR rubber, acrylonitrile-butadiene-styrene rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber, hydrogenated nitrile rubber. These may be used alone or in combination.

The elastomers used for the elastic belt are not particularly limited and may be appropriately selected depending on the intended purpose. Examples thereof include thermoplastic elastomers, of polystyrene, polyolefin, polyvinyl chloride, polyurethane, polyamide, polyurea, polyester and fluorine resins. These may be used alone or in combination.

The conductive agent used for the elastic belt for adjusting resistance is not particularly limited and may be appropriately selected depending on the intended purpose. Examples thereof include carbon black, graphite, metal powders such as aluminum and nickel; conductive metal oxides such as tin oxide, titanium oxide, antimony oxide, indium oxide, potassium titanate, antimony tin oxide (ATO), and indium tin oxide (ITO). The conductive metal oxides may be coated with insulating fine particles such as barium sulfate, magnesium silicate, and calcium carbonate.

The material used for the surface layer of the elastic belt is required to prevent contamination of the photoconductor clue to elastic material as well as to reduce the surface frictional resistance of the elastic belt so that toner adhesion force is decreased while improving the cleaning ability and the secondary transfer property. The surface layer preferably contains a binder resin such as polyurethane resins, polyester resins, and epoxy resins and materials that reduce surface energy and enhance lubrication, for example, powders or particles such as fluorine resins, fluorine compounds, carbon fluoride, titanium dioxide, and silicon carbide. In addition, it is possible to use materials such as fluorine rubbers that are treated with heat so that a fluorine-rich layer is formed on the surface of the belt and the surface energy is reduced.

A method for producing the elastic belt is not particularly limited and may be appropriately selected depending on the intended purpose. Examples thereof include (1) centrifugal forming in which material is poured into a rotating cylindrical mold to form a belt, (2) spray coating method in which a liquid coating solution is sprayed to form a film, (3) dipping method in which a cylindrical mold is dipped into a solution of material and then pulled out, (4) injection mold method in which material is injected into inner and outer molds, (5) a method in which a compound is applied onto a cylindrical mold and the compound is vulcanized and ground.

A method for preventing the elastic belt from elongating is not particularly limited and may be appropriately selected depending on the intended purpose. Examples thereof include (1) a method in which materials that prevent elongation are added to a core layer and (2) a method in which a rubber layer is formed on a core layer which is less stretchable.

The material that prevents elongation is not particularly limited and may be appropriately selected depending on the intended purpose. For example, natural fibers such as cotton, and silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenol fibers; inorganic fibers such as carbon fibers, glass fibers, and boron fibers; metal fibers such as iron fibers, and copper fibers; and materials that are in a form of a weave or thread may be preferably used.

The method for forming the core layer is not particularly limited and may be appropriately selected depending on the intended purpose. Examples thereof include (1) a method in which a weave that is woven in a cylindrical shape is placed on a mold or the like and a coating layer is formed on top of it, (2) a method in which a weave that is woven in a cylindrical shape is dipped in a liquid rubber or the like so that coating layer(s) are formed on one side or on both sides of the core layer and (3) a method in which a thread is twisted helically around a mold or the like with an arbitrary pitch, and then a coating layer is formed thereon.

As the coated layer comes to thicker, elongation and contraction of the surface comes to more significant and the surface layer is susceptible to cracks, causing significant elongation and contraction of images, therefore, excessive thickness such as above 1 mm is undesirable.

The transfer unit, i.e. the primary transfer unit and the secondary transfer unit, preferably has at least a transferer that is configured to charge so as to separate the visible image formed on the latent electrostatic image bearing member and transfer the visible image onto the recording medium. One transferer or two transferers may be used. Examples of the transferer include corona transferers utilizing corona discharge, transfer belts, transfer rollers, pressure transfer rollers, and adhesion-transferers.

A typical recording medium is plain paper, and it is not particularly limited as long as being capable of receiving transferred, unfixed image after developed, and may be appropriately selected depending on the intended purpose; and PET bases for OHP may also be used.

<Fixing Step and Fixing Unit>

The fixing step is a step of fixing the transferred visible image on a recording medium using the fixing unit.

The fixing unit is not particularly limited and may be appropriately selected depending on the intended purpose, however, a fixing device having a fixing member and a heat source for heating the fixing member is preferably used.

The fixing member is not particularly limited as long as they can be in contact with each other to form a nip, and may be appropriately selected depending on the intended purpose. Examples of the fixing member include a combination of an endless belt and a roller, and a combination of a roller and a roller. In view of shorter warm-up period and energy saving, a combination of an endless belt and a roller or induction heating where the transferred image is heated from the surfaces of the fixing member, is preferably employed.

The fixing member is exemplified by conventional heating and pressurizing units, i.e. a combination of a heating unit and a pressurizing unit. For the heating and pressurizing units, in the case of the combination of an endless belt and a roller, it is exemplified by a combination of a heating roller, a pressurizing roller, and an endless belt, and in the case of the combination of a roller and a roller, it is exemplified by a combination of a heating roller and a pressurizing roller.

The fixing unit is not particularly limited and may be appropriately selected depending on the intended purpose. The fixing unit including a heating roller that is formed of a magnetic metal and is heated by electromagnetic induction; a fixation roller disposed parallel to the heating roller; an endless belt-like toner heating medium (a heating belt) that is stretched around the heating roller and the fixation roller and rotated by these rollers, while being heated by the heating roller, and a pressure roller that is brought into pressure contact with the fixation roller through the heating belt and is rotated in a forward direction relative to the heating belt to form a fixation nip part. The fixing step can realize a temperature rise in the fixation belt in a short time and can realize stable temperature control. Further, even when a recording medium having a rough surface is used, during the fixation, the fixation belt acts in conformity to the surface of the transfer paper to some extent and, consequently, satisfactory fixing ability can be realized.

The fixing unit is preferably of an oil-less type or a minimal oil-coated fixing type. To this end, preferably, the toner particles to be fixed contain a releasing agent (wax) in a finely dispersed state in the toner particles. In the toner in which a releasing agent is finely dispersed in the toner particle, the releasing agent is likely to ooze out during fixation. Accordingly, in the oil-less fixing device or even when an oil coating effect becomes unsatisfactory in the minimal oil-coated fixing device, the transfer of the toner to the belt can be suppressed. In order that the releasing agent is present in a dispersed state in the toner particle, preferably the releasing agent and the binder resin are not compatible with each other. The releasing agent can be finely dispersed in the toner particle, for example, by taking advantage of the shear force of kneading during the toner production. The dispersion state of the releasing agent can be determined by observing a thin film section of the toner particle under a TEM. The dispersion diameter of the releasing agent is not particularly limited but is preferably small. However, when the dispersion diameter is excessively small, the releasing agent may not be sufficiently oozed out during the fixation. Accordingly, when the releasing agent can be observed at a magnification of 10,000 times, it can be determined that the releasing agent is present in a dispersed state. When the releasing agent is so small that the releasing agent cannot be observed at a magnification of 10,000 times, the releasing agent may not be sufficiently oozed out during the fixation even when the releasing agent is finely dispersed in the toner particle.

Figure 7:
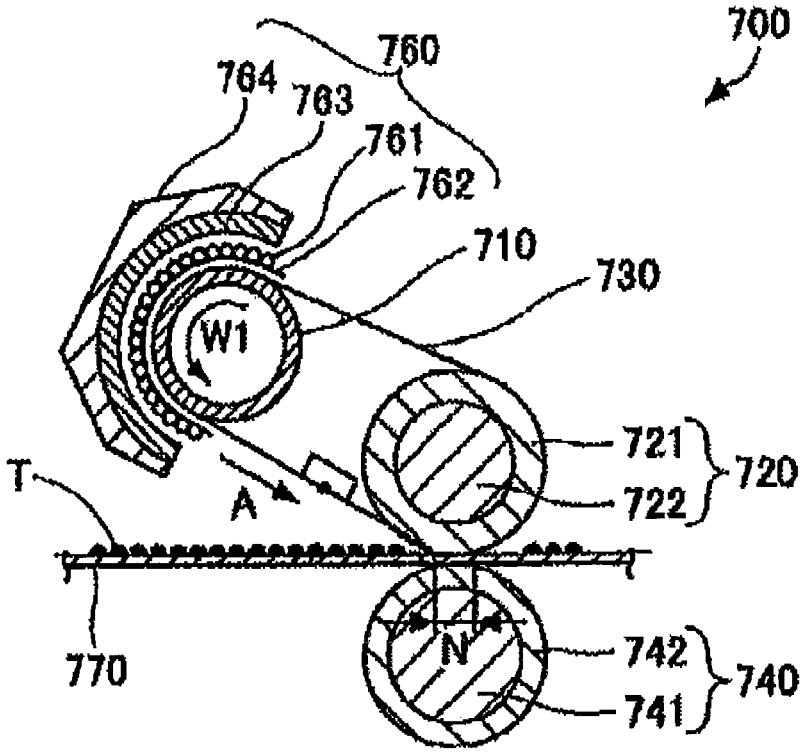
FIG. 7 is one exemplary schematic view of a fixing device.

The fixing device (fixing unit) used in the image forming method of the present invention may be a fixing device shown in FIG. 7. The fixing device 700 shown in FIG. 7 preferably includes a heating roller 710 which is heated by electromagnetic induction by means of an induction heating unit 760, a fixing roller 720 (facing rotator) disposed in parallel to the heating roller 710, an endless fixing belt (heat resistant belt, toner heating medium) 730, which is formed of an endless strip stretched between the heating roller 710 and the fixing roller 720 and which is heated by the heating roller 710 and rotated by means of rotation of any of these rollers in the direction indicated by an arrow A, and a pressure roller 740 (pressing rotator) which is pressed against the fixing roller 720 through the fixing belt 730 and which is rotated in forward direction with respect to the fixing belt 730.

The heating roller 710 is a hollow cylindrical magnetic metal member made of, for example, iron, cobalt, nickel or an alloy of these metals. The heating roller 710 is 20 mm to 40 mm in an outer diameter, and 0.3 mm to 1.0 mm in thickness, to be in construction of low heat capacity and a rapid rise of temperature.

The fixing roller 720 (facing rotator) is formed of a metal core 721 made of metal such as stainless steel, and an elastic member 722 made of a solid or foam-like silicone rubber having heat resistance to be coated on the metal core 721. Further, to form a contact section of a predetermined width between the pressure roller 740 and the fixing roller 720 by a compressive force provided by the pressure roller 740, the fixing roller 720 is constructed to have an outer diameter of about 20 mm to about 40 mm, and to be larger than the heating roller 710. The elastic member 722 is about 4 mm to about 6 mm in thickness. Owing to this construction, the heat capacity of the heating roller 710 is smaller than that of the fixing roller 720, so that the heating roller 710 is rapidly heated to make warm-up time period shorter.

The fixing belt 730 that is stretched between the heating roller 710 and the fixing roller 720 is heated at a contact section W1 with the heating roller 710 to be heated by the induction heating unit 760. Then, an inner surface of the fixing belt 730 is continuously heated by the rotation of the heating roller 710 and the fixing roller 720, and as a result, the whole belt will be heated.

Figure 8:
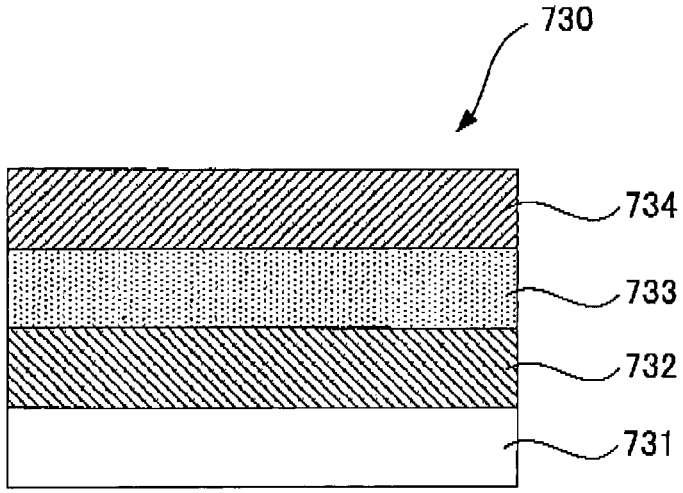
FIG. 8 is one exemplary layer structure of a fixing belt.

FIG. 8 shows a layer structure of the fixing belt 730. The fixing belt 730 consists of the following four layers in the order from an inner layer to a surface layer, a substrate 731, a heat generating layer 732, an intermediate layer 733, and a release layer 734.

The substrate 731 preferably a resin layer, for example, formed of a polyimide (PI) resin. The heat generating layer 732 is a conductive material layer, for example, formed of Ni, Ag, SUS. The intermediate layer 733 is an elastic layer for uniform fixation. The release layer 734 is a resin layer, for example, formed of a fluorine-containing resin material for obtaining releasing effect and making oilless.

The release layer 734 preferably has a thickness of about 10 μm to about 300 μm, particularly preferably about 200 μm. In this manner, in the fixing device 700 as shown in FIG. 7, since the surface layer of the fixing belt 730 sufficiently covers a toner image T formed on a recording medium 770, it becomes possible to uniformly heat and melt the toner image T. The release layer 734; i.e., a surface release layer needs to have a thickness of 10 μm at minimum in order to secure abrasion resistance over time. In addition, when the release layer 734 exceeds 300 μm in thickness, the heat capacity of the fixing belt 730 increases, resulting in a longer warm-up time period. Further, additionally, a surface temperature of the fixing belt 730 is unlikely to decrease in the toner-fixing step, a cohesion effect of melted toner at an outlet of the fixing portion cannot be obtained, and thus the so-called hot offset occurs in which a releasing property of the fixing belt 730 is lowered, and toner particles of the toner image T is attached onto the fixing belt 730. Moreover, as a substrate of the fixing belt 730, the heat generating layer 732 formed of a metal may be used, or the resin layer having heat resistance, such as a fluorine-containing resin, a polyimide resin, a polyamide resin, a polyamide-imide resin, a PEEK resin, a PES resin, and a PPS resin, may be used.

The pressure roller 740 is constructed of a cylindrical metal core 741 made of a metal having a high thermal conductivity, for example, copper or aluminum, and an elastic member 742 having a high heat resistance and toner releasing property that is located on the surface of the metal core 741. The metal core 741 may be made of SUS other than, the above-described metals. The pressure roller 740 presses the fixing roller 720 through the fixing belt 730 to form a nip portion N. According to this embodiment, the pressure roller 740 is arranged to engage into the fixing roller 720 (and the fixing belt 730) by causing the hardness of the pressure roller 740 to be higher than that of the fixing roller 720, whereby the recording medium 770 is in conformity with the circumferential shape of the pressure roller 740, thus to provide the effect that the recording medium 770 is likely to come off from the surface of the fixing belt 730. This pressure roller 740 has an external diameter of about 20 mm to, about 40 μm, which is the same as that of the fixing roller 720. However, the pressure roller 740 has a thickness of about 0.5 mm to about 2.0 mm, and is formed thinner than the fixing roller 720.

The induction heating unit 760 for heating the heating roller 710 by electromagnetic induction, as shown in FIG. 7, includes an exciting coil 761 serving as a field generation unit, and a coil guide plate 762 around which this exciting coil 761 is wound. The coil guide plate 762 has a semi-cylindrical shape that is located close to the perimeter surface of the heating roller 710. The exciting coil 761 is the one in which one long exciting coil wire is wound alternately in an axial direction of the heating roller 710 along this coil guide plate 762. Further, in the exciting coil 761, an oscillation circuit is connected to a driving power source (not shown) of variable frequencies. Outside of the exciting coil 761, an exciting coil core 763 of a semi-cylindrical shape that is made of a ferromagnetic material such as ferrites is fixed to an exciting coil core support 764 to be located in the proximity of the exciting coil 761.

<Cleaning Step and Cleaning Unit>

The cleaning step is a step of removing a residual toner remaining on the latent electrostatic image bearing member and is preferably carried out by a cleaning unit.

The cleaning unit is not particularly limited as long as it can remove the toner remaining and adhering onto the surface of the latent electrostatic image bearing member, and may be appropriately selected from known ones depending on the intended purpose. Examples thereof include a magnetic brush cleaner, an electrostatic brush cleaner, a magnetic roller cleaner, a cleaning blade, a brush cleaner, and a web cleaner. Among these, cleaning blades are particularly preferable in view of higher toner-removing ability, compact size, and lower cost.

Examples of rubber materials used for the cleaning rubber blade include urethane rubber, silicone rubber, fluorine rubber, chloroprene rubber, and butadiene rubber. Among these, urethane rubber is particularly preferable.

<Other Steps and Other Units>

The charge eliminating step is a step of charge eliminating by applying a charge eliminating bias to the latent electrostatic image bearing member by a charge eliminating unit.

The charge eliminating unit is not particularly limited as long as it can apply a charge eliminating bias to the latent electrostatic image bearing member, and may be appropriately selected from known charge eliminating devices. Examples thereof include charge eliminating lamps.

The recycling step is a step of recycling the toner removed by the cleaning step to the developing unit, and can be preferably carried out by a recycling unit. The recycling unit is not particularly limited and may be appropriately selected from known conveying units.

The controlling step is a step of controlling each of the above-mentioned steps and can be preferably carried out by a controlling unit.

The controlling unit is not particularly limited as long as being capable of controlling the operations of each of the units, and may be appropriately selected depending on the intended purpose. Examples thereof include equipments such as sequencers and computers.

Hereinafter, one embodiment of the image forming method of the present invention carried out by means of the image forming apparatus will be described with reference to Figures.

Figure 10:
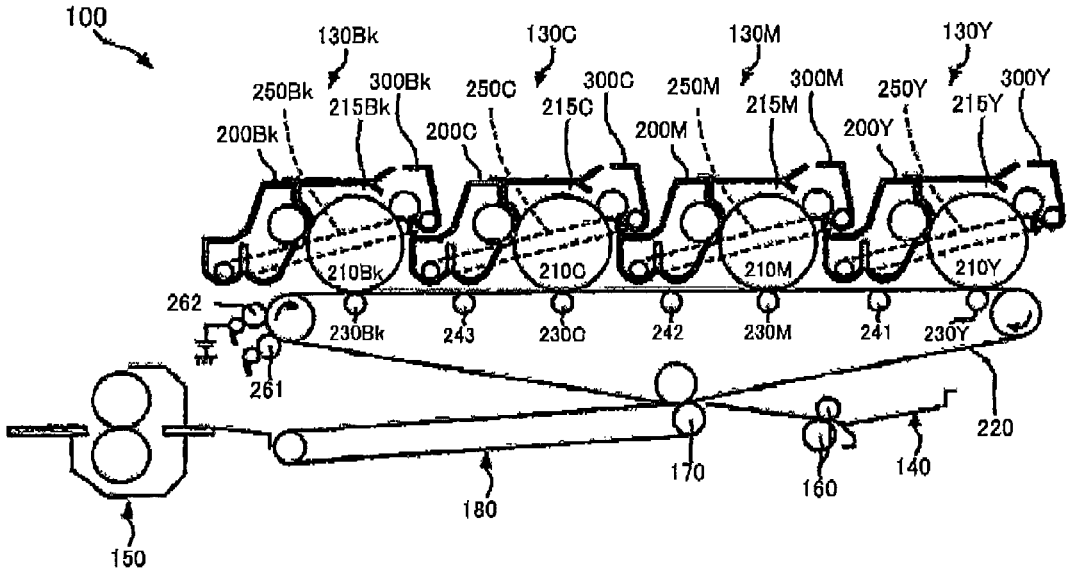
FIG. 10 is a schematic view of one exemplary image forming apparatus of the present invention.
Figure 11:
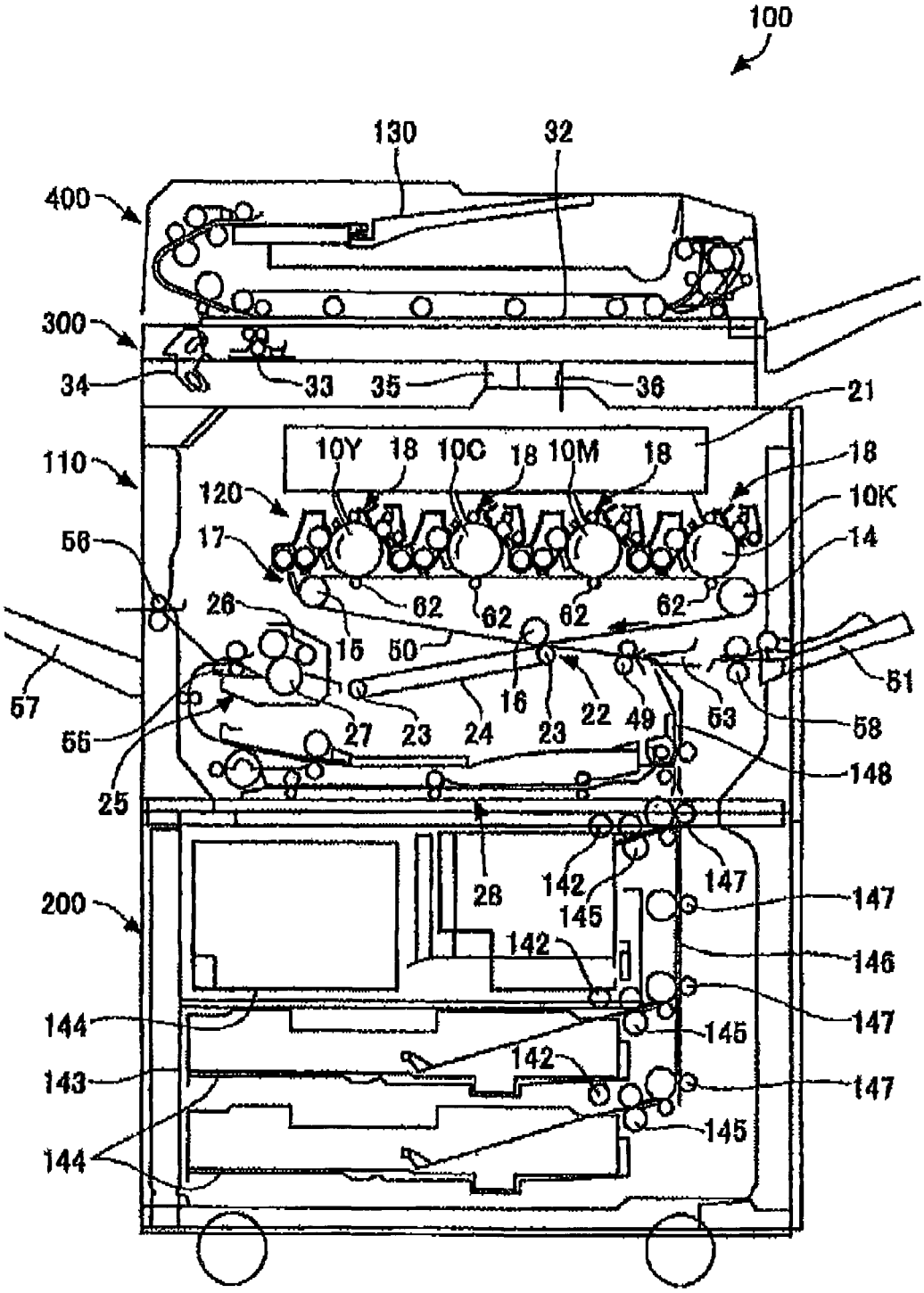
FIG. 11 is a schematic view of another exemplary image forming apparatus of the present invention.

For example, a tandem image forming apparatus 100 shown in FIGS. 10 and 11 may be used. In FIG. 10, the image forming apparatus 100 mainly includes image writing units (not shown) for color image formation by an electrophotographic method, image forming units 130Bk, 130C, 130M and 130Y, and a paper feeder 140. According to image signals, image processing is performed in an image processing unit (not shown) for conversion to respective color signals of black (Bk), cyan (C), magenta (M), and yellow (Y) for image formation, and the color signals are sent to the image wiring units. The image writing units are a laser scanning optical system that includes, for example, a laser beam source, a deflector such as a rotary polygon mirror, a scanning imaging optical system, and a group of mirrors (all not shown), has four writing optical paths corresponding to the color signals, and performs image writing according to the color signals in the image forming units 130Bk, 130C, 130M and 130Y.

The image forming units 130Bk, 130C, 130M and 130Y include photoconductors 210Bk, 210C, 210M and 210Y respectively for black, cyan, magenta, and yellow. An organic photoconductor (OPC) is generally used in the photoconductors 210Bk, 210C, 210M and 210Y for the respective colors. For example, charging devices 215Bk, 215C, 215M and 215Y, the image writing units (exposing units) for emitting laser beams therefrom, developing devices 200Bk, 200C, 200M and 200Y for respective colors, primary transfer-devices 230Bk, 230C, 230M and 230Y, cleaning devices 300Bk, 300C, 300M and 300Y, and charge-eliminating devices (not shown) are provided around the respective photoconductors 210Bk, 210C, 210M and 210Y. The developing devices 200Bk, 200C, 200M and 200Y use a two-component magnetic brush development system. Further, an intermediate transfer belt 220 is interposed between the photoconductors 210Bk, 210C, 210M and 210Y and the primary transfer devices 230Bk, 230C, 230M and 230Y. Color toner images are successively transferred from respective photoconductors onto the intermediate transfer belt 220 to form superimposed toner images thereon.

In some cases, a pre-transfer charger is preferably provided as a pre-transfer charging unit at a position that is outside the intermediate transfer belt 220 and after the passage of the final color through a primary transfer position and before a secondary transfer position. Before the toner images on the intermediate transfer belt 220, which have been transferred onto the photoconductors 210Bk, 210C, 210M and 210Y in the primary transfer unit, are transferred onto a transfer paper as a recording medium, the pre-transfer charger charges toner images evenly to the same polarity.

The toner images on the intermediate transfer belt 220 transferred from the photoconductors 210Bk, 210C, 210M and 210Y include a halftone portion and a solid image portion or a portion in which the level of superimposition of toners is different. Accordingly, in some cases, the charge amount varies from a toner image to a toner image. Further, due to separation discharge generated in spaces on an adjacent downstream side of the primary transfer unit in the direction of movement of the intermediate transfer belt, a variation in charge amount within toner images on the intermediate transfer belt 220 after the primary transfer sometimes occurs. The variation in charge amount within the same toner image disadvantageously decreases a transfer latitude in the secondary transfer unit that transfers the toner images on the intermediate transfer belt 220 onto the transfer paper. Accordingly, the toner images before transfer onto the transfer paper are evenly charged to the same polarity by the pre-transfer charger to eliminate the variation in charge amount within the same toner image and to improve the transfer latitude in the secondary transfer unit.

Thus, according to the image forming method wherein the toner images transferred from the photoconductors 210Bk, 210C, 210M and 210Y and located on the intermediate transfer belt 220 are evenly charged by the pre-transfer, charger, even when a variation in charge amount of the toner images located on the intermediate transfer belt 220 exists, the transfer properties in the secondary transfer unit can be rendered almost constant over each portion of the toner images located on the intermediate transfer belt 220. Accordingly, the decrease in the transfer latitude in the transfer of the toner images onto the transfer paper can be suppressed, and the toner images can be stably transferred.

In the image forming method, the amount of charge by the pre-transfer charger varies depending upon the moving speed of the intermediate transfer belt 220 as the charging object. For example, when the moving speed of the intermediate transfer belt 220 is slow, the period of time, for which the same part in the toner images on the intermediate transfer belt 220 passes through a section of charging by the pre-transfer charger, becomes longer. Therefore, in this case, the charge amount is increased. On the other hand, when the moving speed of the intermediate transfer belt 220 is high, the charge amount of the toner images on the intermediate transfer belt 220 is decreased. Accordingly, when the moving speed of the intermediate transfer belt 220 changes during the passage of the toner images on the intermediate transfer belt 220 through the position of charging by the pre-transfer charger, preferably, the pre-transfer charger is regulated according to the moving speed of the intermediate transfer belt 220 so that the charge amount of the toner images does not change during the passage of the toner images on the intermediate transfer belt 220 through the position of charging by the pre-transfer charger.

Conductive rollers 241, 242 and 243 are provided between the primary transfer devices 230Bk, 230C, 230M and 230Y. The transfer paper is fed from a paper feeder 140 and then is supported on a transfer belt 180 through a pair of registration rollers 160. At a portion where the intermediate transfer belt 220 comes into contact with the transfer belt 180, the toner images on the intermediate transfer belt 220 are transferred by a secondary transfer roller 170 onto the transfer paper to perform color image formation.

The transfer paper after image formation is transferred by a secondary transfer belt 180 to a fixing device 150 where the color image is fixed to provide a fixed color image. The toner remaining after transfer on the intermediate transfer belt 220 is removed form the belt by an intermediate transfer belt cleaning device.

The polarity of the toner on the intermediate transfer belt 220 before transfer onto the transfer paper has the same negative polarity as the polarity in the development. Accordingly, a positive transfer bias voltage is applied to a secondary transfer roller 170, and the toner is transferred onto the transfer paper. The nip pressure in this portion affects the transferability and significantly affects the fixing ability. The toner remaining after transfer and located on the intermediate transfer belt 220 is subjected to discharge electrification to positive polarity side; i.e., 0 to positive polarity, in a moment of the separation of the transfer paper from the intermediate transfer belt 220. Toner images formed on the transfer paper in jam or toner images in a non-image section of the transfer paper are not influenced by the secondary transfer and thus, maintain negative polarity.

The thickness of the photoconductor layer, the beam spot diameter of the optical system, and the quantity of light are 30 μm, 50 μm×60 μm, and 0.47 mW, respectively. The developing step is performed under such conditions that the charge (exposure side) potential V0 of the photoconductor (black) 210Bk is −700 V, potential VL after exposure is −120 V, and the development bias voltage is −470 V, that is, the development potential is 350 V The visible image of the toner (black) formed on the photoconductor (black) 210Bk is then subjected to transfer (intermediate transfer belt and transfer paper) and the fixing step and consequently is completed as an image. Regarding the transfer, all the colors are first transferred from the primary transfer devices 230Bk, 230C, 230M and 230Y to the intermediate transfer belt 220 followed by transfer to the transfer paper by applying bias to a separate secondary transfer roller 170.

Next, the photoconductor cleaning device will be described in detail. In FIG. 10, the developing devices 200Bk, 200C, 200M and 200Y are connected to respective cleaning devices 300Bk, 300C, 300M and 200Y through toner transfer tubes 250Bk, 250C, 250M and 250Y (dashed lines in FIG. 10). A screw (not shown) is provided within the toner transfer tubes 250Bk, 250C, 250M and 250Y, and the toners recovered in the cleaning devices 300Bk, 300C, 300M and 300Y are transferred to the respective developing devices 200Bk, 200C, 200M and 200Y.

A direct transfer system including a combination of four photoconductor drums with belt transfer has the following drawback. Specifically, upon abutting of the photoconductor against the transfer paper, paper dust adheres onto the photoconductor. Therefore, the toner recovered from the photoconductor contains paper dust and thus cannot be used, because in the image formation, an image deterioration such as toner dropouts occurs. Further, in a system including a combination of one photoconductor drum with intermediate transfer, the adoption of the intermediate transfer has eliminated a problem of the adherence of paper dust onto the photoconductor upon transfer of an image onto the transfer paper. In this system, however, when recycling of the residual toner on the photoconductor is contemplated, the separation of the mixed color toners is practically impossible. The use of the mixed color toners as a black toner has been proposed. However, even when all the colors are mixed, a black color is not produced. Further, colors vary depending upon printing modes. Accordingly, in the one-photoconductor structure, recycling of the toner is impossible.

By contrast, in the full-color image forming apparatus, since the intermediate transfer belt 220 is used, the contamination with paper dust is not significant. Further, the adherence of paper dust onto the intermediate transfer belt 220 during the transfer onto the paper can also be prevented. Since each of the photoconductors 210Bk, 210C, 210M and 210Y uses independent respective color toners, there is no need to perform contacting and separating of the photoconductor cleaning devices 300Bk, 300C, 300M and 300Y. Accordingly, only the toner can be reliably recovered.

The positively charged toner remaining after transfer on the intermediate transfer belt 220 is removed by cleaning with a conductive fur brush 262 to which a negative voltage has been applied. A voltage can be applied to the conductive fur brush 262 in the same manner as in the application of the voltage to a conductive fur brush 261, except that the polarity is different. The toner remaining after transfer can be almost completely removed by cleaning with the two conductive fur brushes 261 and 262. The toner, paper dust, talc and the like, remaining unremoved by cleaning with the conductive fur brush 262 are negatively charged by a negative voltage of the conductive fur brush 262. The subsequent primary transfer of black is transfer by a positive voltage. Accordingly, the negatively charged toner and the like are attracted toward the intermediate transfer belt 220, and thus, the transfer to the photoconductor (black) 210Bk side can be prevented.

FIG. 11 shows another example of the image forming apparatus 100 used in the forming method of the present invention and is a copier quipped with an electrophotographic image forming apparatus of a tandem indirect transfer system. In FIG. 11, the copier includes a copier main body 110, a paper feed table 200 for mounting the copier main body 110, a scanner 300, which is arranged over the copier main body 110, and an automatic document feeder (ADF) 400, which is arranged over the scanner 300. The copier main body 110 has an endless belt intermediate transfer medium 50 in the center.

The intermediate transfer medium is stretched around support rollers 14, 15, and 16 and rotates clockwise as shown in FIG. 11. An intermediate transfer medium cleaning device 17 for removing residual toner on the intermediate transfer medium 50 after image transfer is provided near the second support roller 15 of the three support rollers. A tandem image forming device 120 has four image forming units 18 for yellow, cyan, magenta, and black, which face the intermediate transfer medium 50 stretched around the first support roller 14 and the second support roller 15, and are arranged side by side along the rotation direction thereof.

An exposing device 21 is provided over the tandem image forming device 120 as shown in FIG. 11. A secondary transfer device 22 is provided across the intermediate transfer medium 50 from the tandem image forming unit 120. The secondary transfer unit 22 has an endless secondary transfer belt 24 stretched around a pair of rollers 23, and is arranged so as to press against the third support roller 16 via the intermediate transfer medium 50, thereby transferring an image carried on the intermediate transfer medium 50 onto a sheet. A fixing device 25 configured to fix the transferred image on the sheet is provided near the secondary transfer device 22. The fixing device 25 has an endless fixing belt 26 and a pressure roller 27 pressed against the fixing belt 26. The secondary transfer device 22 includes a sheet conveyance function in which the sheet on which the image has been transferred is conveyed to the fixing device 25. As the secondary transfer device 22, a transfer roller or a non-contact charge may be provided, however, these are difficult to provide in conjunction with the sheet conveyance function. A sheet reversing device 28 for turning over a transferred sheet to form images on both sides of a sheet is provided parallel to the tandem image forming device 120 and under the secondary transfer device 22 and fixing device 25.

At first, a document is placed on a document table 130 of the automatic document feeder 400, when a copy is made using the color electrophotographic image forming apparatus. Alternatively, the automatic document feeder 400 is opened, the document is placed onto a contact glass 32 of the scanner 300, and the automatic document feeder 400 is closed.

When an unillustrated start switch is pressed, a document placed on the automatic document feeder 400 is conveyed onto the contact glass 32. When the document is initially placed on the contact glass 32, the scanner 300 is immediately driven to operate a first carriage 33 and a second carriage. 34. At the first carriage 33, light is applied from a light source to the document, and reflected light from the document is further reflected toward the second carriage 34. The reflected light is further reflected by a mirror of the second carriage 34 and passes through image-forming lens 35 into a read sensor 36 to thereby read the document.

When the start switch is pressed, one of the support rollers 14, 15 and 16 is rotated by an unillustrated drive motor, and as a result, the other two support rollers are rotated by the rotation of the driven support roller. In this way, the intermediate transfer medium 50 runs around the support rollers 14, 15 and 16. Simultaneously, the individual image forming units 18 respectively rotate their photoconductors 10K, 10M, 10C and 10Y to thereby form black, magenta, cyan, and yellow monochrome images on the photoconductors 10K, 10M, 10C and 10Y, respectively. With the conveyance of the intermediate transfer medium 50, the monochrome images are sequentially transferred to form a composite color image on the intermediate transfer medium 50.

Separately, when the start switch (not shown) is pressed, one of feeder rollers 142 of the paper feed table 200 is selectively rotated, sheets are ejected from one of multiple feeder cassettes 144 in a paper bank 143 and are separated in a separation roller 146 one by one into a feeder path 146, are transported by a transport roller 147 into a feeder path 148 in the main body of the image forming apparatus 100 and are bumped against registration rollers 49.

Alternatively, pressing the start switch rotates a paper feeding roller to eject sheets on a manual bypass tray 51, and the sheets are separated one by one on a separation roller 58 into a manual bypass feeder path 53 and are bumped against the registration rollers 49.

The registration rollers 49 are rotated synchronously with the movement of the composite color image on the intermediate transfer medium 50 to transport the sheet into between the intermediate transfer medium 50 and the secondary transfer device 22, and the composite color image is transferred onto the sheet by action of the secondary transfer device 22 to thereby form a color image.

The sheet on which the image has been transferred is conveyed by the secondary transfer device 22 into the fixing device 25, and then heat and pressure is applied to the sheet in the fixing device 25 to fix the transferred image. The sheet is changed its direction by action of a switch claw 55, and is ejected by an ejecting roller 56 to be stacked on an output tray 57. Alternatively, the moving direction of the paper is changed by the switching claw 55, and the paper is conveyed to the sheet reversing device 28 where it is reversed, and guided again to the transfer position in order that an image is formed also on the back surface thereof, then the paper is ejected by the ejecting roller 56 and stacked on the output tray 57.

On the other hand, in the intermediate transfer medium 50 after the image transfer, the toner, which remains on the intermediate transfer medium 50 after the image transfer, is removed by the intermediate transfer medium cleaning device 17, and the intermediate transfer medium 50 again gets ready for image formation by the tandem image forming device 120. The registration rollers 49 are generally used in a grounded state. Bias may also be applied to the registration rollers 49 to remove paper dust of the paper sheet.

(Process Cartridge)

The process cartridge of the present invention includes at least a latent electrostatic image bearing member that bears a latent electrostatic image on the surface thereof and a developing unit configured to develop the latent electrostatic image borne on the surface of the latent electrostatic image bearing member using a toner to form a visible image and further includes appropriately selected other units in accordance with the necessity such as a charging unit, an exposing unit, a transfer unit, a cleaning unit and a charge eliminating unit.

The toner of the present invention is used as the toner.

The developing unit includes at least a developer container to house the toner and/or the developer and a developer bearing member to bear and convey the toner and/or the developer which is housed in the developer container and may further include a layer thickness controlling member for controlling the thickness of a toner layer to be carried by the developer bearing member. Specifically, any of the one-component developing unit and the two-component developer unit, which have been described hereinbefore in the sections of the image forming apparatus and image forming method, can be preferably used.

The charging unit, exposing unit, transfer unit, cleaning unit, and charge eliminating unit may be appropriately selected from those similar to ones mentioned above for the image forming apparatus.

The process cartridge is detachably provided in various types of electrophotographic image forming apparatuses, facsimiles, and printers, and particularly preferably be detachably mounted to the image forming apparatus of the present invention.

Figure 9:
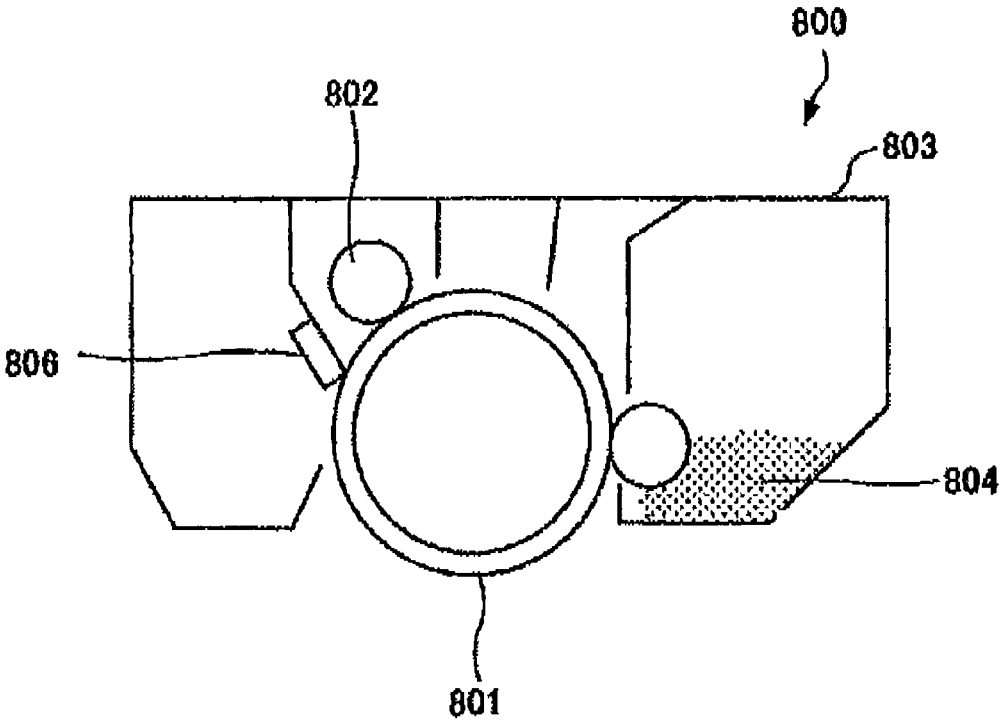
FIG. 9 is a schematic view of one exemplary process cartridge of the present invention.

An example of the process cartridge is shown in FIG. 9. A process cartridge 800 shown in FIG. 9 includes a photoconductor 801, a charging unit 802, a developing unit 803, and a cleaning unit 806. In the operation of this process cartridge 800, the photoconductor 801 is rotated at a specific peripheral speed. In the course of rotating, the photoconductor 801 receives from the charging unit 802 a uniform, positive or negative electrical charge of a specific potential around its periphery, and then receives image exposure light from an image exposing unit (not shown), such as slit exposure or laser beam scanning exposure, and in this way a latent electrostatic image is formed on the periphery of the photoconductor 801. The latent electrostatic image thus formed is then developed by a developing unit 803, and the developed toner image is transferred by a transfer unit (not shown) onto a recording medium that is fed from a paper supplier to in between the photoconductor 801 and the transfer unit, in synchronization with the rotation of the photoconductor 801. The recording medium on which the image has been transferred is separated from the surface of the photoconductor 801, introduced into an unillustrated image fixing unit so as to fix the image thereon, and this product is printed out from the device as a copy or a print. The surface of the photoconductor 801 after the image transfer is cleaned by the cleaning unit 806 so as to remove the residual toner after the transfer, and is electrically neutralized and repeatedly used for image formation.

EXAMPLES

Hereinafter, Examples of the present invention will be described in detail, however, these Examples shall not be construed as limiting the scope of the present invention. Note that, "part(s)" described in the following means "part(s) by mass".

Synthesis Example 1

Synthesis of Crystalline Polyester Resin 1

In a 5 L four-neck flask equipped with a nitrogen inlet tube, a dehydration tube, a stirrer and a thermocouple, 2,300 g of 1,10-decanediol, 2,530 g of 1,8-octanediol, and 4.9 g of hydroquinone were charged, and reacted at 180° C. for 10 hours, and was further reacted at 200° C. for 3 hours. Furthermore, the reaction product was reacted at 8.3 kPa for 2 hours, to thereby synthesize Crystalline Polyester Resin 1.

The resultant Crystalline Polyester Resin 1 had an endothermic peak temperature by DSC of 70° C., a number average molecular weight (Mn) of 3,000, a weight average molecular weight (Mw) of 10,000, and Mw/Mn of 3.3.

<Endothermic Peak Temperature by DSC>

An endotherm peak temperature of the crystalline polyester resin was measured using a differential scanning calorimeter (DSC) system ("DSC-60", manufactured by Shimadzu Corporation).

First, about 5.0 mg of a polyester resin was placed in a sample container made of aluminum; the sample container was placed on a holder unit; and the holder unit was set in an electric furnace. Using a differential scanning calorimeter ("DSC-60", manufactured by Shimadzu Corporation), a DSC curve of the sample was obtained by heating the sample at 20° C. to 150° C. in a nitrogen atmosphere at a temperature increasing rate of 10° C./min. Using the thus-obtained DSC curve and an analysis program of a DSC-60 system, a peak analysis of the DSC curve upon temperature increase was selected, and then an endotherm peak temperature by DSC was calculated.

<Number Average Molecular Weight (Mn) and Weight Average Molecular Weight (Mw)>

A number average molecular weight (Mn) and weight average molecular weight (Mw) of the crystalline polyester resin were measured by gel permeation chromatography (GPC) under the following conditions:

Instrument: GPC-150C (manufactured by Waters CORPORATION)

Columns: Shodex KF801 to KF807 (manufactured by SHOWA DENKO K.K.)

Temperature: 40° C.

Solvent: tetrahydrofuran (THF)

Flow rate: 1.0 mL/min

Sample: 0.1 mL of a sample having a concentration of 0.05% by mass to 0.6% by mass From a molecular weight distribution of the crystalline polyester resin measured under the above conditions, a molecular weight calibration curve was constructed according to a monodisperse polystyrene standard sample. By using the molecular weight calibration curve, the number average molecular weight (Mn) and weight average molecular weight (Mw) of the crystalline polyester resin were calculated.

Synthesis Example 2

Synthesis of Crystalline Polyester Resin 2

In a 5 L four-neck flask equipped with a nitrogen inlet tube, a dehydration tube, a stirrer and a thermocouple, 2,800 g of 1,10-decanediol, 2,200 g of 1,8-octanediol, and 4.3 g of hydroquinone were charged, and reacted at 180° C. for 10 hours, and was further reacted at 200° C. for 3 hours. Furthermore, the reaction product was reacted at 8.3 kPa for 2 hours, to thereby synthesize Crystalline Polyester Resin 2.

The resultant Crystalline Polyester Resin 2 had an endothermic peak temperature by DSC of 63° C., a number average molecular weight (Mn) of 2,500, a weight average molecular weight (Mw) of 8,500, and Mw/Mn of 3.4, as measured in the same manner as in Synthesis Example 1.

Synthesis Example 3

Synthesis of Crystalline Polyester Resin 3

In a 5 L four-neck flask equipped with a nitrogen inlet tube, a dehydration tube, a stirrer and a thermocouple, 2,450 g of 1,10-decanediol, 2,400 g of 1,8-octanediol, and 2.5 g of hydroquinone were charged, and reacted at 170° C. for 15 hours, and was further reacted at 200° C. for 4 hours. Furthermore, the reaction product was reacted at 9.0 kPa for 3 hours, to thereby synthesize Crystalline Polyester Resin 3.

The resultant Crystalline Polyester Resin 3 had an endothermic peak temperature by DSC of 70° C., a number average molecular weight (Mn) of 4,000, a weight average molecular weight (Mw) of 22,000, and Mw/Mn of 5.5, as measured in the same manner as in Synthesis Example 1.

Synthesis Example 4

Synthesis of Crystalline Polyester Resin 4

In a 5 L four-neck flask equipped with a nitrogen inlet tube, a dehydration tube, a stirrer and a thermocouple, 3,050 g of 1,10-decanediol, 1,900 g of 1,8-octanediol, and 1.6 g of hydroquinone were charged, and reacted at 180° C. for 10 hours, and was further reacted at 200° C. for 3 hours. Furthermore, the reaction product was reacted at 8.3 kPa for 2 hours, to thereby synthesize Crystalline Polyester Resin 4.

The resultant Crystalline Polyester Resin 4 had an endothermic peak temperature by DSC of 86° C., a number average molecular weight (Mn) of 2,600, a weight average molecular weight (Mw) of 13,000, and Mw/Mn of 5.2, as measured in the same manner as in Synthesis Example 1.

Next, the details of the synthesized Crystalline Polyester Resins 1 to 4 are shown in Table 1.

TABLE 1

| | Synthesis Example 1 Crystalline Polyester Resin 1 | Synthesis Example 2 Crystalline Polyester Resin 2 | Synthesis Example 3 Crystalline Polyester Resin 3 | Synthesis Example 4 Crystalline Polyester Resin 4 |
|---|---|---|---|---|
| 1,10-decanediol | 2,300 g | 2,800 g | 2,450 g | 3,050 g |
| 1,8-octanediol | 2,530 g | 2,200 g | 2,400 g | 1,900 g |
| hydroquinone | 4.9 g | 4.3 g | 2.5 g | 1.5 g |
| endothermic peak temperature by DSC (° C.) | 70 | 63 | 70 | 85 |
| weight average molecular weight (Mw) | 10,000 | 8,500 | 22,000 | 13,000 |
| number average molecular weight (Mn) | 3,000 | 2,500 | 4,000 | 2,500 |
| Mw/Mn | 3.3 | 3.4 | 5.5 | 5.2 |

Preparation Example 1

Synthesis of Unmodified Polyester Resin

Low-Molecular-Weight Polyester Resin

Into a reaction vessel equipped with a condenser, a stirrer and a nitrogen inlet tube, 67 parts of an ethylene oxide (2 mol) adduct of bisphenol A, 84 parts of a propylene oxide (3 mol) adduct of bisphenol A, 274 parts of terephthalic acid, and 2 parts of dibutyltin oxide were charged, and reacted under normal pressure at 230° C. for 8 hours. Next, the reaction liquid was reacted under reduced pressure of 10 mmHg to 15 mmHg for 5 hours to thereby obtain an unmodified polyester resin.

The resultant unmodified polyester resin had a number average molecular weight (Mn) of 2,100, a weight average molecular weight (Mw) of 5,600, and a glass transition temperature (Tg) of 55° C.

—Preparation of Dispersion Liquid 1 of Crystalline Polyester Resin—

In a 2 L-metallic vessel, 100 parts of Crystalline Polyester Resin 1 is of Synthesis Example 1 and 400 parts of ethyl acetate were charged, and dissolved by heating at 75° C., followed by rapidly cooling at 27° C./min in an ice-water bath, to thereby obtain a recrystallized dispersion having a particle size of approximately several hundred micrometers.

Into a beaker, 500 parts of the resultant recrystallized dispersion of the crystalline polyester resin, 100 parts of the unmodified polyester resin, and 200 parts of ethyl acetate were charged, and the mixture was dispersed using a bead mill, ULTRA VISCOMILL (manufactured by Aimex Co., Ltd.) under the following conditions: liquid feed rate: 1 kg/hr, disc circumferential speed: 6 m/sec, 0.5 mm-zirconia bead filled at 80% by volume, and 3 passes, to thereby prepare Dispersion Liquid 1 of Crystalline Polyester Resin.

An average particle diameter (dispersion diameter) of the crystalline polyester resin in the resultant Dispersion Liquid 1 of Crystalline Polyester Resin was 85 nm as measured by the method described below. Particles of the resultant crystalline polyester resin were observed with a scanning electron microscope (SEM), and found that each had a needle shape.

<Measurement of Average Particle Diameter (Dispersion Diameter)>

Into a cell, the dispersion liquid diluted with ethyl acetate to an appropriate optical transmission density was charged, and the cell was set in a particle size distribution measuring device LA-920 (manufactured by HORIBA, Ltd.), to thereby measure a weight average particle diameter (nm) of the crystalline polyester resin.

Preparation Example 2

Preparation of Dispersion Liquid 2 of Crystalline Polyester Resin

Dispersion Liquid 2 of Crystalline Polyester Resin was prepared in the same manner as in Preparation Example 1, except that Crystalline Polyester Resin 1 of Synthesis Example 1 was replaced with Crystalline Polyester Resin 2 of Synthesis Example 2.

An average particle diameter (dispersion diameter) of the crystalline polyester resin in the resultant Dispersion Liquid 2 of Crystalline Polyester Resin was 73 nm as measured in the same manner as in Preparation Example 1. Particles of the resultant crystalline polyester resin had needle shapes, as observed in the same manner as in Preparation Example 1.

Preparation Example 3

Preparation of Dispersion Liquid 3 of Crystalline Polyester Resin

Dispersion Liquid 3 of Crystalline Polyester Resin, was prepared in the same manner as in Preparation. Example 1, except that Crystalline Polyester Resin 1 of Synthesis Example 1 was replaced with Crystalline Polyester Resin 3 of Synthesis Example 3.

An average particle diameter (dispersion diameter) of the crystalline polyester resin in the resultant Dispersion Liquid 3 of Crystalline Polyester Resin was 82 nm as measured in the same manner as in Preparation Example 1. Particles of the resultant crystalline polyester resin had needle shapes, as observed in the same manner as in Preparation Example 1.

Preparation Example 4

Preparation of Dispersion Liquid 4 of Crystalline Polyester Resin

Dispersion Liquid 4 of Crystalline Polyester Resin was prepared in the same manner as in Preparation Example 1, except that Crystalline Polyester Resin 1 of Synthesis Example 1 was replaced with Crystalline Polyester Resin 4 of Synthesis Example 4.

An average particle diameter (dispersion diameter) of the crystalline polyester resin in the resultant Dispersion Liquid 4 of Crystalline Polyester Resin was 93 nm as measured in the same manner as in Preparation Example 1. Particles of the resultant crystalline polyester resin had needle shapes, as observed in the same manner as in Preparation Example 1.

Preparation Example 5

Preparation of Dispersion Liquid 5 of Crystalline Polyester Resin

In a 4 L four-neck glass flask, 100 parts of 1,6-hexanediol, 75 parts of fumaric acid, 30 parts of adipic acid, 0.1 parts of dibutyl tin oxide, and 0.05 parts of hydroquinone were charged, and reacted at 160° C. for 5 hours in a nitrogen atmosphere, and was further reacted at 200° C. for 1 hour. Furthermore, the reaction product was reacted at 8 kPa, and then cooled down, to thereby obtain a resin. To 100 parts of the resin, 400 parts of toluene was added and mixed, and then heated at 80° C., to thereby dissolve the resin. To the cooled resin solution, 3 parts of triethylamine was added.

Next, 360 parts of ethyl acetate and 40 parts of 48.5% aqueous solution of sodium dodecyldiphenyl ether disulfonate "ELEMINOL MON-7" (manufactured by Sanyo Chemical Industries Ltd.) were mixed, and the above-described resin solution was added to the mixture, and mixed and stirred to obtain an opaque white liquid. The toluene was removed under reduced pressure, to thereby obtain Dispersion Liquid 5 of Crystalline Polyester Resin.

An average particle diameter (dispersion diameter) of the crystalline polyester resin in the resultant Dispersion Liquid 5 of Crystalline Polyester Resin was 90 nm as measured in the same manner as in Preparation Example 1. Particles of the resultant crystalline polyester resin had substantially spherical shapes, as observed in the same manner as in Preparation Example 1.

Example 1

Preparation of Solution or Dispersion Liquid of Toner Material

—Synthesis of Unmodified Polyester Resin (Low-Molecular-Weight Polyester Resin)—

Into a reaction vessel equipped with a condenser, a stirrer and a nitrogen inlet tube, 67 parts of an ethylene oxide (2 mol) adduct of bisphenol A, 84 parts of a propylene oxide (3 mol) adduct of bisphenol A, 274 parts of terephthalic acid, and 2 parts of dibutyltin oxide were charged, and reacted under normal pressure at 230° C. for 8 hours. Next, the reaction liquid was reacted under reduced pressure of 10 mmHg to 15 mmHg for 5 hours to thereby obtain an unmodified polyester resin.

The resultant unmodified polyester resin had a number average is molecular weight (Mn) of 2,100, a weight average molecular weight (Mw) of 5,600, and a glass transition temperature (Tg) of 55° C.

—Preparation of Masterbatch—

Water (1,000 parts), 540 parts of carbon black ("Printex 35" manufactured by Degussa, DBP oil absorption amount: 42 mL/100 g, pH 9.5), and 1,200 parts of the unmodified polyester resin were mixed using HENSCHEL MIXER (manufactured by NIPPON COKE & ENGINEERING CO., LTD.), to obtain a mixture. The resultant mixture was kneaded at 150° C. for 30 minutes with a two-roller mill, and thereafter rolled and cooled, and pulverized with a pulverizer (manufactured by Hosokawa Micron Corporation), to thereby prepare a masterbatch.

—Synthesis of Prepolymer—

Into a reaction vessel equipped with a condenser, a stirrer, and a nitrogen-introducing tube, 682 parts of an ethylene oxide (2 mol) adduct of bisphenol A, 81 parts of a propylene oxide (2 mol) adduct of bisphenol A, 283 parts of terephthalic acid, 22 parts of trimellitic anhydride, and 2 parts of dibutyltin oxide were charged, allowing the resultant mixture to react for 8 hours at 230° C. under normal pressure. Subsequently, the reaction mixture was allowed to react for 5 hours under reduced pressure of 10 mmHg to 15 mmHg, to thereby synthesize an intermediate polyester. The thus-obtained intermediate polyester had a number average molecular weight (Mn) of 2,100, a weight average molecular weight (Mw) of 9,600, a glass transition temperature (Tg) of 55° C., an acid value of 0.5 mgKOH/g, and a hydroxyl group value of 49 mgKOH/g.

Subsequently, into a reaction vessel equipped with a condenser, a stirrer, and a nitrogen-introducing tube, 411 parts of the intermediate polyester, 89 parts of isophorone diisocyanate, and 500 parts of ethyl acetate were charged, allowing the resultant mixture to react for 5 hours at 100° C. to thereby synthesize a prepolymer, i.e., a polymer reactive with an active hydrogen group-containing compound.

The prepolymer thus obtained had a free isocyanate content of 1.60% by mass and solid content concentration of 50% by mass (150° C., after being left for 45 minutes).

—Preparation of Fine Resin Particles—

Into a reaction vessel equipped with a stirring rod and a thermometer, 682 parts of water, 16 parts of sodium salt of sulfuric acid ester of ethylene oxide adduct of methacrylic acid, ELEMINOL RS-30 (manufactured by Sanyo Chemical Industries Ltd.), 83 parts of styrene, 83 parts of methacrylic acid, 110 parts by mass of butyl acrylate, and 1 part by mass of ammonium persulfate were charged, and then stirred at 400 rpm for 15 minutes to thereby obtain a white emulsion. The emulsion was heated to a system temperature of 75° C. and was allowed to react for 5 hours. Then, 30 parts by mass of a 1% by mass aqueous ammonium persulfate solution was added to the reaction mixture, followed by aging at 75° C. for 5 hours, to thereby obtain an aqueous dispersion liquid of a vinyl resin (a copolymer of styrene-methacrylic acid-butyl acrylate-sodium salt of sulfate ester of methacrylic acid-ethylene oxide adduct), i.e. fine resin particle dispersion liquid.

The volume average particle diameter of the fine resin particle dispersion liquid was found to be 42 nm as measured using a particle size distribution measuring device LA-920 (manufactured by Horiba, Ltd.).

—Preparation of Solution or Dispersion Liquid of Toner Material—

Into a beaker, 85 parts of the unmodified polyester resin and 65 parts of ethyl acetate were charged, followed by stirring so as to dissolve the unmodified polyester resin in the ethyl acetate. Then, 10 parts of carnauba wax (molecular weight: 1,800, acid value: 2.5 mgKOH/g, penetration: 1.5 mm (40° C.)), 10 parts of the masterbatch, and as shown in Table 3, 80 parts of Dispersion Liquid 1 of Crystalline Polyester Resin, and 0 parts of isophoronediamine were charged into the beaker. The mixture was treated with a bead mill ("ULTRA VISCOMILL," manufactured by AIMEX CO., Ltd.) under the following conditions: a liquid feed rate of 1 kg/r, disc circumferential velocity of 6 m/s, 0.5 mm zirconia beads packed to 80% by volume, and 3 passes, to thereby prepare a starting material solution. Further, 50 parts by mass of the prepolymer solution was added thereto, followed by stirring, to thereby prepare a solution or dispersion liquid of a toner material.

—Preparation of Aqueous Medium—

Water (660 parts), 1.25 parts of the fine resin particle dispersion liquid, 25 parts of 48.5% by mass aqueous solution of sodium dodecyldiphenyl ether disulfonate "ELEMINOL MON-7" (manufactured by Sanyo Chemical Industries Ltd.) and 60 parts by mass of ethyl acetate were mixed and stirred to obtain an opaque white liquid (aqueous phase).

—Preparation of Emulsion or Dispersion Liquid—

The aqueous medium phase (150 parts) was placed in a vessel, and then stirred at 8,000 rpm with a TK homomixer (manufactured by Tokushu Kika Kogyo Co., Ltd.). Subsequently, 100 parts of the solution or dispersion liquid of the toner material was added to the thus-treated aqueous, medium phase, and the resultant mixture was mixed for 10 min to thereby prepare emulsion or dispersion liquid (emulsified slurry). A small amount of the emulsified slurry obtained by mixing for 10 min was sampled, and immediately diluted with excessive amount of ion-exchanged water, followed by measuring a weight average particle diameter Dw1 (Dw just before completion of the emulsification).

—Removal of Organic Solvent—

A flask equipped with a degassing tube, a stirrer, and a thermometer was charged with 100 parts of the emulsified slurry. The solvent was removed by stirring the emulsified slurry at a circumferential velocity of 20 m/min at 30° C. for 12 hours under reduced pressure to obtain a desolvated slurry. A small amount of the resultant slurry was sampled, and immediately diluted with excessive amount of ion-exchanged water, followed by measuring a weight average particle diameter Dw2 (Dw after toner formation), —Washing and Drying—

The whole amount of the desolvated slurry was filtrated under reduced pressure. Then, 300 parts of ion-exchanged water was added to the filter cake, followed by mixing and redispersing with a TK homomixer at a rotation speed of 12,000 rpm for 10 min, and filtrating. Further, 300 parts of ion-exchanged water was added to the filter cake, followed by mixing with a TK homomixer at a rotation speed of 3,000 rpm for 10 min and filtrating. This procedure was performed three times. The thus obtained filter cake was dried with a circular wind dryer at 45° C. for 48 hr. The dried product was sieved through a sieve with 75 μm-mesh opening, to thereby obtain toner base particles.

—External Addition Treatment—

The toner base particles (100 parts) were mixed with 0.6 parts of hydrophobic silica having an average particle diameter of 100 nm, 1.0 part of titanium oxide having an average particle diameter of 20 nm, and 0.8 parts of a fine powder of hydrophobic silica having an average particle diameter of 15 nm using a HENSCHEL MIXER to produce a toner of Example 1.

Examples 2 to 6 and Comparative Examples 1 to 5

Each of toners of Examples 2 to 6 and Comparative Examples 1 to 5 was produced in the same manner as in Example 1, except that the production conditions were changed to Dispersion Liquids 2 to 5 of Crystalline Polyester Resins, the amount of isophoronediamine, and emulsification rate, as shown in Table 3.

The physicals properties of the produced toners of Examples 1 to 6 and Comparative Examples 1 to 5 were measured as described below. The results are shown in Tables 3 and 4.

<Measurement of Weight Average Particle Diameter (Dw, Dw1, Dw2), Volume Average Particle Diameter (Dv), Number Average Particle Diameter (Dn) and Dw/Dn>

The weight average particle diameter (Dw), the volume average particle diameter (Dv) and the number average particle diameter (Dn) of the toner were measured as follows. Specifically, using a particle size analyzer ("MULTISIZER III," manufactured by Beckman Coulter Inc.) with the aperture diameter being set to 100 μm, and the obtained measurements were analyzed with an analysis software (Beckman Coulter MULTISIZER 3 Version 3.51). More specifically, 0.5 mL of a 10% by mass surfactant (alkylbenzene sulfonate, Neogen SC-A, manufactured by Daiichi Kogyo Seiyaku Co., Ltd.) was charged to a 100 mL-glass beaker, and 0.5 g of a toner sample was added thereto, followed by stirring with a microspatula. Subsequently, 80 mL of ion-exchanged water was added to the beaker. The obtained dispersion liquid was subjected to dispersion treatment for 10 min using an ultrasonic wave dispersing device (W-113MK-II, manufactured by Honda Electronics Co., Ltd.). The resultant dispersion liquid was measured using MULTISIZER III and ISOTON III (manufactured by Beckman Coulter Inc.) serving as a solution for measurement. The dispersion liquid containing the toner sample was dropped so that the concentration indicated by the meter fell within a range of 8%±2%. In this measuring method, it was important in terms of reproducibility of measuring the particle size that the concentration was adjusted to the range of 8%±2%. When the concentration indicated by the meter fell within the range of 8%±2%, no error was occurred in the measurement of the particle size.

<Average Circularity of Toner>

The average circularity of the toner was defined by the following equation.

Average circularity $SR$=(Circumferential length of a circle having the same area as projected particle area/Circumferential length of projected particle image)×100(%)

The average circularity of the toner was measured using a flow-type particle image analyzer ("FPIA-2100," manufactured by SYSMEX CORPORATION), and analyzed using an analysis software (FPIA-2100 Data Processing Program for FPIA Version00-10). Specifically, into a 100 mL glass beaker, 0.1 mL to 0.5 mL of a 10% by mass surfactant (NEOGEN SC-A, an alkylbenzene sulfonate, manufactured by Dai-ichi Kogyo Seiyaku Co., Ltd.) was charged, and 0.1 g to 0.5 g of a toner was added, followed by stirring with a microspatula. Subsequently, 80 mL of ion-exchanged water was added to the beaker. The obtained dispersion liquid was subjected to dispersion treatment for 3 min using an ultrasonic wave dispersing device (manufactured by Honda Electronics Co., Ltd.). Using FPIA-2100, the shape and distribution of toner particles were measured until the dispersion liquid had a concentration of 5,000 number per μL to 15,000 number per μL.

<BET Specific Surface Area of Toner>

The BET specific surface area of the toner was measured with an is automatic specific surface area/pore distribution measuring device TRISTAR 3000 (manufactured by SHIMADZU CORPORATION). One gram of the toner was placed in a dedicated cell, and the inside of the dedicated cell was degassed using a degassing dedicated unit for TRISTAR, VACUPREP 061 (manufactured by SHIMADZU CORPORATION). The degassing treatment was carried out at room temperature at least for 20 hr under the condition of reduced pressure at equal to or less than 100 mtorr. The dedicated cell subjected to the degassing treatment was subjected to the BET specific surface area measurement with TRISTAR 3000, to thereby automatically obtain a BET specific surface area of the toner. Nitrogen gas was used as absorbing gas.

<Volume Specific Resistance of Toner>

The common logarithm Log ρ of volume specific resistance ρ of the toner was measured as follows. First, 3 g of the toner was formed into a pellet having a thickness of approximately 2 mm, to thereby form a sample for measurement. The sample was set in electrodes for solid SE-70 (manufactured by Ando Electric Co., Ltd.), and then Log R when 1 kHz of alternating current was applied to the electrodes was measured using a measurement device consisting of a dielectric loss measuring instrument TR-10C, an oscillator WBG-9, and an equilibrium point detector BDA-9 (manufactured by Ando Electric Co., Ltd.), to thereby obtain Log ρ of the toner.

TABLE 3

| | Number of Dispersion Liquid of Crystalline Polyester Resin | Dispersion diameter of crystalline polyester resin (μm) | Shape of crystalline polyester resin particle | Amount of isophorone-diamine (parts) | Emulsification rate (rpm) | Dw1 (μm) | Dw2 (μm) | ΔDw |
|---|---|---|---|---|---|---|---|---|
| Ex. 1 | 1 | 85 | Needle shape | 0 | 8,000 | 4.2 | 5.1 | 0.9 |
| Ex. 2 | 1 | 85 | Needle shape | 0.5 | 8,000 | 4.8 | 5.4 | 0.6 |
| Ex. 3 | 1 | 85 | Needle shape | 1.0 | 8,000 | 5.0 | 5.2 | 0.2 |
| Comp. Ex. 1 | 1 | 85 | Needle shape | 0 | 12,000 | 4.0 | 5.3 | 1.3 |
| Ex. 4 | 2 | 73 | Needle shape | 0.5 | 8,000 | 4.8 | 5.3 | 0.5 |
| Comp. Ex. 2 | 2 | 73 | Needle shape | 0 | 13,000 | 4.2 | 5.3 | 1.1 |
| Ex. 5 | 3 | 82 | Needle shape | 0.5 | 8,000 | 4.9 | 5.1 | 0.2 |
| Comp. Ex. 3 | 3 | 82 | Needle shape | 0 | 12,000 | 4.1 | 5.4 | 1.3 |
| Ex. 6 | 4 | 93 | Needle shape | 0.5 | 6,000 | 4.5 | 5.1 | 0.6 |
| Comp. Ex. 4 | 4 | 93 | Needle shape | 0.1 | 10,000 | 4.2 | 5.3 | 1.1 |
| Comp. Ex. 5 | 5 | 90 | Substantially spherical shape | — | — | — | — | — |

TABLE 4

| | Weight average particle diameter Dw (μm) | Dw/Dn | Average circularity | BET specific surface area ($m^2/g$) | Volume specific resistance (logΩcm) |
|---|---|---|---|---|---|
| Ex. 1 | 5.0 | 1.14 | 0.960 | 1.48 | 11.2 |
| Ex. 2 | 5.3 | 1.12 | 0.950 | 1.49 | 11.3 |
| Ex. 3 | 5.1 | 1.15 | 0.960 | 1.59 | 11.1 |

TABLE 4-continued

| | Weight average particle diameter Dw (μm) | Dw/Dn | Average circularity | BET specific surface area ($m^2/g$) | Volume specific resistance (logΩcm) |
|---|---|---|---|---|---|
| Comp. Ex. 1 | 5.2 | 1.15 | 0.985 | 1.60 | 11.2 |
| Ex. 4 | 5.3 | 1.14 | 0.965 | 1.48 | 11.2 |
| Comp. Ex. 2 | 5.2 | 1.15 | 0.99 | 1.59 | 11.0 |
| Ex. 5 | 5.1 | 1.14 | 0.960 | 1.56 | 11.2 |
| Comp. Ex. 3 | 5.3 | 1.13 | 0.983 | 1.60 | 11.2 |
| Ex. 6 | 5.1 | 1.13 | 0.955 | 1.49 | 11.1 |
| Comp. Ex. 4 | 5.2 | 1.15 | 0.987 | 1.60 | 11.2 |
| Comp. Ex. 5 | 5.5 | 1.22 | 0.995 | 1.35 | 11.0 |

Production Example 1

Production of Carrier

The materials for the carrier were dispersed with a homomixer for 10 min to obtain a solution for forming a coating film of the acrylic resin and the silicone resin containing alumina particles.

—Carrier—

| | |
|---|---|
| Acrylic resin solution (solid content: 50% by mass) | 21.0 parts |
| Guanamine solution (solid content: 70% by mass) | 6.4 parts |
| Alumina particles (0.3 μm, specific resistance: $10^{14}$ Ω · cm) | 7.6 parts |
| Silicone resin solution (SR2410, solid content: 23% by mass, manufactured by Dow Corning Toray Silicone Co., Ltd.) | 65.0 parts |
| Aminosilane (solid content: 100% by mass, SH6020, manufactured by Dow Corning Toray Silicone Co., Ltd.) | 1.0 part |
| Toluene | 60 parts |
| Butyl cellosolve | 60 parts |

The solution for forming a coating film was applied onto the surface of fired ferrite powder, $(MgO)_{1.8}(MnO)_{49.5}(Fe_2O_3)_{48.0}$, having an average particle diameter of 25 μm serving as a core material, so as to have a thickness of 0.15 μm with SPILA COATER (manufactured by OKADA SEIKO CO., LTD.), followed by drying, to thereby obtain coated ferrite powder. The coated ferrite powder was allowed to stand in an electric furnace at 160° C. for one hour for firing. After cooling, the ferrite powder bulk was disintegrated with a sieve with an opening of 106 μm to obtain a carrier having a weight average particle diameter of 35 μm.

By observing a cross section of the carrier with transmission electron microscope, the thickness of the film coating the carrier surface could be observed. An average value of the thickness of the coating film was determined as the thickness of the coating film.

Production Example 2

Production of Two-Component Developer

A two-component developer was produced using each of the toners and the carrier. Specifically, 7 parts of the toner and 100 parts of the carrier were uniformly mixed using a tubular mixer including a container that was tumbled for stirring, and then charged to thereby produce the two-component developer.

Next, by using the produced toner and two-component developer, durability, fixing ability, heat resistant storage stability, cleaning ability, and position of crystalline polyester resin near toner surface by TEM observation were evaluated as described below. The results are shown in Table 5.

<Durability>

An evaluation machine, which was a modified machine of a digital full-color copier, IMAGIO COLOR 2800 (manufactured by Ricoh Company, Ltd.), which included a primary transfer unit configured to transfer a toner image formed on an electrophotographic photoconductor to an intermediate transfer medium, a secondary transfer unit configured to transfer the toner image from the intermediate transfer medium to a recording medium, and a fixing unit configured to fix the toner image on the recording medium by heat and pressure fixing member, and subjected to tuning so that the linear velocity and the transfer time could be adjusted, was provided. Each developer was subjected to a 100,000-sheet running test with the evaluation machine in which a solid image pattern of size A4 at a toner, coverage of 0.6 $mg/cm^2$ was outputted as a test pattern. As an index of durability, the developers before and after 100,000-sheet running test were sampled and measured for charge amount by the method described below. The charge amount of the toner before the 100,000-sheet running test was compared with the charge amount thereof after the 100,000-sheet running test, to thereby evaluate durability.

—Charge Amount Before and After 100,000-Sheet Running Test (Charge Amount of Toner in the Copier)—

The charge amount of the toner before and after the 100,000-sheet running test were measured using a blow-off device (manufactured by RICOH SOZO KAIHATSU K.K.). One gram of a developer sampled from the copier, and a charge amount distribution of the sampled toner was measured by a single mode method using a blow-off apparatus (manufactured by RICOH SOZO KAIHATSU K.K.). At the time of blow, an opening of 635 mesh was used. In the single mode, measurement was performed under conditions of height 5 mm, suction pressure (negative pressure) 100 mmHg, and blow twice using the blow-off device (manufactured by RICOH SOZO KAIHATSU K.K.).

<Fixing Ability>

A test for copying was carried out on type 6200 paper (Ricoh Company, Ltd.) using each developer and a copier which had been arranged by modifying a fixing part of a copier (MF2200, manufactured by Ricoh Company, Ltd.) having a TEFLON roller for a fixing roller.

Specifically, a temperature at which cold offset would occur (lower limit temperature for fixing) and a temperature at which hot offset would occur (upper limit temperature for fixing) were determined by changing temperatures for fixing.

Conditions for evaluation of the lower limit temperature for fixing were as follows: linear speed for paper sending; 120 mm/sec to 150 mm/sec; pressure applied on surface: 1.2 $kgf/cm^2$; and a nip width: 3 mm.

Conditions for evaluation of the upper limit temperature for fixing were as follows: linear speed for paper sending: 50 mm/sec; pressure applied on surface: 2.0 $kgf/cm^2$; and a nip width: 4.5 mm.

<Heat Resistant Storage Stability>

Each toner was stored at 50° C. for 8 hours, and sieved through a 42-mesh sieve for 2 min. Then, a proportion of the toner remained on a metal mesh was measured, and evaluated based on the following evaluation criteria. In this case, the better the heat-resistant-storage stability of the toner was, the smaller the proportion of the toner remained on the metal mesh.

Evaluation Criteria

A: The ratio of the remaining toner was less than 10%.

B: The ratio of the remaining toner was 10% or more and less than 20%.

C: The ratio of the remaining toner was 20% or more and less than 30%.

D: The ratio of the remaining toner was 30% or more.

<Cleaning Ability>

After the durability was evaluated, a solid image of horizontal A4 size was printed. The operation of a machine was stopped during printing, a trace, of a toner remaining backward of a cleaning blade on an organic photoconductor (OPC) was collected using a transparent tape, and attached to white paper, and then cleaning ability was evaluated based on the following evaluation criteria.

Evaluation Criteria

A: No toner was observed.

B: One or more and less than three lines formed of the toner which passed through the cleaning blade were observed.

C: Three or more and less than ten lines formed of the toner which passed through the cleaning blade were observed.

D: Ten or more lines formed of the toner which passed through the cleaning blade were observed.

<Position of Crystalline Polyester Resin Near Toner Surface by TEM Observation>

Each toner was stained by being exposed to vapor of 5% by mass aqueous solution of commercially available ruthenium tetroxide. Subsequently, the toner was wrapped with an epoxy resin, and then cut with a microtome (Ultracut-E) using a diamond knife. The thus-cut section was adjusted to a thickness of about 100 nm using an interference color of the epoxy resin. The section was placed on a copper grid mesh, and exposed to vapor of 5% by mass aqueous solution of commercially available ruthenium tetroxide, and then observed under a transmission electron microscope, JEM-2100F (manufactured by JEOL Ltd.), followed by photographing a cross section of the toner in the section. Cross sections of 20 toner particles were observed. Specifically, a surface part of the toner particle formed of the fine resin particles and the crystalline polyester resin (outline of a cross section of a toner particle) was observed, and a state where the fine resin particles and crystalline polyester resin were present was evaluated.

By observing a TEM image of the cross section of the toner particle, the position of the crystalline polyester resin in the toner particle was confirmed. The proportion that the crystalline polyester resin present within 1 μm-depth from the outermost surface of the toner particle was obtained in the following manner. In the TEM image of the cross section of the toner particle, the outline of the part where the crystalline polyester resin was present was judged from a crystalline lamellar layer, and then an area of the crystalline polyester resin was surrounded to form a diagram. The sum of the surrounded areas, and the outline diagram of the crystalline lamellar layer present within 1 μm-depth from the outermost surface of the toner particle were subjected to image processing. The proportion that the crystalline polyester resin present within 1 μm-depth from the outermost surface of the toner particle is obtained by calculating a ratio of the area of the part where the crystalline polyester resin present within 1 μm-depth from the outermost surface of the toner particle to the total areas of the crystalline polyester resin. This process was performed with respect to twenty toner particles, and the obtained values were averaged, and then evaluated based on the following evaluation criteria.

Evaluation Criteria

"Localized near toner surface": Within 1 μm-depth from the outermost surface of the toner particle 90% or more of the crystalline polyester resin located, and inside the toner particle the crystalline polyester resin hardly located.

"Dispersed inside toner": The crystalline polyester resin dispersed throughout the toner particle, and located inside the toner particle.

TABLE 5

| | Durability | | Fixing ability | | Heat | | Position of the |
|---|---|---|---|---|---|---|---|
| | Charge amount (μC/g) | | Lower limit | Upper limit | resistant | | crystalline polyester |
| | Before 100,000-sheet running test | After 100,000-sheet running test | temperature for fixing (° C.) | temperature for fixing (° C.) | storage stability | Cleaning ability | resin near toner surface by TEM observation |
| Ex. 1 | 46 | 38 | 125 | 190 | B | B | Localized near toner surface |
| Ex. 2 | 48 | 41 | 120 | 180 | B | A | Localized near toner surface |
| Ex. 3 | 48 | 48 | 120 | 190 | A | A | Localized near toner surface |
| Comp. Ex. 1 | 48 | 20 | 130 | 180 | D | C | Dispersed inside toner |
| Ex. 4 | 40 | 39 | 120 | 185 | B | A | Localized near toner surface |
| Comp. Ex. 2 | 50 | 16 | 130 | 170 | C | C | Dispersed inside toner |
| Ex. 5 | 51 | 49 | 125 | 190 | A | B | Localized near toner surface |
| Comp. Ex. 3 | 49 | 13 | 140 | 180 | C | C | Dispersed inside toner |
| Ex. 6 | 38 | 40 | 120 | 190 | B | B | Localized near toner surface |
| Comp. Ex. 4 | 30 | 10 | 185 | 175 | D | D | Dispersed inside toner |
| Comp. Ex. 5 | 35 | 22 | 170 | 180 | D | D | Dispersed inside toner |

INDUSTRIAL APPLICABILITY

The toner of the present invention is excellent in toner chargeability, durability and environmental stability, and can achieve a small particle diameter, in full color image forming method, thus high quality images can be stably obtained, thereby being suitably used for various electrophotographic image formation,

REFERENCE SIGNS LIST

10K: photoconductor for black
10M: photoconductor for magenta
10C: photoconductor for cyan
10Y: photoconductor for yellow
14, 15, 16: support rollers
17: intermediate transfer medium cleaning device
18: image forming unit
21: exposing device
22: secondary transfer unit
23: roller
25: fixing device
26: fixing belt
27: pressure roller
28: sheet reversing device
32: contact glass
33: first carriage
34: second carriage
35: image-forming lens
36: read sensor
49: registration roller
50: intermediate transfer medium
51: manual bypass tray
53: manual bypass feeder path
55: switch claw
56: ejecting roller
57: output tray
100 image forming apparatus
110: copier main body.
120; tandem image forming device
130: document table
142: feeder roller
143: paper bank
144: multiple feeder cassette
145: separation roller
146: feeder path
147: transport roller
148: feeder path
200: paper feed table
220: intermediate transfer belt
300: scanner
400: automatic document feeder
500: roller charging device
501: charging roller
502: metal core
503: conductive rubber layer
505: photoconductor
510: brush charging device
511: fur brush roller
513: brush part
514: power supply
515: photoconductor
600: developing device
601: developing sleeve
602: power supply
603: developing section
604: photoconductor
605: toner
710: heating roller
720: fixing roller
730: endless fixing belt
731: substrate
732: heat generating layer
733: intermediate layer
734: release layer
740: pressure roller
741: metal core
742: elastic member
760: induction heating unit
761: exciting coil
762: coil guide plate
763; exciting coil core
764: exciting coil core support
770: recording medium
800: process cartridge
801: photoconductor
802: charging unit
803: developing unit,
804; developer
806: cleaning unit
100: image forming apparatus
130Bk, 130C, 130M, 130Y: image forming units
140: paper feeder
200Bk, 200C, 200M, 200Y: developing devices
210Bk, 210C, 210M, 210Y: photoconductors
215Bk, 215C, 215M, 215Y: charging devices
230Bk, 230C, 230M, 230Y: primary transfer devices
300Bk, 300C, 300M, 300Y: cleaning devices

The invention claimed is:

1. A toner comprising a binder resin and a crystalline polyester resin, wherein the crystalline polyester resin is localized near a surface of the toner.

2. The toner of claim 1, wherein the crystalline polyester resin is localized within a 1 μm-depth from an outermost surface of the toner.

3. The toner of claim 1, wherein the crystalline polyester resin has a needle shape.

4. The toner of claim 1, wherein the crystalline polyester resin has an average particle diameter of 10 nm to 500 nm.

5. The toner of claim 1, comprising 1 part by mass to 30 parts by mass of the crystalline polyester resin, relative to 100 parts by mass of the toner.

6. The toner of claim 1, wherein the toner has an average circularity of 0.95 to 0.99.

7. A method for producing a toner, comprising:

dissolving or dispersing in an organic solvent a toner material comprising (i) a binder resin and (ii) a dispersion liquid of a crystalline polyester resin, to obtain a solution or dispersion liquid of the toner material, emulsifying or dispersing the solution or dispersion liquid of the toner material in an aqueous medium, to obtain an emulsion or dispersion liquid, and removing the organic solvent from the emulsion or dispersion liquid, to obtain a toner, wherein a value calculated by subtracting Dw1 from Dw2 is 1 μm or less, and wherein Dw1 is a weight average particle diameter of the toner just before completion of emulsification in the emulsifying or dispersing, and Dw2 is a weight average particle diameter of the toner obtained in the removing of the organic solvent.

8. The method of claim 7, wherein the crystalline polyester resin has an average particle diameter of 10 nm to 500 nm.

9. The method of claim 7, wherein the solution or dispersion liquid of the toner material comprises a cationic compound, and the aqueous medium comprises fine anionic resin particles having an average particle diameter of 5 μm to 50 μm and an anionic surfactant.

10. A developer comprising a toner, wherein the toner comprises a binder resin and a crystalline polyester resin, and wherein the crystalline polyester resin is localized near a surface of the toner.

11. The toner of claim 1, obtained by a process comprising:

dissolving or dispersing in an organic solvent a toner material comprising (i) a binder resin and (ii) a dispersion liquid of the crystalline polyester resin, to obtain a solution or dispersion liquid of the toner material, emulsifying or dispersing the solution or dispersion liquid of the toner material in an aqueous medium, to obtain an emulsion or dispersion liquid, and removing the organic solvent from the emulsion or dispersion liquid, to obtain the toner.

12. The method of claim 7, wherein the toner material further comprises (iii) a compound having an active hydrogen group and (iv) a modified polyester resin reactive with the compound.

13. The toner of claim 1, wherein the crystalline polyester resin has a weight average molecular weight Mw of 3000 to 30,000, a number average molecular weight Mn of 1000 to 10,000, and a ratio Mw/Mn in a range of 1 to 10.

14. The toner of claim 1, wherein the crystalline polyester resin has a weight average molecular weight Mw of 5000 to 15,000, a number average molecular weight Mn of 2000 to 10,000, and a ratio Mw/Mn in a range of 1 to 5.

15. The toner of claim 1, wherein the binder resin is a polyester resin.

16. The toner of claim 1, wherein the toner has a volume average particle diameter of 1 μm to 6 μm.

17. The toner of claim 1, wherein the toner has a volume average particle diameter of 2 μm to 5 μm.

18. The toner of claim 1, wherein a ratio, Dw/Dn, of a weight average particle diameter Dw of the toner, to a number average particle diameter Dn of the toner, is in a range of 1.05 to 1.25.

19. The toner of claim 1, wherein the toner has a BET specific surface area of 0.5 $m^2/g$ to 4.0 $m^2/g$.

20. The toner of claim 1, wherein the toner has a BET specific surface area of 0.5 $m^2/g$ to 2.0 $m^2/g$.

* * * * *